US007584709B2

(12) United States Patent
Nakatsu et al.

(10) Patent No.: US 7,584,709 B2
(45) Date of Patent: Sep. 8, 2009

(54) SEWING FRAME OF SEWING MACHINE AND SEWING FRAME DRIVE MECHANISM

(75) Inventors: Akira Nakatsu, Ichinomiya (JP); Keisuke Kasugai, Ichinomiya (JP)

(73) Assignee: Kabushikikaisha Barudan, Ichinomiya-shi, Aichi-ken (JP)

( * ) Notice: Subject to any disclaimer, the term of this patent is extended or adjusted under 35 U.S.C. 154(b) by 156 days.

(21) Appl. No.: 11/797,222

(22) Filed: May 1, 2007

(65) Prior Publication Data

US 2008/0110384 A1 May 15, 2008

(30) Foreign Application Priority Data

| | | |
|---|---|---|
| May 2, 2006 | (JP) | 2006-128178 |
| May 2, 2006 | (JP) | 2006-128179 |
| May 8, 2006 | (JP) | 2006-129707 |
| May 9, 2006 | (JP) | 2006-130823 |
| May 9, 2006 | (JP) | 2006-130862 |
| May 9, 2006 | (JP) | 2006-130901 |
| Jul. 12, 2006 | (JP) | 2006-192205 |
| Feb. 8, 2007 | (JP) | 2007-028854 |
| Feb. 8, 2007 | (JP) | 2007-028859 |

(51) Int. Cl.
*D05B 39/00* (2006.01)
*D05C 9/04* (2006.01)

(52) U.S. Cl. ..... 112/103; 112/470.14; 112/470.18

(58) Field of Classification Search ..... 112/103, 112/470.14, 470.15, 470.18, 475.18, 475.11, 112/475.12

See application file for complete search history.

(56) References Cited

U.S. PATENT DOCUMENTS 2,148,614 A * 2/1939 Gilardone ..... 112/90
5,018,460 A * 5/1991 Schilling et al. ..... 112/103
5,353,725 A * 10/1994 Sakakibara ..... 112/103
5,915,314 A * 6/1999 Moore, III ..... 112/103
6,065,413 A 5/2000 Kawaguchi (Continued)

FOREIGN PATENT DOCUMENTS

JP 7-109660 4/1995

(Continued)

OTHER PUBLICATIONS

United Kingdom Search Report dated Aug. 29, 2007.

*Primary Examiner*—Ismael Izaguirre
(74) *Attorney, Agent, or Firm*—McGinn IP Law Group, PLLC

(57) ABSTRACT

A sewing frame for extending and holding a sewing cloth is provided with a supported portion, such as a shaft and an engagement portion, which is movably or rotatably supported at front and rear frame side portions of the rectangular support frame at the front and rear ends. A sewing frame drive mechanism includes a support mechanism for supporting the front and rear ends of the sewing frame movably at the front and rear frame side portions of the support frame which is movable in the longitudinal direction but not movable in the lateral direction. The sewing frame drive unit includes left and right protruding portions to the left and right of recess portions of a table, and a front hanging preventive mechanism formed of left and right frame side portions of the support frame movably disposed on the left and right protruding portions in the longitudinal direction.

22 Claims, 58 Drawing Sheets

U.S. PATENT DOCUMENTS

| | | | | |
|---|---|---|---|---|
| 6,374,760 | B1 | 4/2002 | Moore, III | |
| 6,792,884 | B1 | 9/2004 | Barrus | |
| 7,194,966 | B2 * | 3/2007 | Tajima et al. | 112/103 |

FOREIGN PATENT DOCUMENTS

| | | | |
|---|---|---|---|
| JP | 2003-326049 | | 11/2003 |
| JP | 2004-49548 | | 2/2004 |
| JP | 2004-91974 | | 3/2004 |
| JP | 2005-199091 | | 7/2005 |
| WO | WO 2004/040052 | A1 | 5/2004 |

* cited by examiner

SEWING FRAME OF SEWING MACHINE AND SEWING FRAME DRIVE MECHANISM

TECHNICAL FIELD

The present invention relates to a sewing frame for extending and holding a cloth to be embroidered with a sewing machine, and a sewing frame drive mechanism to drive the sewing frame.

BACKGROUND OF THE INVENTION

In the aforementioned sewing frame drive mechanism such as a related art sewing frame drive mechanism 900 shown in FIG. 58, rear ends of cylindrical sewing frames 880 for extending/holding a sewing cloth (not shown) is rotatably supported at a bar-like support frame 910 which displaces in the longitudinal direction but does not displace in the lateral direction (disclosed in Japanese Patent Application Publication No. JP-A-2005-199091).

There has been a well-known mechanism structured to apply the sewing cloth to a sewing window formed in the cylindrical sewing frame via an interliner, and to allow the frame drive mechanism of the embroidery sewing machine to move the sewing frame in the longitudinal direction and to rotate the sewing frame around the axis in the longitudinal direction to embroider the sewing cloth.

In Japanese Patent Application Publication No. JP-A-2003-326049, the longitudinally long sewing window is formed in the cylindrical sewing frame to hold the interliner which covers the sewing window at the sewing frame with the interliner holding member which is longer than the sewing window such that the tubular sewing cloth such as socks, wrist bands or the like is applied to the interliner. The similarly structured frame is disclosed in Japanese Patent Application Publication No. JP-A-2004-91974.

In Japanese Patent Application Publication No. JP-A-7-109660, the longitudinally short sewing frame is supported at the cylindrical inner frame internally to suppress jumping or deformation of the hat held by the sewing frame.

In Japanese Patent Application Publication No. JP-A-2004-49548, the cylindrical frame is divided into a pair of front and rear cylindrical elements in the longitudinal direction to form the sewing window therebetween having substantially entire periphery opened, and the longitudinal position of one of those elements is adjusted to allow the length of the sewing window to be changed.

SUMMARY OF THE INVENTION

The structure shown in FIG. 58 has no problem so long as the longitudinal length L0 of the sewing frame 880 is sufficiently short as shown in FIG. 58. However, the length L0 is required to be made long depending on the conditions of the sewing cloth. In the aforementioned case, the rear end of the sewing frame 880 is held at a single side only. Accordingly, the unsupported front end hangs downward. It is difficult to make the length L0 of the sewing frame 880 to the predetermined length or longer.

It is therefore an object of the present invention to suppress hanging down of the front end of the sewing frame.

In the sewing frame disclosed in Japanese Patent Application Publication No. JP-A-2003-326049 or No. JP-A-7-109660, the embroidery range on the sewing cloth is defined by the size of the sewing window. When the large embroidery pattern long in the longitudinal direction and wide in the lateral direction is formed on the long tubular cloth like jeans, the sewing window becomes large in accordance with the size of the embroidery pattern. If the sewing window is enlarged in the generally employed cylindrical frame, the interliner (interlining paper) is set on the sewing frame, on which the sewing cloth is applied for the purpose of compensating the reduction in the force for holding the sewing cloth. Upon processing of the long and heavy material such as the jeans and the golf bag, the sewing frame is required to be long. The front end of the cylindrical frame hangs downward with the sewing frame and the sewing material, resulting in deteriorated accuracy for processing the embroidery pattern.

It is therefore an object of the present invention to provide a sewing frame capable of enlarging the embroidery range without reducing the force for holding the sewing cloth, applying the sewing cloth easily without interliner, and processing the embroidery pattern on the long tubular cloth with high accuracy by preventing the front hanging of the sewing frame.

The sewing frame disclosed in Japanese Patent Application Publication No. JP-A-2003-326049 holds only the front and rear ends of the interliner holding member. If the length of the interliner holding member is increased, the force for holding the interliner around the intermediate area of the sewing window becomes insufficient. The impact caused by the needle drop may deform the interliner, and accordingly, slack or wrinkles may occur in the sewing cloth, resulting in deteriorated accuracy in processing the embroidery pattern.

It is therefore an object of the present invention to improve the processing accuracy in the embroidery pattern with the long sewing frame with a longitudinally long sewing window by preventing deformation of the interliner which covers the sewing window.

In the sewing frame disclosed in Japanese Patent Application Publication No. JP-A-2003-326049, the sewing window is formed on the peripheral wall of the sewing frame. In the case where the embroidery pattern which is long in the longitudinal direction is processed on the long tubular cloth, for example, the sleeve of the outer wear, the trousers (jeans) and the like, the cylindrical frame has to be replaced. In the cylindrical frame disclosed in Japanese Patent Application Publication No. JP-A-2004-49548 allows adjustment of the length of the sewing window. However, as the sewing window is widely opened in the peripheral direction of the cylindrical frame, the force for holding the sewing cloth becomes insufficient especially when the long embroidery pattern is processed on the lateral area of the long tubular cloth, resulting in lack of practicality.

It is therefore an object of the present invention to provide a sewing frame for processing the embroidery which allows accurate processing of various embroidery patterns in the lateral direction while being long in the longitudinal direction on the long tubular cloth.

The sewing frame disclosed in Japanese Patent Application Publication No. JP-A-2003-326049 or No. JP-A-2004-91974 has the disadvantage in the weight resulting from the elongated sewing frame, and has the sewing window formed into the rectangular shape. In the case where the irregularly shaped cloth having a narrow portion, for example, boot-cut jeans is processed, the sewing frame with the diameter which can be inserted into the narrow portion is required. However, as the width of the sewing window becomes insufficient for processing the large pattern on the wide portion, the sewing frame has to be replaced with the large-diameter sewing frame having the wide sewing window, resulting in the disadvantage of requiring two kinds of cylindrical frames for processing a single cloth. As the tubular cloth is applied onto the sewing window with the embroidery pattern to be processed being cylindrically curved, the embroidering process may be limited owing to difficulty in stitching of the cord and sequin.

It is therefore an object of the present invention to provide a sewing frame capable of efficiently processing the embroidery patterns with different sizes with respect to the narrow portion and the wide portion of the long cloth using the light-weight sewing frame. It is another object of the present invention to provide the light and flat plate-like sewing frame capable of efficiently processing the embroidery pattern on the tubular cloth in accordance with an arbitrary embroidery method.

In order to achieve the object, a sewing frame of a sewing machine according to the present invention comprises supported portions each provided at a front end and a rear end of the sewing frame. The supported portions are supported at a front frame side portion and a rear frame side portion of a rectangular support frame so as to be movable in a lateral direction. The "movable in a lateral direction" represents that at least a part of the sewing frame is movable in the lateral direction. More specifically, the case where the flat sewing frame is movable in parallel with the lateral direction, and the upper portion of the cylindrical sewing frame for extending/holding the sewing cloth is movable in the lateral direction accompanied with the rotation of the frame may be exemplified, which will apply to the description to be explained as follows.

The sewing frame drive mechanism of the sewing machine for driving a sewing frame for extending and holding a sewing material according to the present invention comprises a rectangular support frame which is movable in a longitudinal direction and not movable in the lateral direction, and support mechanisms each provided at a front frame side portion and a rear frame side portion of the support frame. The support mechanisms support a front end and a rear end of the sewing frame, respectively, so that the front and rear end of the sewing frame are movable in a lateral direction.

Preferably, the sewing frame drive mechanism is provided with a front hang preventive mechanism which prevents the front frame side portion of the support frame from hanging downward with respect to the rear frame side portion. Preferably, the front hang preventive mechanism includes left and right protruding portions of a table which protrude relatively forward by forming a recess portion from a front side of the table rearward, and left and right frame side portions of the support frame movably disposed in a longitudinal direction above the left and right protruding portions. However, they are not limited to those described above. Preferably, the slide member for reducing the sliding friction is interposed between the lateral protrusion and the lateral frame side portion.

Preferably, the sewing frame drive mechanism is provided with a guide mechanism which guides a longitudinal movement of the support frame so as not to move in a lateral direction to prevent a lateral shaking. Preferably, the guide mechanism is formed of left and right inner end surfaces of a recess portion formed from a front side of a table rearward, and a guide roller attached to left and right frame side portions of the support frame allowed to roll in abutment against the inner end surfaces. However, they are not limited to those described above.

The guide mechanism is not limited to the specific structure. Preferably, however, the guide mechanism includes a position adjustment mechanism which adjusts a position of the guide roller in a lateral direction. It is preferable to attach the guide roller to the top end portion of the protruding member having the base portion fixed to the support frame and the top end portion attached to the protruding member protruding into the support frame, and further preferable to combine the long hole laterally extending through the base portion of the protruding member with a screw for fixing the long hole with the support frame.

It is preferable to use the sewing frame drive mechanism when the longitudinal length of the sewing frame is 30 cm or longer, and more preferably, when it is in the range from 50 to 100 cm. As the sewing frame becomes longer, the need for the drive mechanism is heightened. The upper limit of the length is set because excessively long frame may deteriorate the practical usability.

Various kinds of trousers, for example, jeans may be exemplified as the sewing cloth. However, it is not limited to those described above.

When the sewing frame is cylindrical, the sewing frame includes a cylindrical inner frame inserted into the sewing frame and supported at a rear frame side portion of the support frame so as not to be rotated. The supported portion which is supported at a front frame side portion of the support frame is formed at a front end of the inner frame. An opening with a size which allows an operator's hand to be inserted into the inner frame is formed in a front end thereof.

In the sewing frame drive mechanism, front and rear ends of each of a plurality of the sewing frames are supported at front and rear frame side portions of the support frame by the support mechanisms, and a lateral intermediate portion of the front frame side portion of the support frame is supported by a front frame side support mechanism so as to be movable in a longitudinal direction, and so as not to have a front portion hang downward. The front frame side support mechanism is not limited to the specific structure. Preferably, however, it includes a longitudinally extending support shaft which is provided movably in the longitudinal direction with the support frame, and supports a lateral intermediate portion of the front frame side portion at the front end. The above structure prevents the front end of the support shaft which directly supports the support frame from projecting forward of the support frame so as not to become the obstacle to the entire front frame side support mechanism.

It is preferable to connect the rear end of the support shaft to the lateral intermediate position of the rear frame side portion of the support frame for the purpose of further stabilizing the support shaft. However, it is not limited to the one as described above.

The front frame side support mechanism includes a support frame fixed to a sewing machine frame and a support shaft with which the support frame is movably provided in the longitudinal direction. A front end of the support shaft is provided with a support portion for supporting the lateral intermediate portion of the front frame side portion. A front end of the support frame is provided with an antivibrating device in contact with at least an upper surface of the support shaft for regulating vibration of the shaft.

The antivibration member is not limited to the specific member. For example, the slide member which is slidably in contact with the support shaft, or the rolling member which is rolling in contact with the support shaft may be used. The slide member or the rolling member may be brought into contact with the upper surface of the support shaft so as to suppress the vertical vibration of the shaft from one side. The slide member or the rolling member may be brought into contact with the upper and the lower surfaces of the support shaft so as to restrict the vertical vibration of the shaft from both sides.

The front frame side support mechanism may be structured to include a link member linked to the lateral intermediate portion of the support frame and a bearing member for bearing the link member movably in the longitudinal direction at a lower side of the support frame. The bearing member may be connected to the sewing machine frame, disposed on the floor surface, or supported at the sewing machine frame and the floor surface. It is preferable to provide the bearing member having its height adjustable.

Various modes of the sewing frame may include the following.

[A] The sewing frame has a longitudinally long cylindrical shape and includes a cylindrical inner frame to be inserted into the sewing frame. A longitudinally long sewing window is formed in the sewing frame for defining an embroidery range to be processed on a sewing cloth. A rear end of the sewing frame is provided with a link portion linked to a rotating drive mechanism on the support frame. A longitudinally long needle hole through which a sewing needle of en embroidery sewing machine pierces is formed in the inner frame. A rear end of the inner frame is provided with an attachment portion attached to a fixing portion on the support frame. A front end of one of the sewing frame and the inner frame is provided with a support portion supported at a front frame of the support frame.

[B] The sewing frame has a cylindrical shape, and includes the sewing window for defining an embroidery range to be processed on a sewing cloth formed therein. An interliner which covers the sewing window is used to hold the sewing cloth along an outer surface of the sewing frame. An interliner holding member for pressing the interliner against the sewing frame is provided. Front and rear ends of the interliner holding member are held at the sewing frame to front and rear portions of the sewing window. A pressure member for pressing an intermediate portion of the interliner holding member against the sewing frame at a longitudinal intermediate portion of the sewing window is provided.

The interliner holding member is not limited to the specific member. For example, the band-like member, bar-like member, the rigid member, the elastic member and the like each having substantially the same length as that of the sewing frame may be used. A pair of left and right interliner holding members may be provided at the left and right sides of the sewing frame. One of the front and rear ends of the interliner holding member may be fixedly held at the sewing frame, while holding the other end to be detachable with respect to the sewing frame so as to allow easy replacement of the interliner.

The pressing member is not limited to the specific member. For example, the member for pressing the interliner holding member against the sewing frame using elasticity of its own, or the member for pressing the interliner holding member against the sewing frame using the attracting force of the magnet may be used. The pressing member may be provided movably on the sewing frame between the operational position and the non-operational position so as to easily release the pressing force applied to the interliner holding member upon replacement of the interliner. Specifically, the pressing member is rotatably or slidably attached to the sewing frame so as to be movable between the operational position overlapped with the interliner holding member and the non-operational position remote from the interliner holding member. The number of the pressing members is not limited to the specific value, which may be set to one or more.

[C] The sewing frame includes a base frame attached to a frame drive unit of an embroidery sewing machine and a longitudinally long cloth application frame to which a sewing cloth is applied. The base frame is provided with a front support portion for supporting a front end of the cloth application frame and a rear support portion for supporting a rear end of the cloth application frame. A sewing window for defining an embroidery range to be processed on the sewing cloth is formed between the front end and the rear end of the cloth application frame. A plurality of cloth application frames each having differently shaped sewing window are replaceably attached to the base frame (in the state in which the cloth application frames extend between the front and rear support portions of the base frame).

The following structures with respect to the base frame and the cloth application frame may be employed.

(a) The base frame is provided with a front element that is attached to the front of the frame drive unit and a rear element attached to the rear of the frame drive unit. The front element is provided with a front support portion that supports the front end of the cloth application frame, and the rear element is provided with a rear support portion that supports the rear end of the cloth application frame. The base frame may be attached to the frame drive unit while being supported at both sides so as to support the heavy and long tubular cloth like trousers (jeans) in a stable position on the horizontal plane.

(b) Cylindrical surfaces each with substantially the same diameter is formed for the front element, rear element and the cloth application frame of the base frame, respectively to form the entire shape of the sewing frame to be cylindrical when the cloth application frame is attached to the base frame. The cylindrical sewing frame has advantages in processing the long and narrow embroidery pattern with high accuracy on the long and narrow tubular cloth, for example, the trousers, the sleeve of the outer ware and the like.

(c) The front element and the rear element of the base frame are linked to a link element. A connector which connects the link element to the cloth application frame at the left and right sides of the sewing window, and an opening portion for opening the connector in the lateral direction are provided such that the base frame is covered with the cloth application frame through the opening portion. This allows the cloth application frame to be easily detachable with respect to the base frame, and the weight to be reduced without deteriorating rigidity of the cloth application frame.

(d) The front element and the rear element of the base frame are separated to form the cloth application frame into the cylindrical shape having the entire circumference closed. The front end of the cloth application frame is attached to the front element of the base frame, and the rear end of the cloth application frame is attached to the rear element of the base frame. In the aforementioned case, the cloth application frame is allowed to exhibit sufficient rigidity, and the sewing window is further allowed to be largely changed in the circumferential direction of the cloth application frame.

[D] The sewing frame is a longitudinally long flat plate and provided with a longitudinally long sewing window for defining an embroidery range processed on a sewing cloth and a reinforcing rib which extends along a longitudinal edge of the sewing window. A narrow portion is formed in one of a front portion and a rear portion of the sewing window, and a wide portion is formed in the other portion.

Preferably, the sewing frame may be structured as described below.

(a) The sewing frame is structured to have an arrow front portion, and a wide rear portion. The sewing window is structured to have the narrow portion at the front portion, and the wide portion at the rear portion.

(b) The reinforcing ribs are disposed to left and right side edges of the sewing frame directed downward, and a cloth stopper for fixing the sewing cloth is provided on a part of the reinforcing rib so as to externally protrude.

(c) The positioning jig is detachably attached onto the sewing frame. The positioning jig is provided with a positioning portion with respect to the sewing frame, and an opening for indicating the position of the sewing window over the sewing cloth.

[E] The sewing frame is a long and narrow flat plate inserted into a tubular sewing cloth, which is provided with a long and narrow sewing window for defining an embroidery range to be processed on the tubular sewing cloth. A peripheral portion of the embroidery range to be processed on the tubular sewing cloth is fixed on an upper surface of the sewing frame. The term "long and narrow" preferably represents that the longitudinal length is twice or more times longer than the lateral length (width).

The following structures may be employed for fixing the periphery of the embroidery range on the tubular cloth.

(1) The reinforcing ribs are disposed to left and right side edges of the sewing frame directed downward, and a cloth stopper for fixing the sewing cloth is provided on a part of the reinforcing rib so as to externally protrude. The periphery of the tubular sewing cloth is fixed to the cloth stopper with a spring type clip.

(2) The periphery of the tubular sewing cloth is fixed on the upper surface of the sewing frame with the two-sided tape.

The following structures may be employed for the sewing frame.

(a) A positioning jig is detachably provided on the sewing frame, and the positioning jig is provided with a positioning portion with respect to the sewing frame and an opening through which a position of the sewing frame is indicated over the sewing cloth.

(b) The sewing frame is divided into a plurality of portions in one of a lateral direction and a longitudinal direction, and the divided portions are connected while allowing a positional adjustment such that the sewing window is retractable in one of the lateral direction and the longitudinal direction. In this case, the sewing window may be formed to be retractable while changing its shape between a rectangle and a trapezoid.

(c) A thin and long flat plate-like holding frame is provided for holding a peripheral portion of the embroidery range to be processed on the tubular sewing cloth on the sewing frame, and a transparent window having substantially the same shape as the sewing window of the sewing frame is formed in the holding frame.

According to an aspect of the present invention, basically, the front and rear ends of the sewing frame are supported at the front and rear frame side portions of the rectangular support frame such that the front end of the sewing frame is unlikely to hang downward.

In addition to the aforementioned basic effect, the following effects may be obtained from another aspect of the present invention.

According to another aspect of the present invention, the opening is formed in the front end of the inner frame of the sewing frame. Besides the basic effect, this may provide the advantage for the operator to be allowed to insert the hand through the opening to easily replace the bobbin of the sewing machine bed.

According to another aspect of the present invention, the front end of the sewing frame is supported at the support frame such that the lateral intermediate portion of the support frame is supported so as not to have the front end hang downward.

According to another aspect of the present invention, the antivibration member in contact with the support shaft is attached to the support frame fixed to the sewing machine frame to suppress the vibration of the support shaft and the support frame, thus processing the long sewing cloth on the sewing frame with high accuracy.

According to another aspect of the present invention, the bearing member is provided to bear the link member linked to the support frame from its lower side. This makes it possible to process the heavy sewing cloth on the long sewing frame with high accuracy.

According to another aspect of the present invention, the long inner frame is inserted into the long sewing frame to support the sewing cloth from the inside of the sewing window as the double frame structure including the outer and inner frames. The sewing window may be widely opened in the longitudinal and circumferential directions of the sewing frame without reducing the holding force applied to the sewing cloth to ensure sufficient embroidery range for the large pattern to be processed on the long tubular cloth. Also, the use of the interliner is unnecessary, and thus cloth application may be simply performed.

According to another aspect of the present invention, the pressure member presses the intermediate portion of the interliner holding member against the sewing frame. The force for holding the interliner around the intermediate portion of the sewing window may be intensified to make it sure to prevent slack of the interliner. If the length of the interliner holding member is increased for embroidering the long tubular cloth, deformation of the interliner may be prevented, and the sewing cloth may be held while being appropriately kept along the outer peripheral surface of the sewing frame, thus processing the embroidery pattern with high accuracy.

According to another aspect of the present invention, the base frame supports the cloth application frame at the front and the rear ends, which allows the length of the sewing window to be increased along the substantially whole length of the cloth application frame. The cloth application frame is replaceably attached to the base frame such that the shape of the sewing window and the opening area are appropriately selected in accordance with the embroidery patterns. The embroidery may be processed with high accuracy in the longitudinal long and laterally various patterns of the long tubular sewing cloth.

According to another aspect of the present invention, the sewing window is formed to be longitudinally long in the flat plate-like sewing frame. This allows the entire sewing frame to be lighter than the cylindrical frame upon embroidery process on the long sewing cloth, resulting in the high speed processing of the embroidery patterns. The reinforcing rib is disposed along the longitudinal edge of the sewing window to prevent deformation of the sewing frame and to appropriately support the sewing cloth on the horizontal plane. The narrow portion and the wide portion are formed at the front and the rear portions of the sewing window. This may eliminate the replacement of the frame upon processing of the irregularly configured sewing product, for example, the boot-cut jeans, thus allowing the efficient processing of the different sizes of the embroidery patterns on the different portions of the sewing cloth using a single sewing frame.

According to another aspect of the present invention, the long and narrow sewing window is formed in the long and narrow flat plate-like sewing frame. The tubular cloth which covers the embroidery range may be stretched flat over the sewing window. The structure may be adaptable for the arbitrary embroidery method. The flat frame may be made lighter than the cylindrical frame upon processing of the embroidery on the tubular sewing cloth, which is advantageous for the high-speed processing of the embroidery patterns.

According to another aspect of the present invention, the operator is allowed to position the sewing start point to the needle drop hole easily based on the contour of the opening of the positioning jig.

According to another aspect of the present invention, a single flat frame is adaptable to the tubular sewing cloth with different width and embroidery range. Besides the maximum embroidery range, according to another aspect of the present invention, the single flat frame is adaptable to the processing of the irregularly configured sewing product such as the bootcut jeans without requiring the frame replacement.

According to another aspect of the present invention, the strength may be ensured by the sewing frame or the holding frame. The structure which has an influence on the embroidery area may be simplified, which is adaptable to the processing of the long tubular sewing cloth, for example, the trousers, sleeves of the outer ware and the like.

BRIEF DESCRIPTION OF DRAWINGS

FIG. 4 shows a guide mechanism of the first embodiment, wherein

FIG. 57 shows a third modified example of the fourteenth embodiment, wherein

DETAILED DESCRIPTION OF THE INVENTION

First Embodiment

Figure 1:
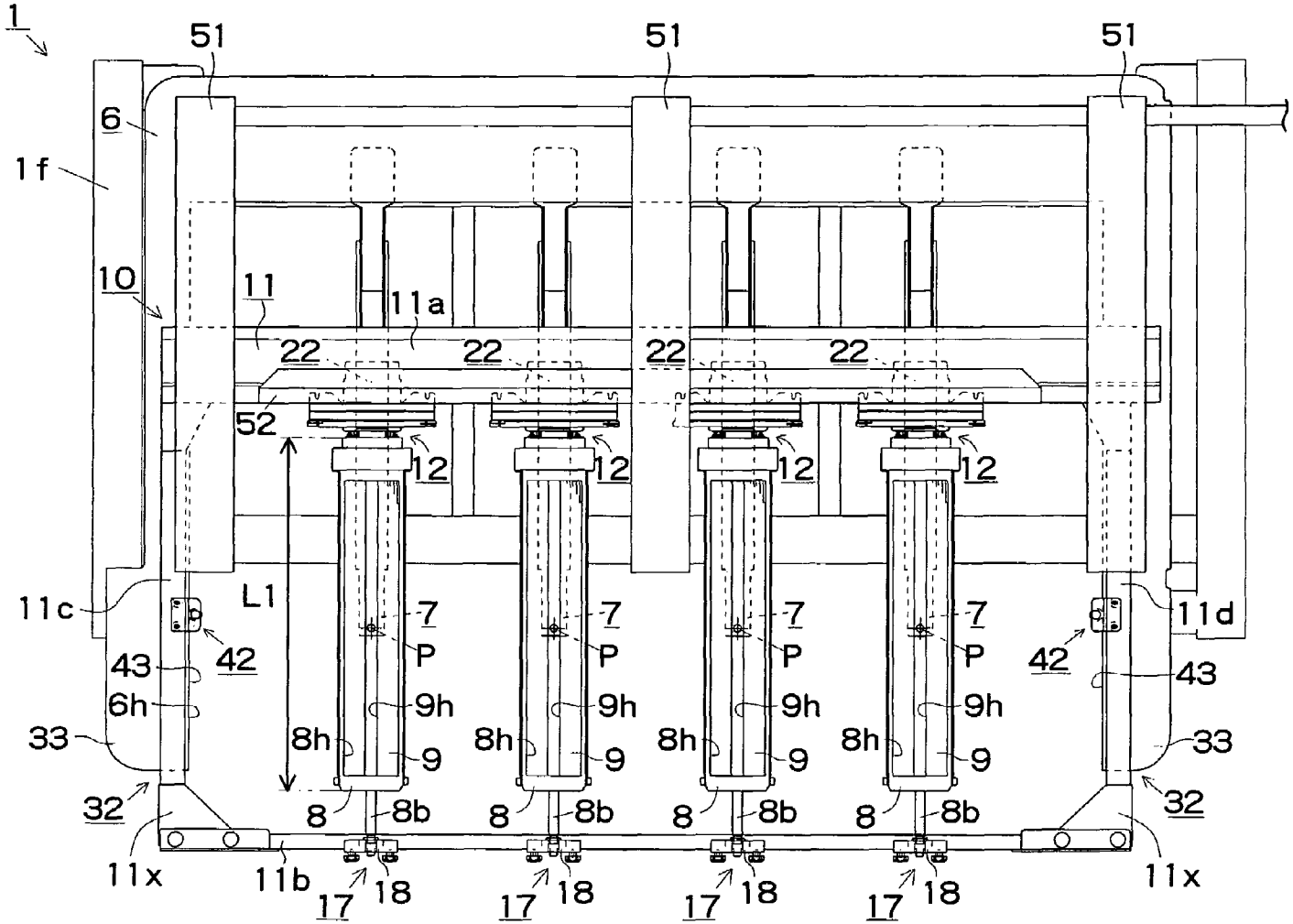
FIG. 1 is a plan view showing a multi-headed sewing machine according to a first embodiment.
Figure 2:
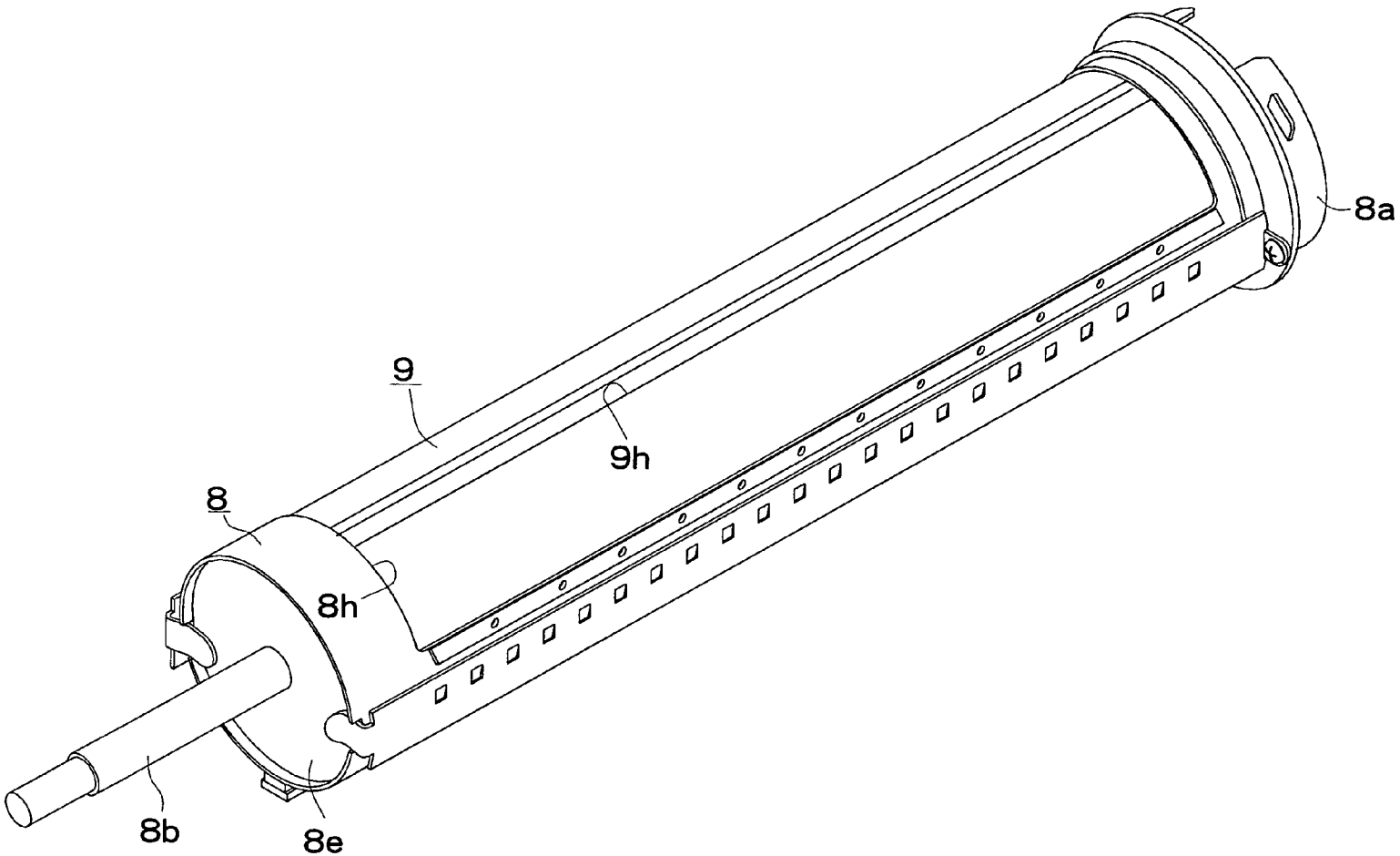
FIG. 2 is a perspective view showing a sewing frame of the first embodiment.
Figure 3:
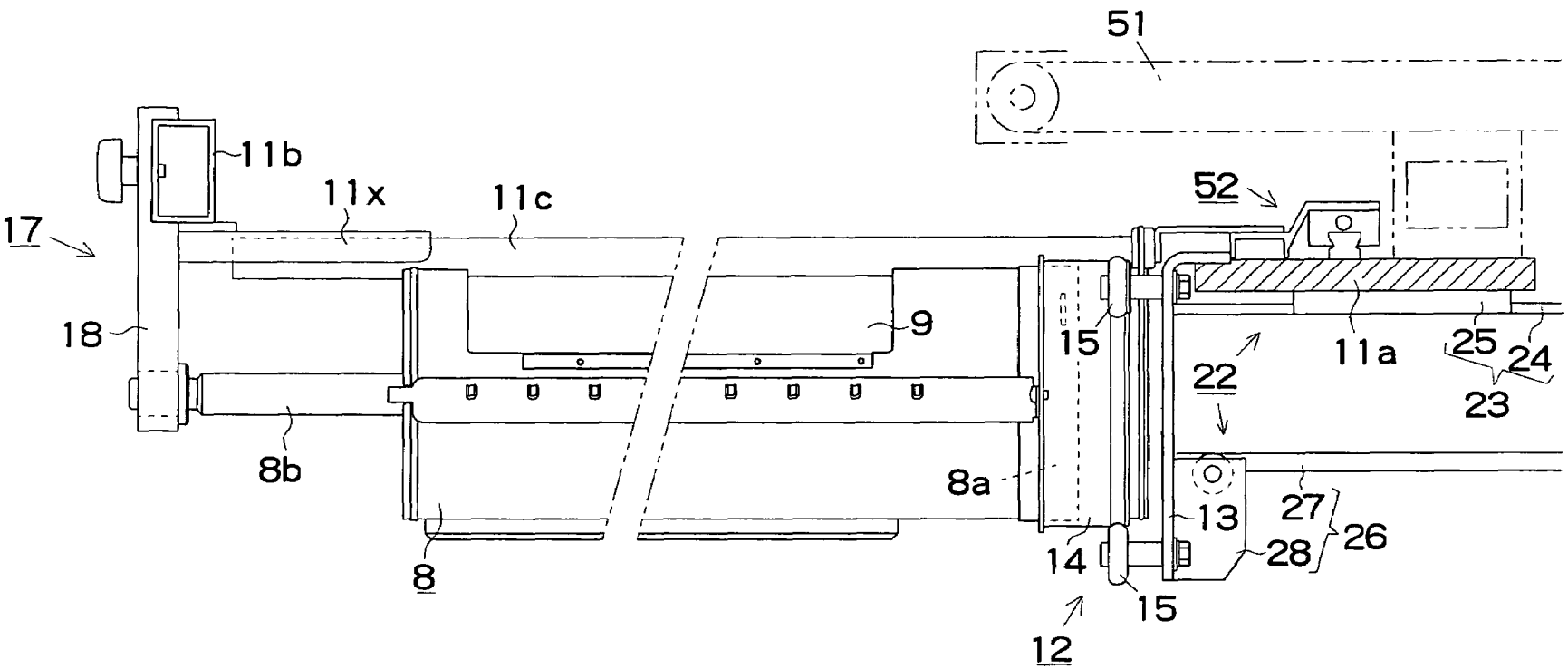
FIG. 3 is a sectional side view showing the sewing frame and the periphery thereof according to the first embodiment.
Figure 4A:
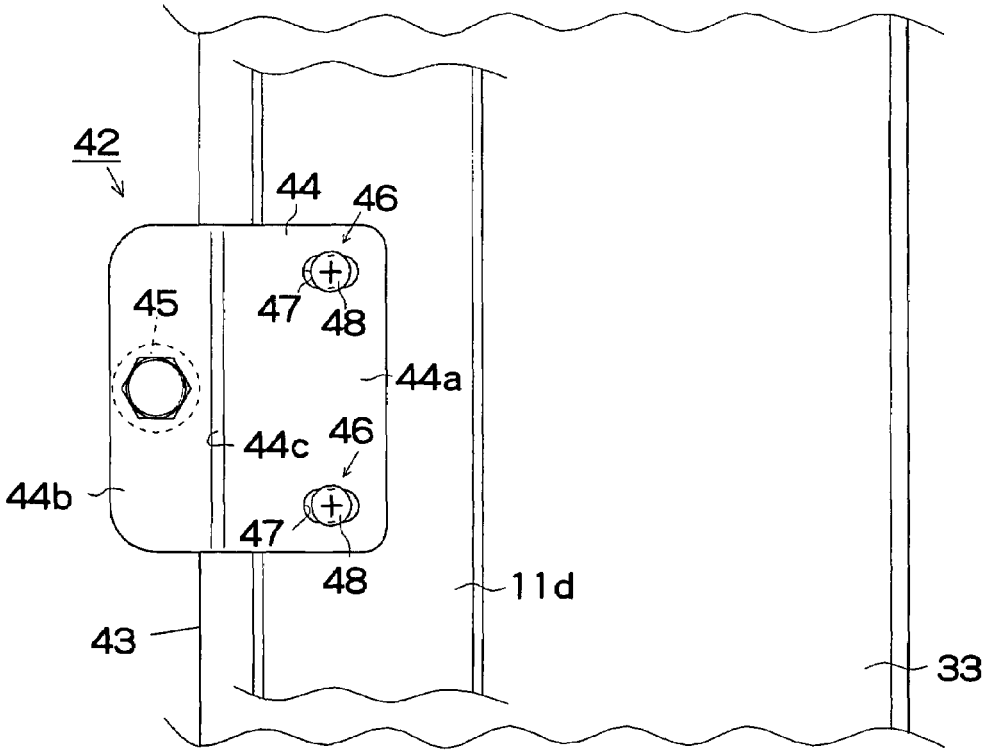
FIG. 4A is a plan view.
Figure 4B:
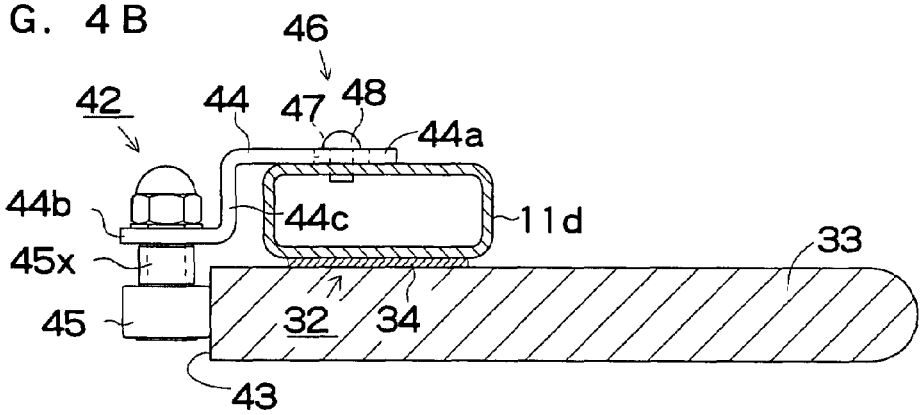
FIG. 4B is a front view.
Figure 4C:
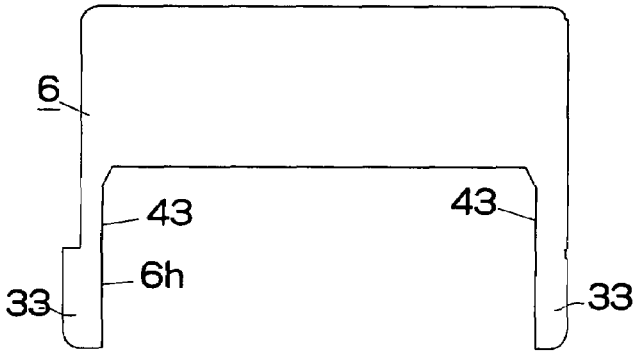
FIG. 4C is a plan view showing a table.

Referring to FIGS. 1 to 4, a multi-headed sewing machine 1 according to the first embodiment is formed of: a table 6 having recess portions 6*h* each formed from the front to the rear side at the lateral center; a plurality of sewing machine heads (not shown) arranged above the recess portions 6*h* in the lateral direction; beds 7 arranged at the needle drop points P of the respective sewing machine heads; sewing frames 8 for extending/holding the sewing cloth (not shown) between the sewing machine heads and the beds 7; a sewing frame drive mechanism 10 which movably supports the sewing frames 8 in the longitudinal and lateral planar directions; longitudinal drive units 51 for longitudinally driving the sewing frames 8; and a lateral drive unit 52 for laterally driving the upper portions of the sewing frames 8 for extending/holding the sewing cloth by driving the sewing frames 8 to be rotated. The aforementioned components are directly or indirectly attached to a sewing machine frame 1*f* that serves as the base of the multi-headed sewing machine 1.

The bed 7 is provided to protrude from the sewing machine frame 1*f* to the rear of or the downward of the recess portion 6*h* into or downward thereof. The bed 7 is inserted into an inner frame 9 which is inserted into the sewing frame 8. The inner frame 9 is a cylindrical frame with both ends opened. The rear end is supported at a rear frame side portion 11*a* of a support frame 11 provided for the sewing frame drive mechanism 10 so as not to be rotated. A slit hole 9*h* is formed in the upper portion of the inner frame 9 in the longitudinal direction such that the needle drop point P on the bed 7 is constantly exposed even if the inner frame 9 displaces in the longitudinal direction. The inner frame 9 is displaceable together with the sewing frame 8 in the longitudinal direction.

The sewing frame 8 has the cylindrical body with a bottom and is structured to have the front end provided with an end surface 8*a*. The inner frame 9 is inserted into the sewing frame 8 so as to be slidable in the circumferential direction. A sewing window 8*h* is formed in the upper portion of the sewing frame 8 for extending/holding the sewing cloth (not shown) between the sewing machine head (not shown) and the needle drop point P. A shaft 8*b* serving as the supported portion that is to be rotatably supported to the front frame side portion 11*b* of the support frame 11 extends from the center of the end surface 8*e* forward at the front end of the sewing frame 8. An engagement portion 8*a* to be rotatably supported as the supported portion is disposed at the rear end of the rear frame side portion 11*a*. The longitudinal length L1 of the sewing frame 8 disposed in the multi-headed sewing machine 1 is in the range from 70 to 80 cm, excluding the length of the shaft 8*b*.

The sewing frame drive mechanism 10 is formed of: a rectangular support frame 11 in which plural pairs of the sewing frame 8 and the inner frame 9 are arranged so as to be supported; rear end support mechanisms 12 which rotatably connect the rear ends of the sewing frames 8 to the rear frame side portion 11*a* of the support frame 11 so as to be supported; front end support mechanisms 17 which rotatably link the front ends of the sewing frames 8 to the front frame side portion 11*b* of the support frame 11 so as to be supported; engagement mechanisms 22 which engage the rear frame side portion 11*a* of the support frame 11 with the beds 7 so as to be movable in the longitudinal direction; front hang preventive mechanisms 32 which prevent the front frame side portion 11*b* of the support frame 11 from hanging downward with respect to the rear frame side portion 11*a*; and guide mechanisms 42 which prevent the lateral vibration by guiding the longitudinal displacement of the support frame 11 so as not to be displaced.

In the support frame 11, the rear frame side portion 11*a* is supported at the longitudinal drive units 51 allowed to be longitudinally driven. Accordingly, the rear frame side portion 11*a* serves as the drive frame for longitudinally driving the sewing frames 8. The lateral drive unit 52 is disposed on the rear frame side portion 11*a*. Meanwhile, the front frame side 11*b*, left and right frame sides 11*c*, 11*d* of the support frame 11 serve as the front end support frames for supporting each front end of the sewing frames 8. The front frame side 11*b* is linked to the front ends of the left and right frame side portions 11*c*, 11*d* so as to be replaced via a link portion 11*x*.

The rear end support mechanism 12 is formed of: a perpendicular plate 13 which hangs downward from the rear frame side portion 11*a*; a circular drive ring 14 which supports a base end (engagement portion 8*a*) of the sewing frame 8; and a plurality of support rollers 15 which grip the drive ring 14 rotatably from the outer periphery. The perpendicular plate 13 includes a shaft hole (not shown) in the center through which the bed 7 is inserted. The rear end of the inner frame 9 is supported outward of the hole so as not to be rotated. Meanwhile, the front end support mechanism 17 is formed of the shaft 8*b* attached to the front end of the sewing frame 8 and a support portion 18 protruding downward from the front frame side portion 11*b* to rotatably support the shaft 8*b*.

The engagement mechanism 22 is formed of an upper engagement portion 23 formed at the upper portion and the periphery of the bed 7, and a lower engagement portion 26 formed at the lower portion and the periphery of the bed 7. The upper engagement portion 23 is formed of an upper guide groove 24 which is a thin and long recess portion longitudinally extending at the upper portion of the bed 7, and a guided member 25 attached to the rear frame side portion 11*a* to be longitudinally movably engaged with the upper guide groove 24. Meanwhile, the lower engagement portion 26 is formed of a lower guide groove 27 which is a thin and long recess portion longitudinally extending at the lower portion of the bed 7, and a guided member 28 attached to the perpendicular plate 13 of the rear end support mechanism 12 to be longitudinally movably engaged with the lower guide groove 27.

The front hang preventive mechanism 32 is formed of: lateral protrusions 33 of the table 6 at the left and right of the recess portion 6*h*, which protrude relatively forward caused by forming the recess portion 6*h* in the table 6; a felt 34 which is thin and long to be longitudinally applied on the lateral protrusions 33 along the recess portion 6*h* as the slide members for reducing the sliding friction; and the left and right frame side portions 11*c*, 11*d* of the support frame 11 disposed on the felt 34.

The guide mechanism 42 is formed of: longitudinally extending guide surfaces 43 formed on the left and right end surfaces of the recess portions 6*h*; protruding members 44 having the base portion fixed to the support frame 11 and having the leading end protruding into the support frame 11; and guide rollers 45 supported at the end portion of the protruding member 44 so as to roll in contact with the guide surface 43. In the guide mechanism 42, the guide rollers 45 abut against the opposite guide surfaces 43 so as to prevent the lateral deformation and deviation of the support frame 11.

The protruding member 44 has a base portion 44*a* that is attached to the upper surface of the support frame 11. A bent portion 44*c* bent downward from the base portion 44*a* to the leading end 44*b* is formed at the intermediate position between the base portion 44*a* and the leading end portion 44*b* such that the level of the leading end 44*b* is lower than the level of the upper surface of the support frame 11. The guide roller 45 is rotatably supported at the rotating axis 45*x* which protrudes from the lower surface of the leading end portion 44*b* of the protruding member 44. The respective numbers of the guide rollers 45 and the protruding members 44 which support the guide rollers 45 are set to one each at the left and right sides, in the first embodiment.

The guide mechanism 42 includes a position adjusting mechanism 46 for adjusting the position of the guide roller 45 in the lateral direction. The position adjusting mechanism 46 is formed of a long hole 47 formed in the base portion 44*a* of the protruding member 44 extending in the lateral direction, and a screw 48 for fixing the long hole 47 to the left or right frame side portion 11*c*, 11*d*.

The plural longitudinal drive units 51 each having a thin and long shape are provided in the longitudinal direction above the rear frame side portion 11*a*, and the rear frame side portion 11*a* is supported by the longitudinal drive units 51 from above so as to be driven in the longitudinal direction. The lateral drive unit 52 having the thin and long shape is provided in the lateral direction above the rear frame side portion 11*a* to drive all the sewing frames 8 to be rotated by rotating the drive rings 14.

According to the first embodiment, the front and rear ends of the sewing frame 8 are supported at the front and rear frame side portions 11*b*, 11*a* of the support frame 11 such that the sewing frame 8 becomes unlikely to displace with respect to the support frame 11 in the vertical and lateral directions. The support frame 11 which supports the sewing frame 8 becomes unlikely to hang downward by providing the front hang preventive mechanism 32. The support frame 11 becomes unlikely to displace in the lateral direction by providing the guide mechanism 42. The sewing frame 8 becomes unlikely to displace with respect to the support frame 11 in the vertical and lateral directions, and the support frame 11 becomes unlikely to hang downward and to displace in the lateral direction. Accordingly the sewing frame 8 is allowed to be unlikely to hang downward and to displace in the lateral direction. The quality of the sewing cloth may be improved.

The guide mechanism 42 guides the displacement of the support frame 11 along the inner side surface of the recess portion 6*h* of the table 6 requiring no exclusive rail, thus simplifying the structure and reducing the cost. As the sewing frame 8 is supported at two points, the sewing frame 8 may be formed to be compact.

The respective numbers of the guide rollers 45 and the protruding members 44 which support the guide rollers currently set to two at both sides may be increased to three, four and the like.

Rather than providing the end surface 8*e* and the shaft 8*b* at the front end of the sewing frame 8 to rotatably support the shaft 8*b*, the similar end surface and the shaft may be provided at the front end of the inner frame 9 such that the shaft is supported so as not to be rotated. Thereby, the front end of the sewing frame 8 is rotatably supported via the inner frame 9.

Second Embodiment

Figure 5:
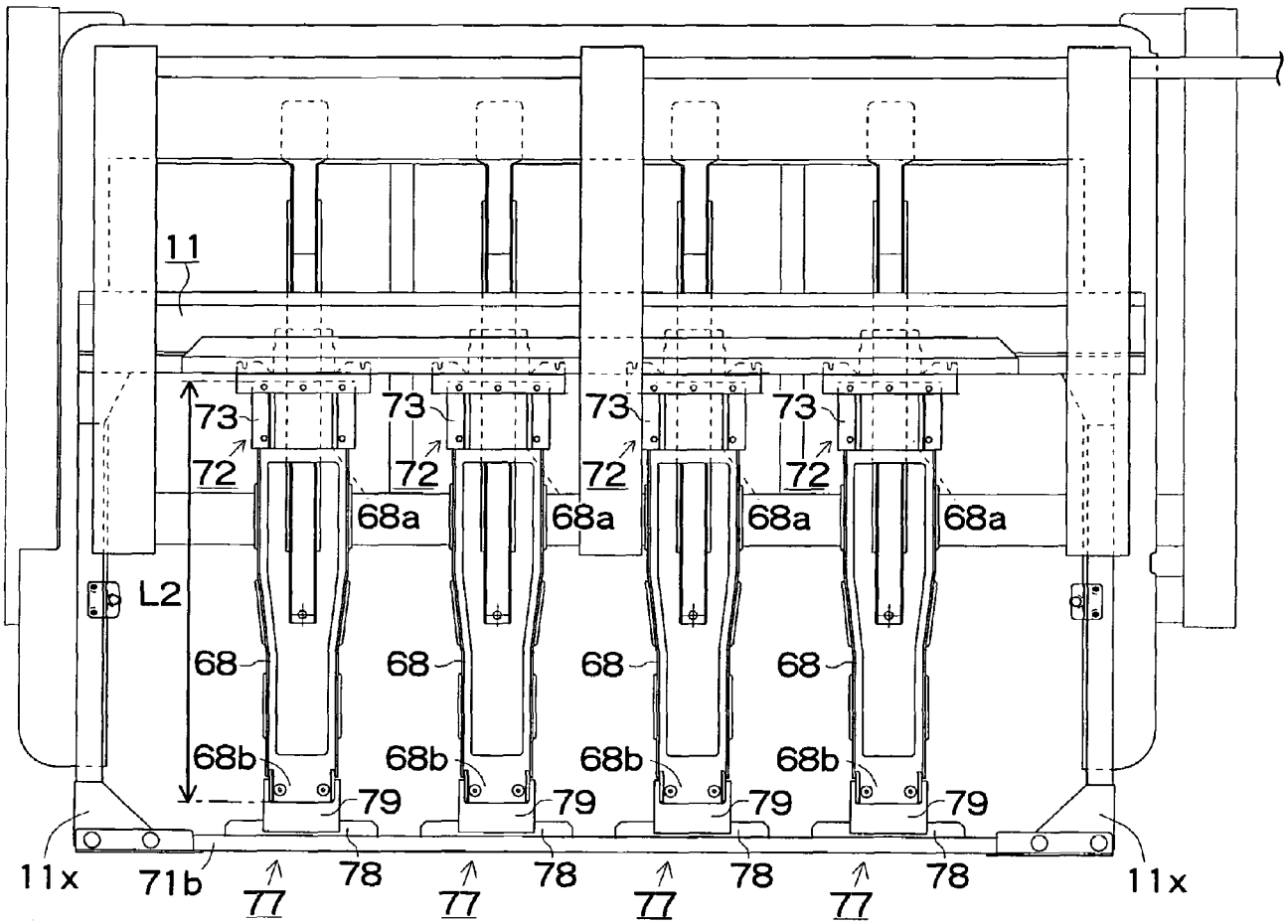
FIG. 5 is a plan view showing a multi-headed sewing machine according to a second embodiment.
Figure 6:
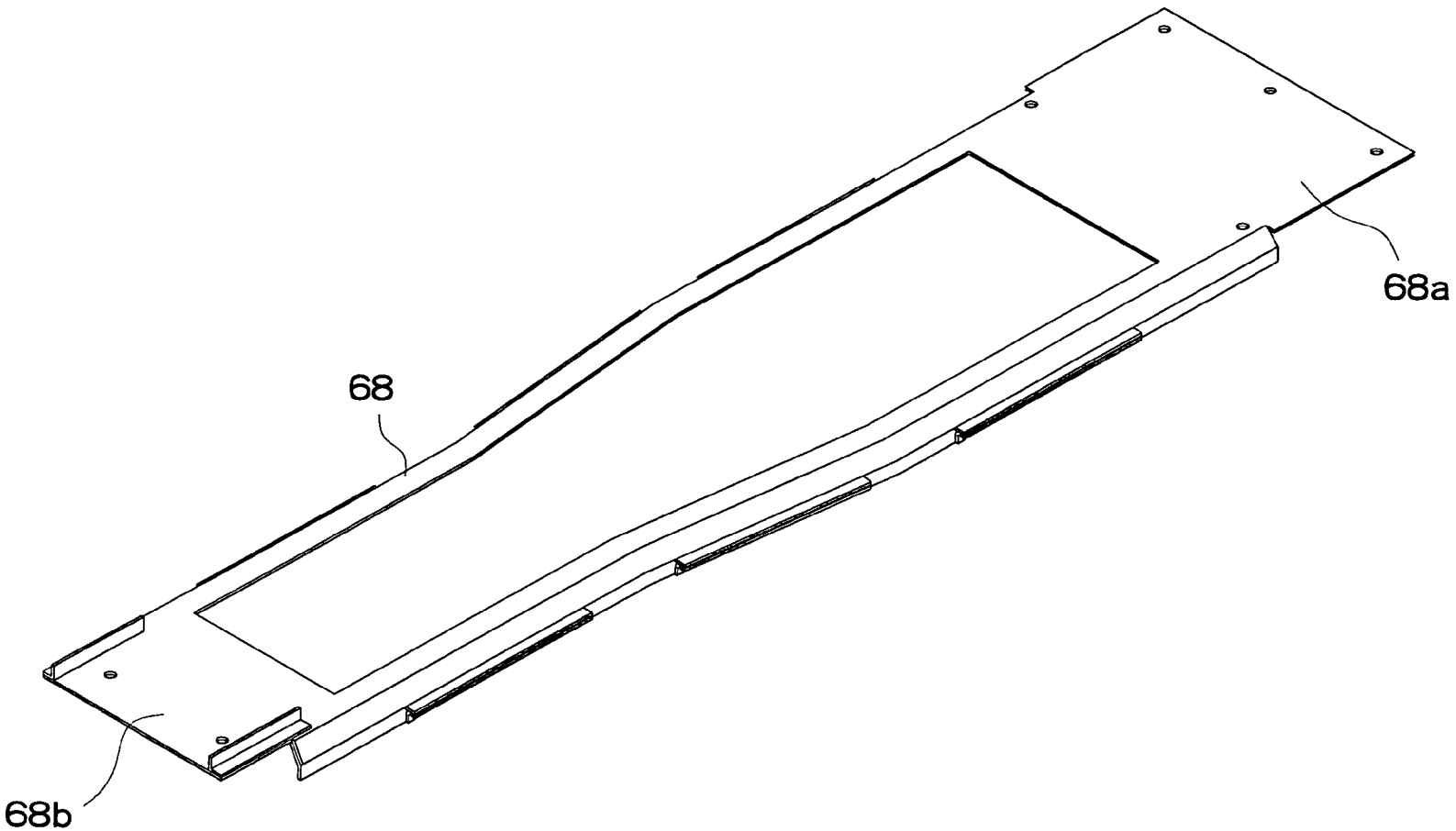
FIG. 6 is a perspective view showing a sewing frame of the second embodiment.
Figure 7:
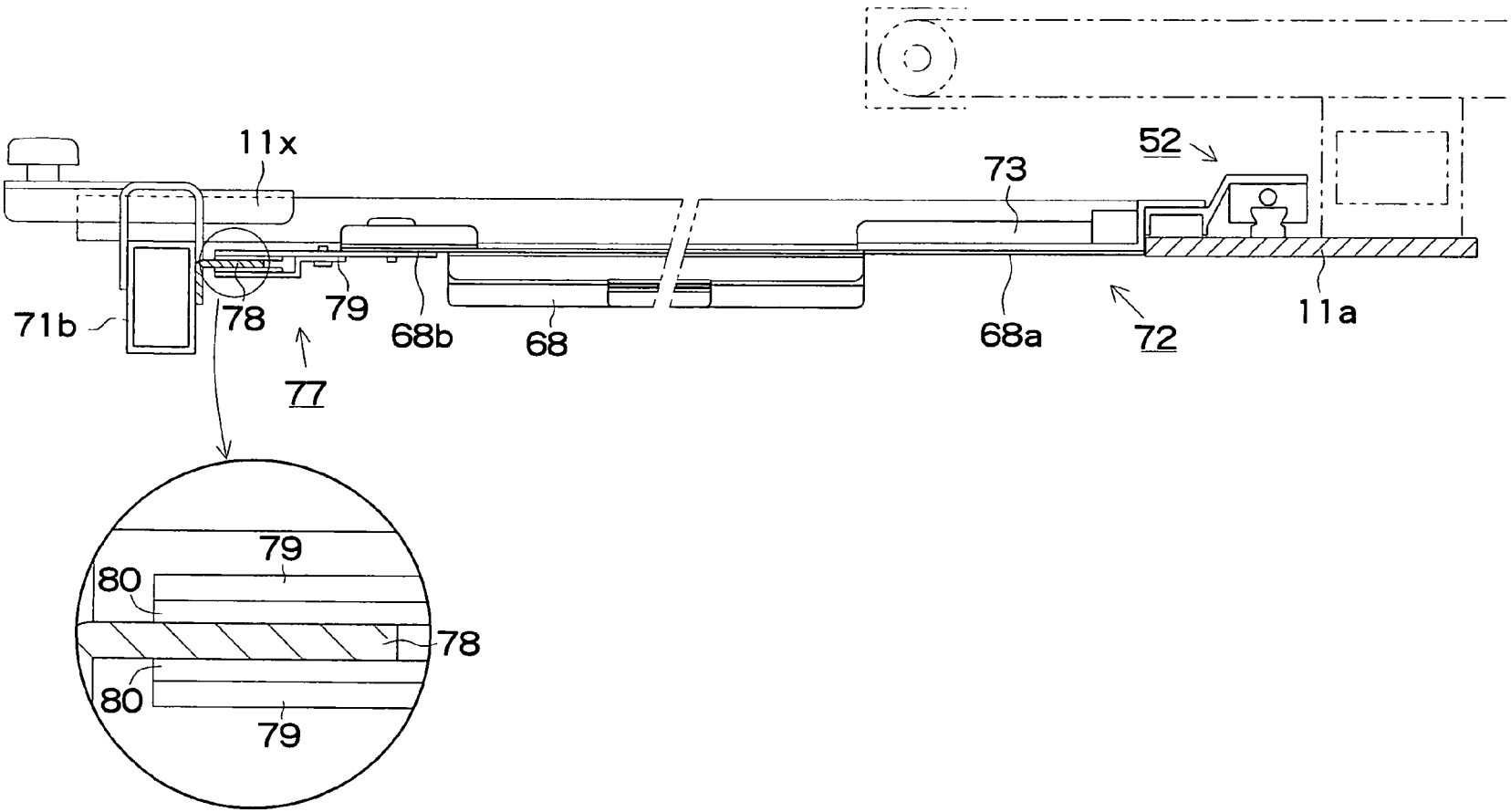
FIG. 7 is a sectional side view showing the sewing frame and the periphery thereof according to the second embodiment.

The second embodiment shown in FIGS. 5 to 7 is substantially the same as the first embodiment except that a flat sewing frame 68 with the longitudinal length L2 ranging from 70 to 80 cm is used instead of the cylindrical sewing frame 8, and a rear end support mechanism 72 and a front end support mechanism 77 for the flat frame are provided instead of the rear end support mechanism 12 and the front end support mechanism 17 for the cylindrical frame. The explanation of the first embodiment may be used for the other structures that are similar to those of the first embodiment.

For replacement of the front support mechanism 77, the front frame side portion 11*b* is removed by operating the link portion 11*x* and a front frame side portion 71*b* having the front end support mechanism 77 is attached.

The rear end support mechanism 72 is formed of a rear end 68*a* of the sewing frame 68 serving as the supported portion which is supported at the rear frame side portion 11*a* movably in the lateral direction, and a rear end support member 73 that supports the rear end 68*a* by linking it to the lateral drive unit 52 so as to be driven in the lateral direction.

The front end support mechanism 77 is formed of: a front end 68*b* of the sewing frame 68 serving as the supported portion to be movably supported at the frame side portion 71*b* in the lateral direction; a front end support portion 78 extending rearward from the front frame side portion 11*b*; and a front end support member 79 having the rear end attached to the front end 68*b* of the sewing frame 68 and the front end gripping the rear end of the front end support portion 78 slidably from the vertical direction to the lateral direction. A felt 80 is interposed between the rear end of the front end support portion 78 and the front end of the front end support member 79 which grips the rear end of the front end support portion 78.

According to the second embodiment, the flat sewing frame 68, instead of the cylindrical frame, may be supported only by replacing a part of the sewing frame drive mechanism 10 according to the first embodiment. This ensures to prevent the front portion of the sewing frame 68 from hanging downward.

Third Embodiment

The third embodiment shown in FIGS. 8 to 12 is substantially the same as the first embodiment except that the supported portion to be supported at the support frame 11 is attached to the front end of the inner frame 9 of the sewing frame 8. A hook 2 is contained in the front end of the bed 7 of the sewing machine. A bobbin 3 wound with the bobbin thread is contained in the hook 2.

Figure 8:
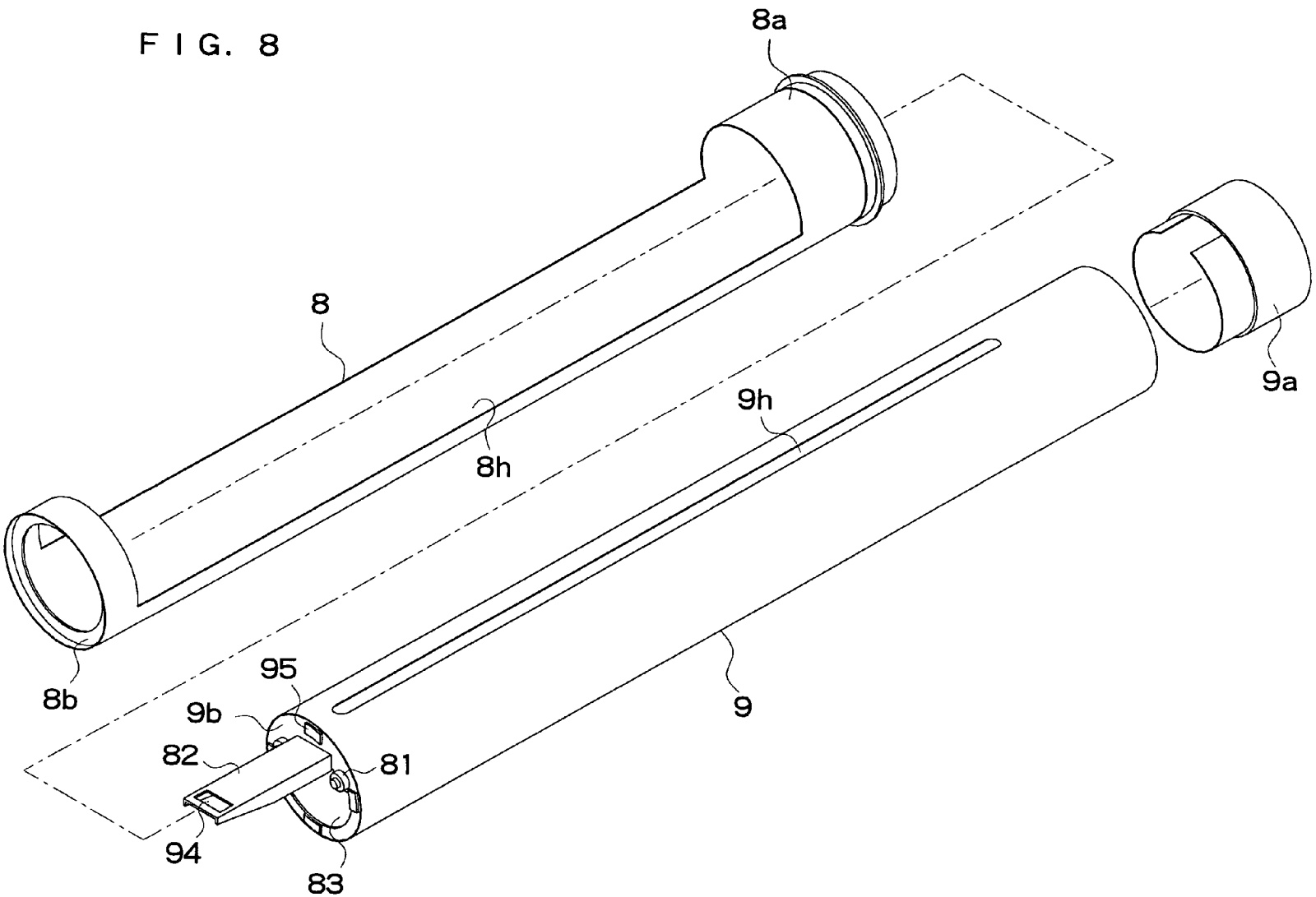
FIG. 8 is a perspective view showing a sewing frame of a third embodiment.
Figure 9:
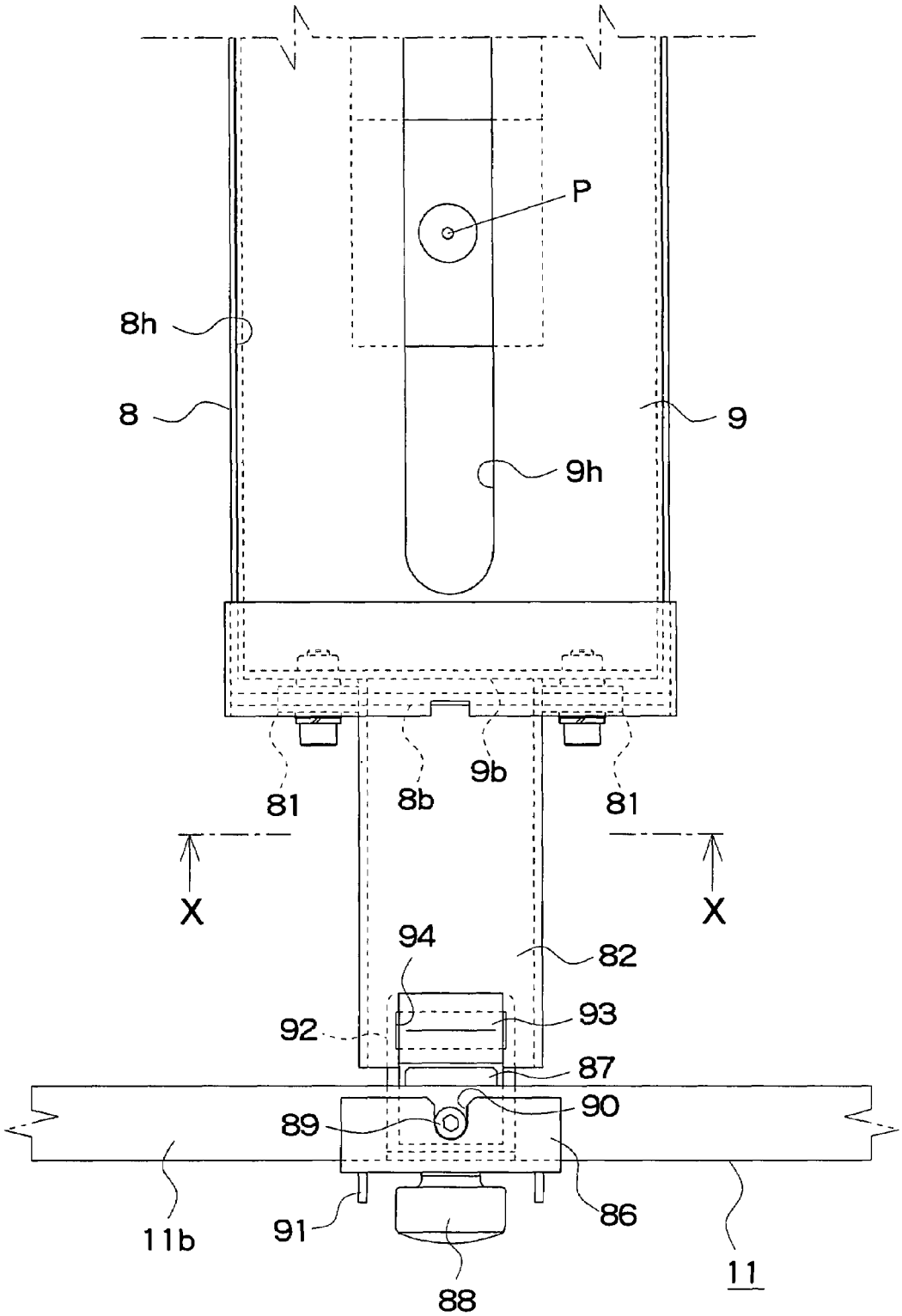
FIG. 9 is a plan view showing the front end of the sewing frame of the third embodiment.
Figure 10:
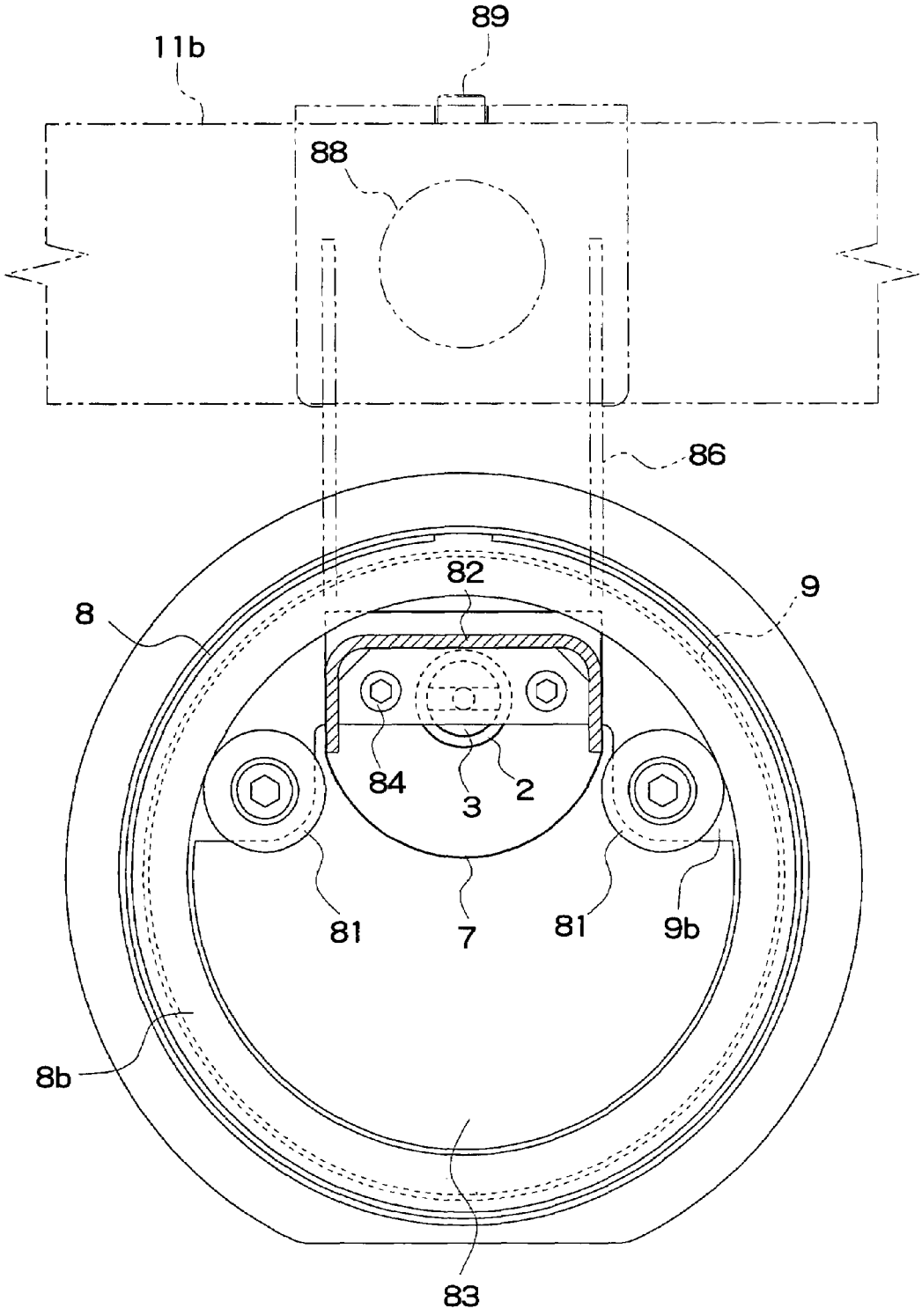
FIG. 10 is a sectional view showing the sewing frame of the third embodiment taken along line X-X of FIG. 9.
Figure 11:
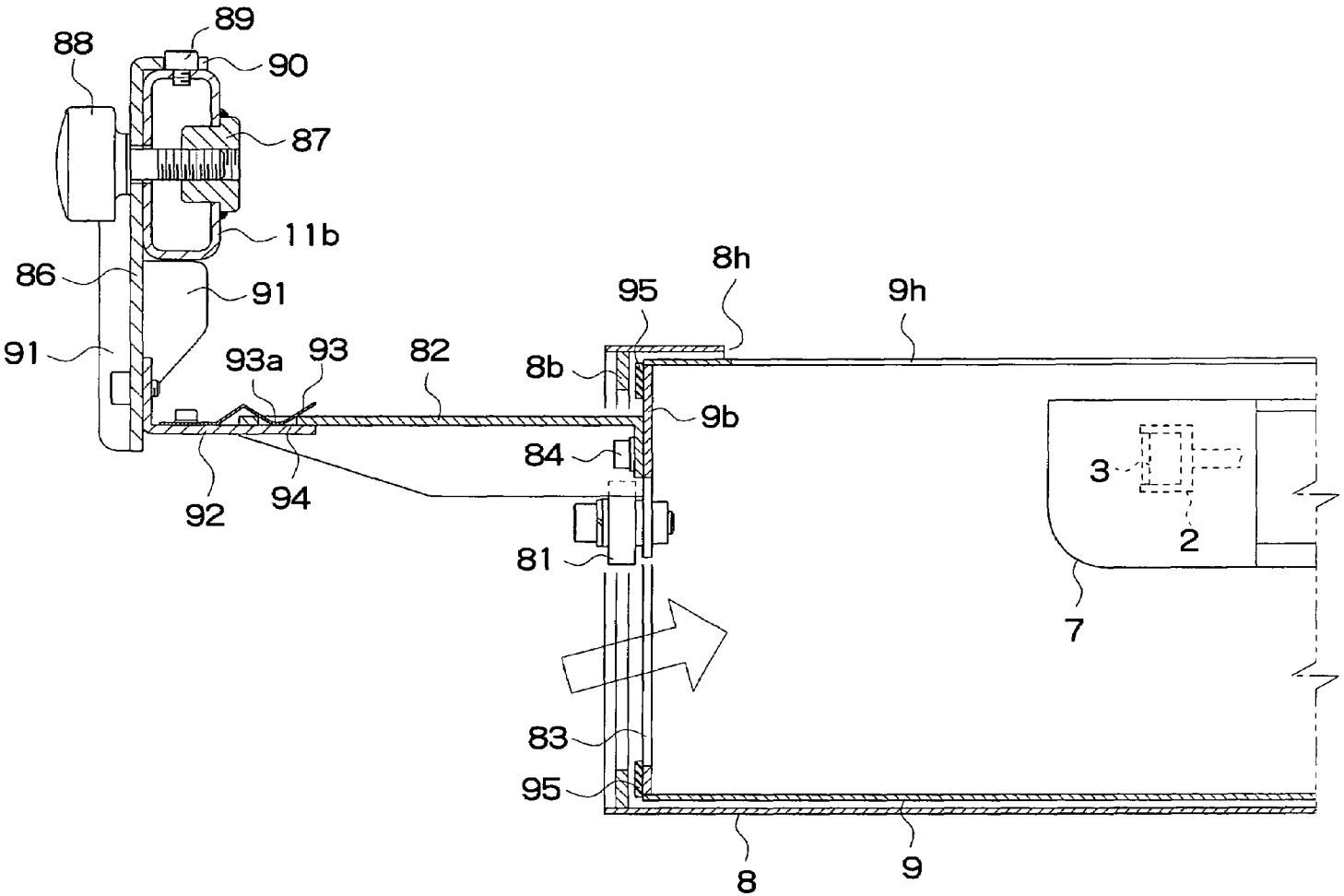
FIG. 11 is a sectional view showing a front end support structure of the sewing frame of the third embodiment.

The sewing frame 8 has a long cylindrical shape with the front and rear ends opened (see FIG. 8). A ring 8*b* to be supported at the rollers 81 of the inner frame 9 is fixed around the inner periphery of the front end of the sewing frame 8.

Figure 12:
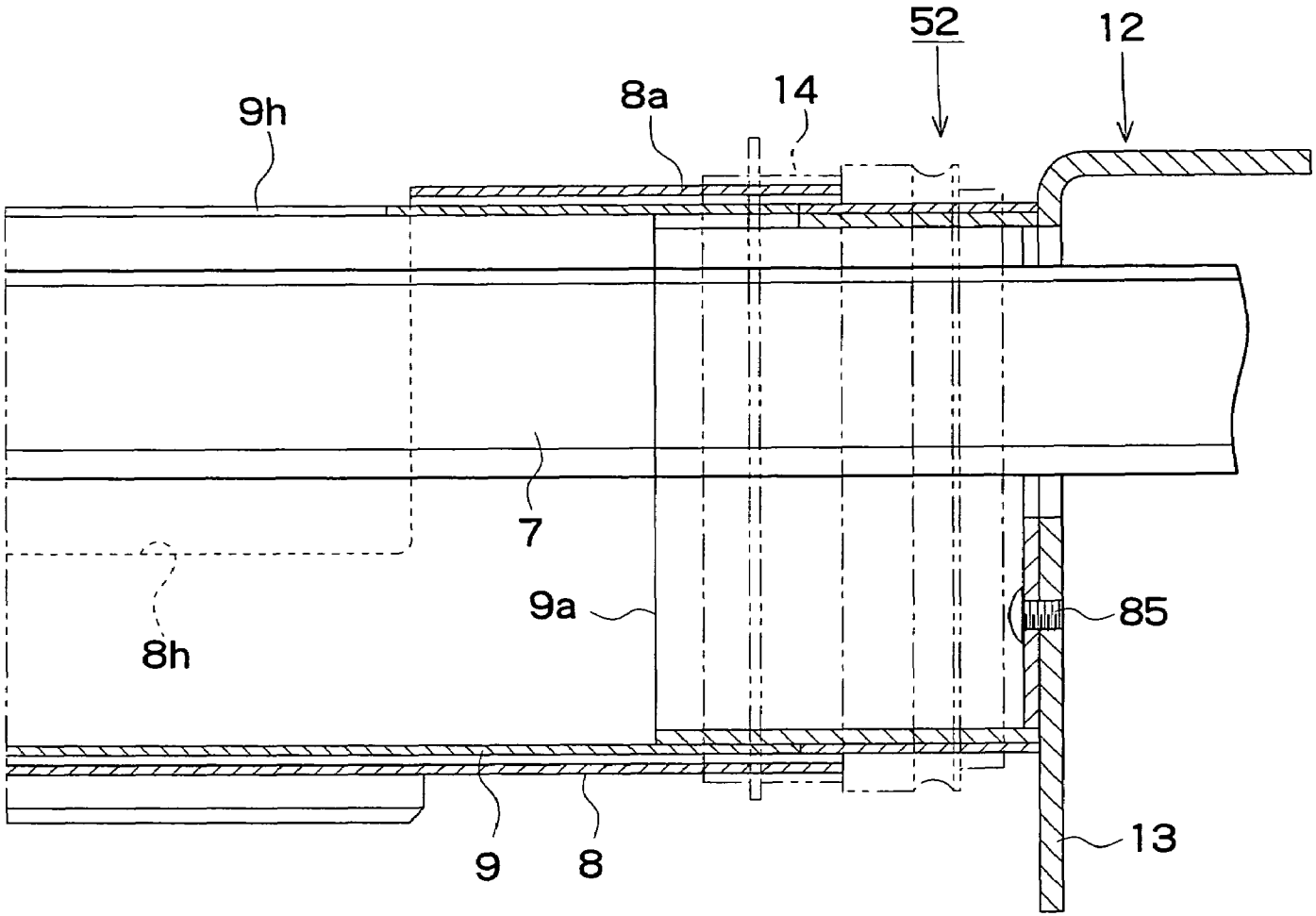
FIG. 12 is a sectional view showing a rear end support structure of the sewing frame of the third embodiment.

A cup-like fixture member 9*a* is attached to the rear end of the inner frame 9, which is fixedly supported at the perpendicular plate 13 of the rear end support mechanism 12 with a screw 85 (see FIG. 12). A terminal plate 9*b* is fixed to the front end of the inner frame 9 to face the ring 8*b* from the front (see FIG. 11).

A pair of rollers 81 engaged with the inner peripheral edge of the ring 8*b* are provided at the upper portion of the terminal plate 9*b* for rotatably supporting the front end of the sewing frame 8 around the axis of the cylindrical inner frame 9. The terminal plate 9*b* is provided with a bracket 82 as the supported portion at the front end of the sewing frame 8 which protrudes forward in parallel with the axis of the cylindrical inner frame 9 between the pair of rollers 81. An opening 83 which is large enough to allow the access of the operator's hand into the inner frame 9 is formed in the terminal plate 9*b* below the bracket 82.

The bracket 82 has the base end attached to the terminal plate 9*b* with the bolt 84 (see FIG. 12) and the top end supported at the front frame side portion 11*b* of the support frame 11 with a support 86. The front frame side portion 11*b* is provided with a nut 87 at the position where the sewing frame 8 is attached, and the support 86 is attached to the front frame side 11*b* with a bolt 88 having a handle hinged with the nut 87. AU-like groove 90 to be fit with a positioning protrusion 89 of the front frame side portion 11*b* is formed at the upper end of the support 86. Ribs 91 are formed on the front and rear surfaces of the support 86.

A support piece 92 is provided at the lower end of the support 86 to protrude rearward, and a plate spring 93 for pressing the top end of the bracket 82 against the support piece 92 is attached to the upper surface thereof. An open hole 94 having substantially the same width as that of the plate spring 93 is formed in the top end of the bracket 82. The bent portion 93*a* of the plate spring 93 is fit with the open hole 94 such that the bracket 82 is supported at the support 86 at a set position in the lateral direction. The terminal plate 9*b* of the inner frame 9 includes a plurality of cushioning media 95 adhered to the surface opposite the ring 8*b* of the sewing frame 8.

With the sewing frame 8 according to the third embodiment, the supported portion attached to the front end of the inner frame 9 is supported at the support frame 11. This ensures to prevent the front portion of the sewing frame 8 from hanging downward in the same way as the first embodiment. Likewise the first embodiment, the inner frame 9 covers the inner surface of the sewing window 8*h* of the sewing frame 8 to support the sewing cloth at the cylindrical surface that is brought very close to the cylindrical surface of the sewing frame 8. The sewing window 8*h* may be largely opened to allow processing of the large embroidery pattern to the wide range of the long sewing cloth such as jeans with high accuracy. As the opening 83 is formed in the front end of the inner frame 9, the operator's hand is allowed to access inside of the inner frame 9 through the opening 83 (see arrow in FIG. 11) for replacing the bobbin in the state where the sewing frame 8 is retracted such that the bobbin 3 is easily attached to/detached from the hook 2 in the bed 7 of the sewing machine.

Fourth Embodiment

Figure 13:
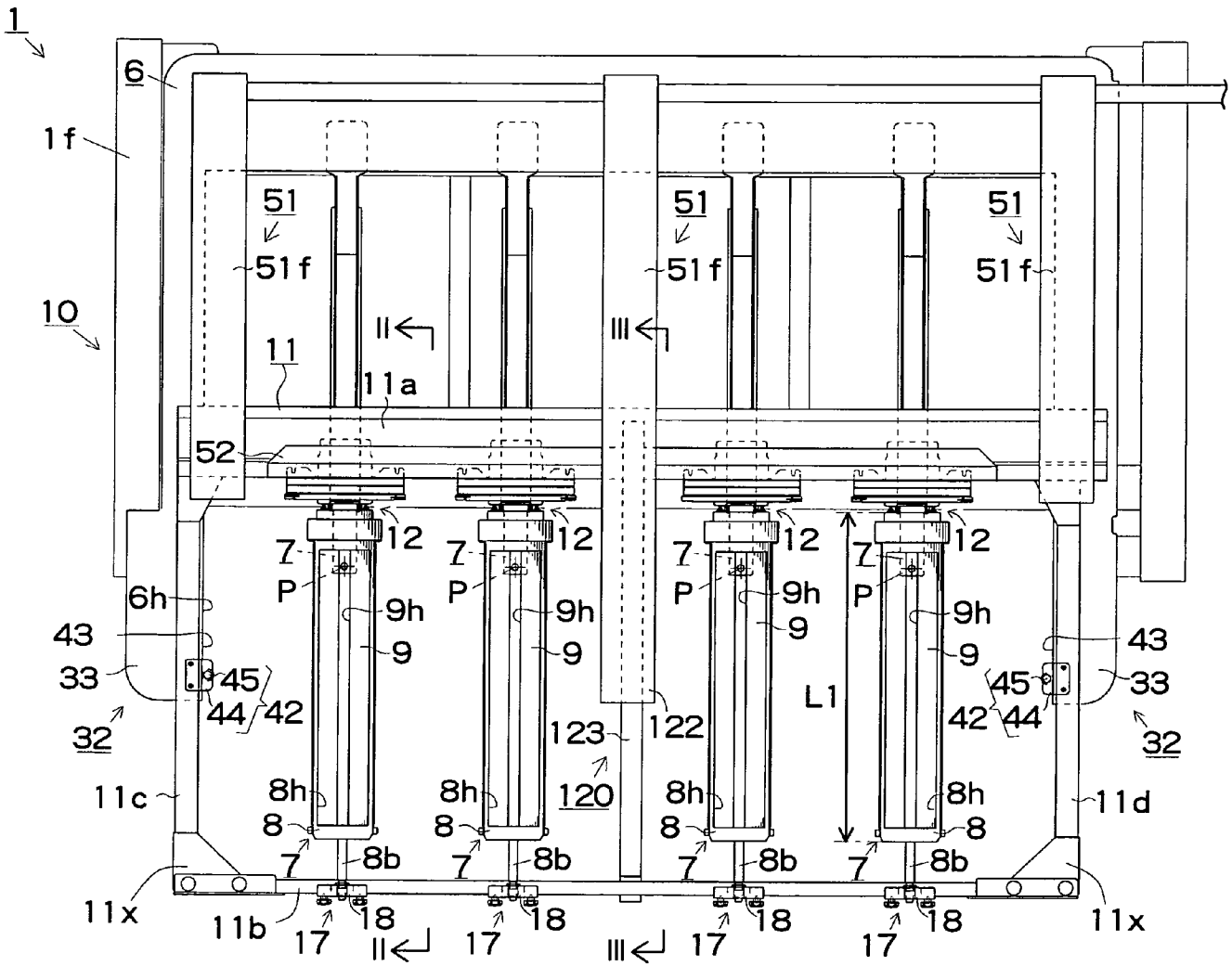
FIG. 13 is a plan view showing a sewing frame drive mechanism and the periphery thereof according to a fourth embodiment.
Figure 14:
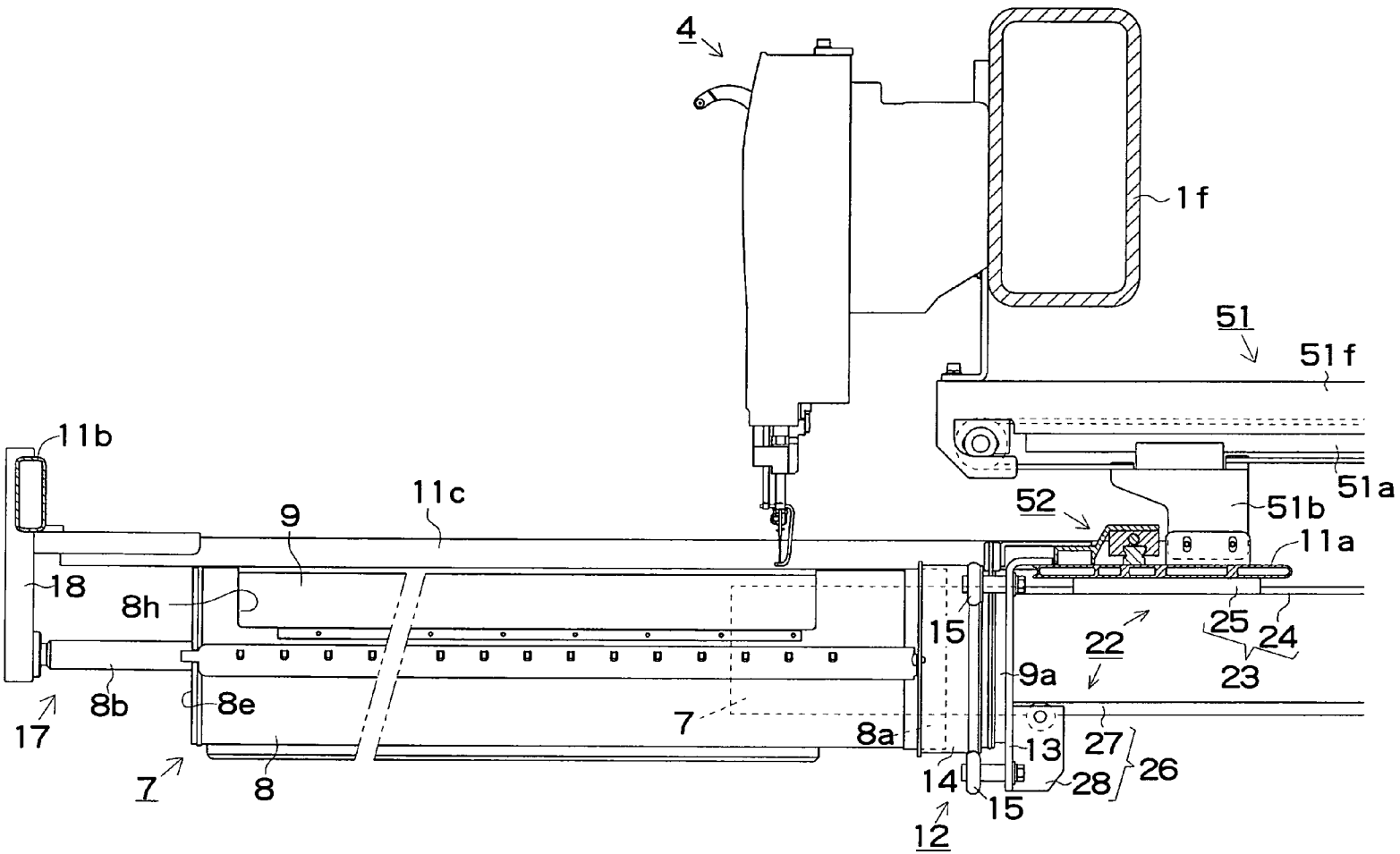
FIG. 14 is a side view showing a rear frame support mechanism and the periphery thereof according to the fourth embodiment.
Figure 15:
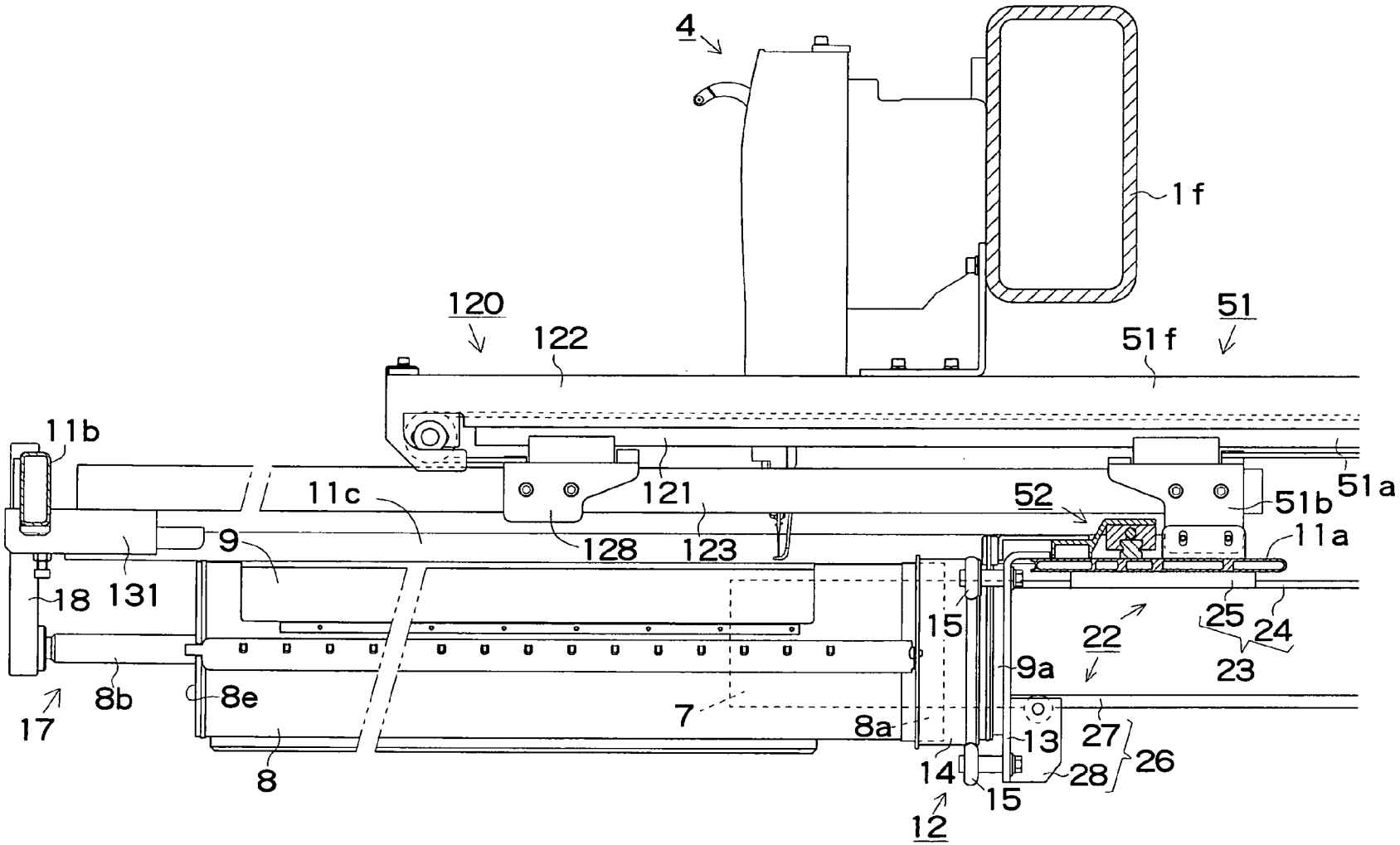
FIG. 15 is a side view showing the rear frame support mechanism, a front frame side portion support mechanism and the periphery thereof according to the fourth embodiment.

The fourth embodiment shown in FIGS. 13 to 15 is substantially the same as the first embodiment except that the intermediate portion of the front frame side portion in the lateral direction is longitudinally movably supported at the front frame side support mechanism so as not to hang downward. The explanation of the first embodiment may be used for the other structures that are similar to those of the first embodiment.

The plural longitudinal drive units 51 are arranged in the lateral direction. Each longitudinal drive unit 51 is formed of: a longitudinally extending support frame 51*f*; a support rail 51*a* attached to the support frame 51*f* to extend longitudinally; and a rear frame link member 51*b* which supports the rear frame side portion 11*a* at the support rail 51*a* linked thereto movably in the longitudinal direction.

A front frame side support mechanism 120 is provided to extend the longitudinal drive unit 51 at the lateral center forward. The rear portion of the front frame side support mechanism 120 is partially overlapped with the front portion of the longitudinal drive unit 51. Specifically, the front frame side support mechanism 120 is formed of: a support frame 122 to extend the support frame 51*f* further forward; a support rail 121 attached to the support frame 122 to further extend the support rail 51*a* forward; a support shaft 123 having the front end provided with a front frame side support member 131 for supporting the substantial center of the front frame side portion 11*b* in the lateral direction, and the rear end connected to the substantial center of the rear frame side portion 11*a* in the lateral direction via the rear frame link member 51*b*; and a front frame support member 128 which supports the longitudinal intermediate portion of the support shaft 123 which is linked to the support rail 121 movably in the longitudinal direction.

The longitudinal drive units 51 drive the rear frame link member 51*b* and the front frame support member 128 in the longitudinal direction to drive the support frame 11 longitudinally. The lateral drive unit 52 disposed above the rear frame side portion 11*a* drives the drive ring 14 of the rear end support mechanism 12 to be rotated such that the sewing frame 8 is driven to be rotated.

According to the fourth embodiment, the rear frame side portion 11*a*, and the left and right frame side portions 11*c*, 11*d* of the support frame 11 are supported movably in the longitudinal direction at the longitudinal drive units 51 and the front hang preventive mechanism (lateral frame support mechanism) 32. The front frame side portion 11*b* is also supported at the front frame side support mechanism 120 movably in the longitudinal direction. Even if the support frame 11 protrudes from the front end of the lateral protruding portion 33 to the great degree, the front frame side portion 11*b* is unlikely to hang downward with respect to the rear frame side portion 11*a*. Accordingly, the front end of the sewing frame 8 supported at the support frame 11 is unlikely to hang downward with respect to the rear end. Therefore, the sewing frame 8 may be smoothly driven, thus improving the quality of the sewing cloth. In the above-described structure, the front end of the support shaft 123 which directly supports the front frame side portion 11*b* does not protrude forward of the front frame side portion 11*b*. As the front frame side support mechanism 120 exhibits good storage capability as a whole, it is unlikely to become an obstacle.

If the number of heads of the sewing machine head 4 is increased, the number of the front frame side support mechanism 120 may be increased.

Fifth Embodiment

Figure 16:
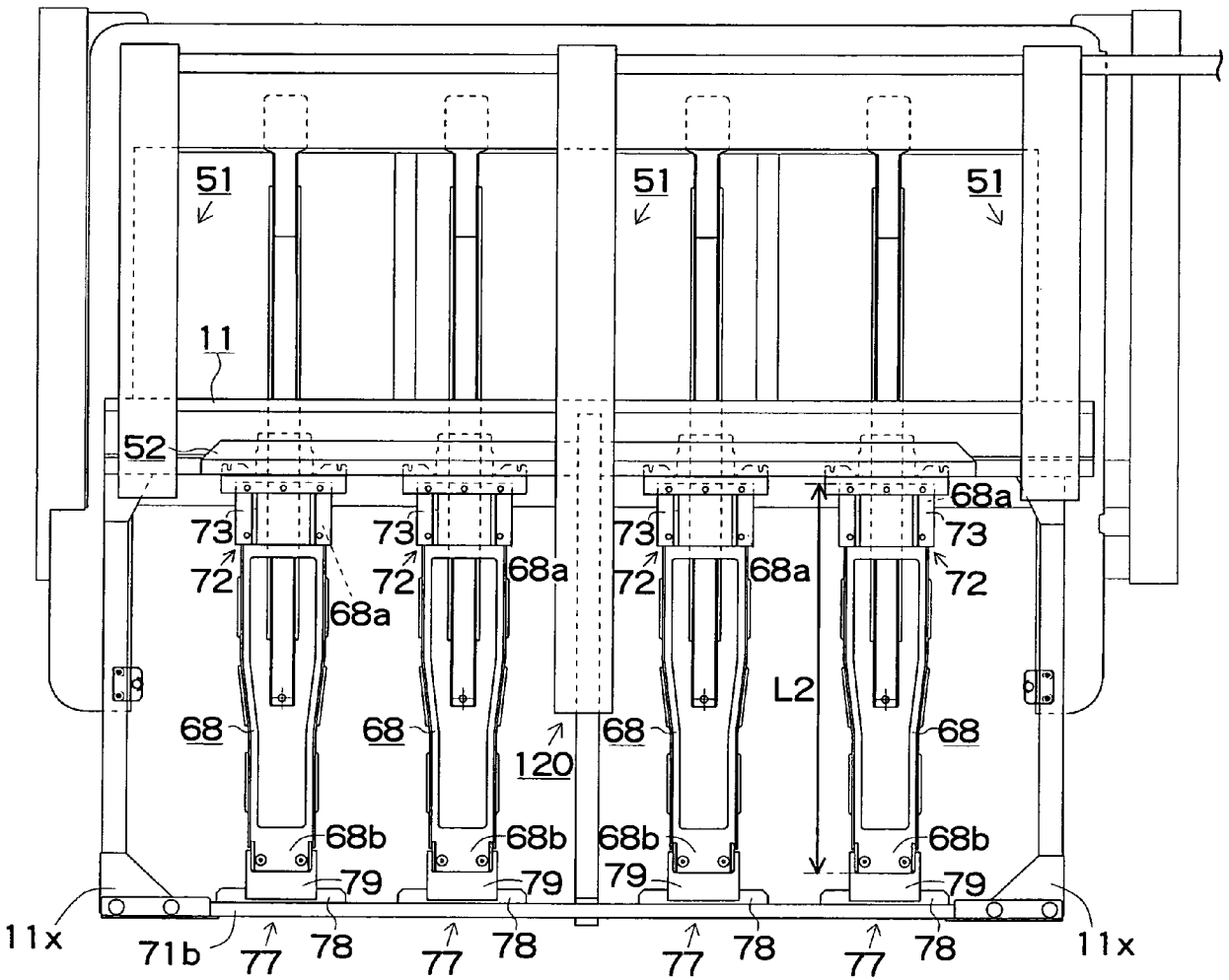
FIG. 16 is a plan view showing a multi-headed sewing machine according to a fifth embodiment.
Figure 17:
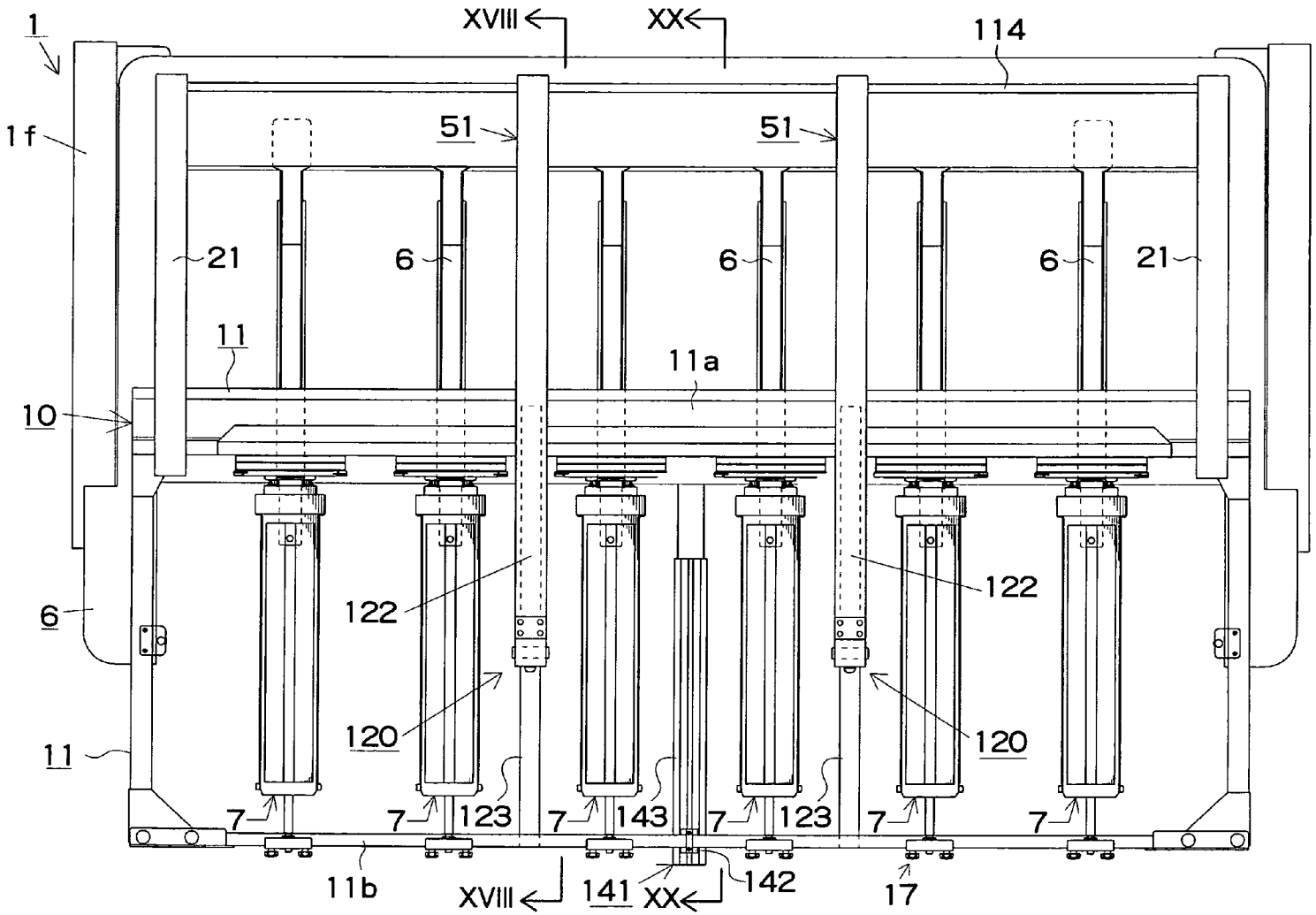
FIG. 17 is a plan view showing a multi-headed sewing machine according to a sixth embodiment.

The fifth embodiment shown in FIG. 16 is substantially the same as the fourth embodiment except that the flat sewing frame 68 as described in the second embodiment is provided, and the rear end support mechanisms 72 and the front end support mechanisms 77 are provided. The explanation of the fourth embodiment may be used for the other structures that are similar to those of the fourth embodiment. The fifth embodiment ensures to prevent the front portion of the sewing frame 68 from hanging down.

Sixth Embodiment

The sixth embodiment shown in FIGS. 17 to 21 is substantially the same as the fourth embodiment except that the sewing frames more than those in the fourth embodiment and the support frame 11 laterally longer than that in the fourth embodiment are provided, and a single lower front frame side support mechanism is provided in addition to the two upper front frame side support mechanisms for the purpose of supporting the plural sewing frames 8 so as to prevent the front portions from hanging downward. The explanation of the fourth embodiment may be used for the other structures that are similar to those of the fourth embodiment.

The upper front frame side support mechanism 120 has substantially the same structure as the one described in the fourth embodiment, including the support frames 122 and 51*f* which are long in the longitudinal direction. The rear end of the front frame side support mechanism 120 is attached to a rear beam 104 of the sewing machine frame 1*f* with a bracket 105, and the intermediate portion is attached to a front beam 106 with a bracket 107. A switch box 124 disposed on the upper surface of the front end of the support frame 122 includes a start/stop switch 125 and an emergency stop switch 126 for the multi-headed sewing machine 1 on the front surface. The respective switches 125 and 126 are arranged to be accessed by the hand of the operator who stands in front of the sewing machine 103 when the support frame 11 displaces to the forefront position.

A belt 112 and support rails 51*a*, 121 of the longitudinal drive unit 51 are provided on the support frame 122 between the front and rear ends. A shaft 114 for rotating a drive pulley (not shown) of the belt 112 is supported at the rear end of the support frame 122. The front frame side support member 131 is attached to the front end of the support shaft 123 to support the intermediate portion of the front frame side portion 11*b* of the support frame 11 in the lateral direction.

An antivibration unit 132 formed of a rigid resin block which slides on the upper surface of the support shaft 123 is fit with the lower surface of the front end of the support frame 122. The support shaft 123 displaces in the longitudinal direction with the support frame 11 accompanied with the rotation of the belt 112. The antivibration unit 132 regulates the vibration of the support shaft 123 from above such that the shaft 123 is guided while being held on the horizontal plane. Accordingly, the upper front frame side support mechanism 120 prevents the front portion of the support frame 11 from hanging downward with the support frame 122 and the support shaft 123, as well as regulates the vibration of the support frame 11 using the antivibration unit 132 so as to accurately process the embroidery on the sewing cloth on the long sewing frame 8.

Figure 18:
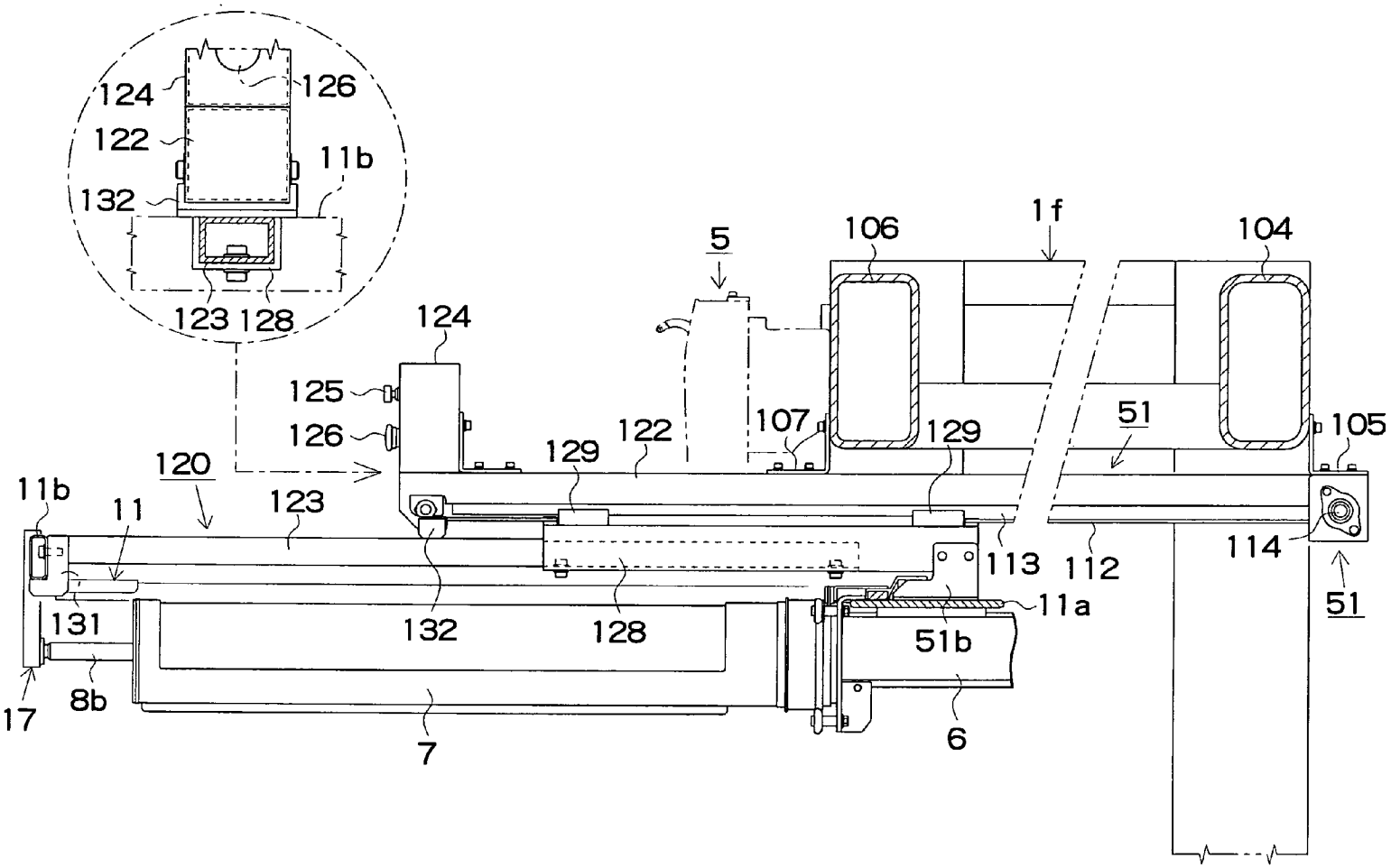
FIG. 18 is a sectional view showing an upper support mechanism of a sewing frame drive mechanism according to the sixth embodiment taken along line XVIII-XVIII of FIG. 17.
Figure 19A:
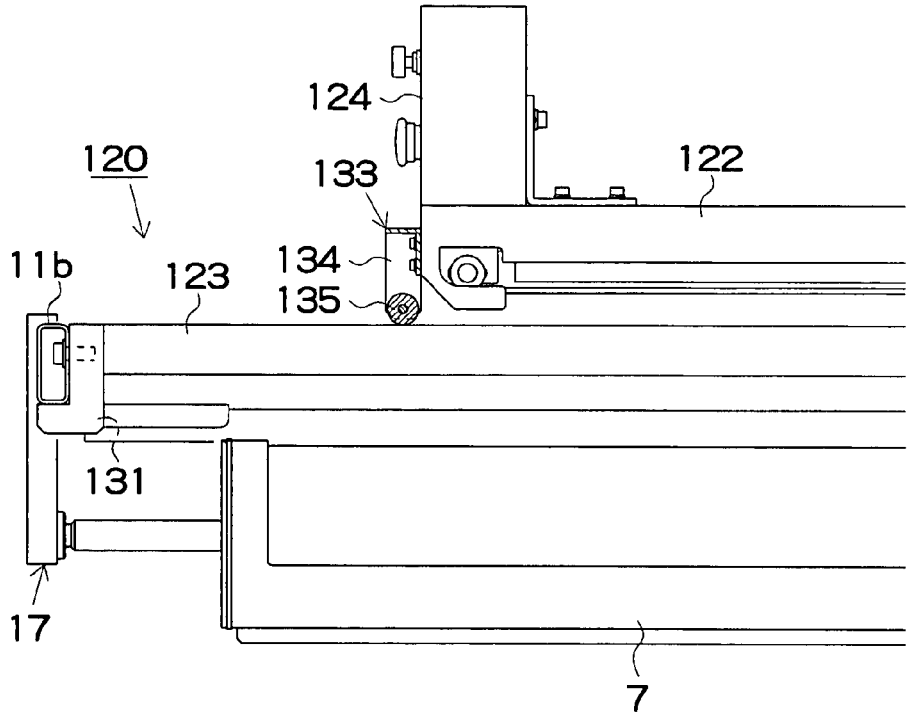
FIG. 19 is a side view showing a modified example of the upper support mechanism according to the sixth embodiment.
Figure 19B:
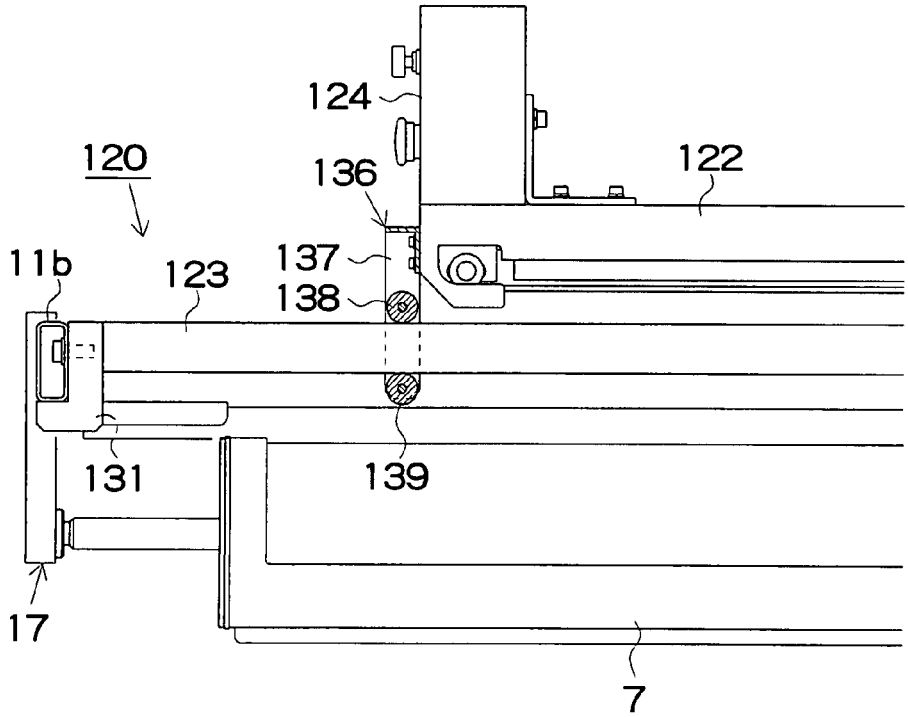

Note that as the antivibration unit, the slide member shown in FIG. 18 may be replaced with the rolling member shown in FIG. 19. The antivibration unit 133 shown in FIG. 19A includes a bracket 134 on the front end surface of the support frame 122 to be structured such that the roller 135 is supported at the bracket 134, the roller 135 rolls in contact with the upper surface of the support shaft 123, and the vibration of the shaft 123 is regulated from above. The antivibration unit 136 shown in FIG. 19B includes a pair of upper and lower rollers 138 and 139 in the bracket 137 to be structured such that the vibration of the shaft 123 is regulated from the upper and the lower sides while gripping the support shaft 123 between the rollers 138 and 139.

Figure 20:
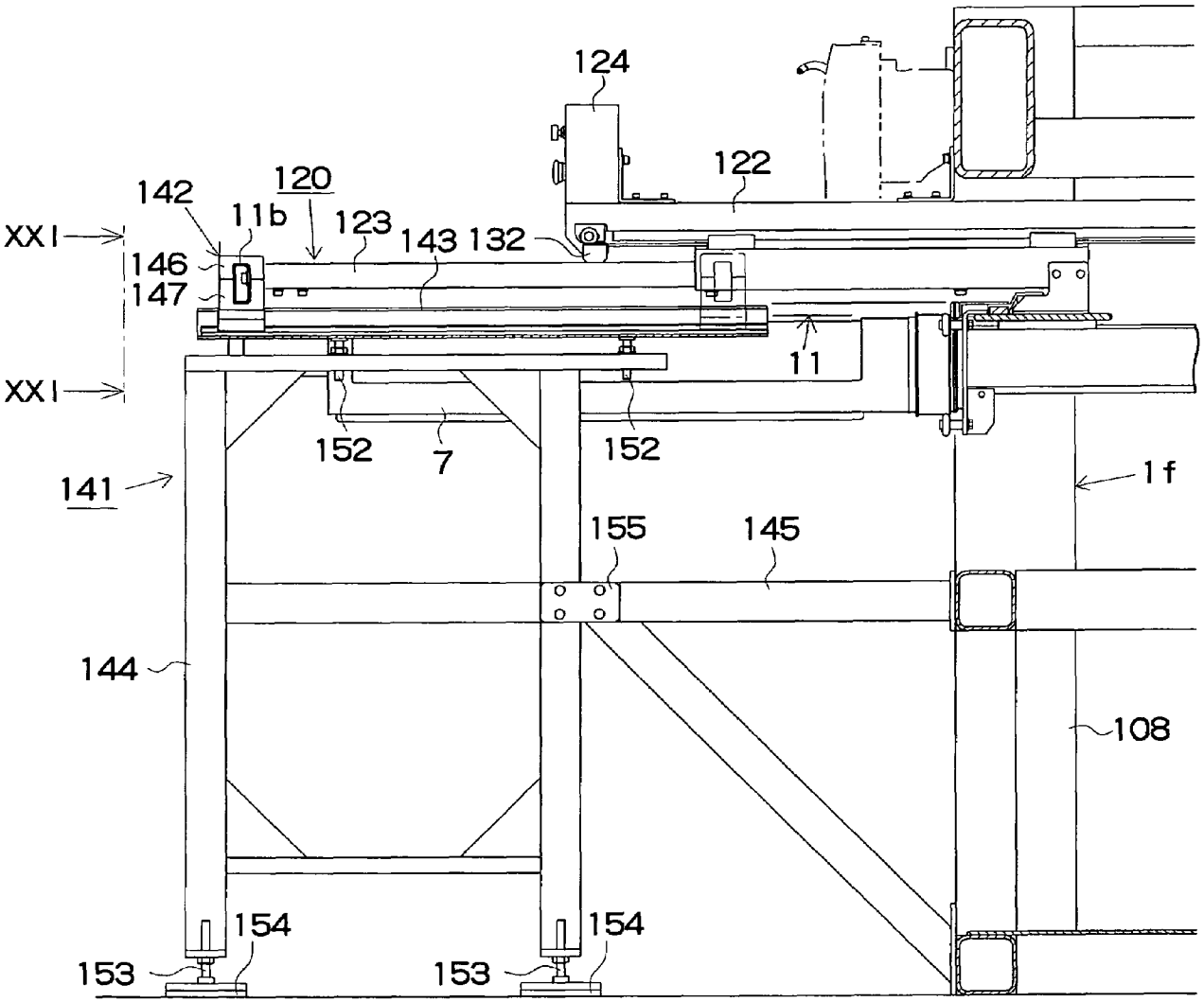
FIG. 20 is a sectional view showing a lower support mechanism of the sewing frame drive mechanism according to the sixth embodiment taken along line XX-XX of FIG. 17.
Figure 21:
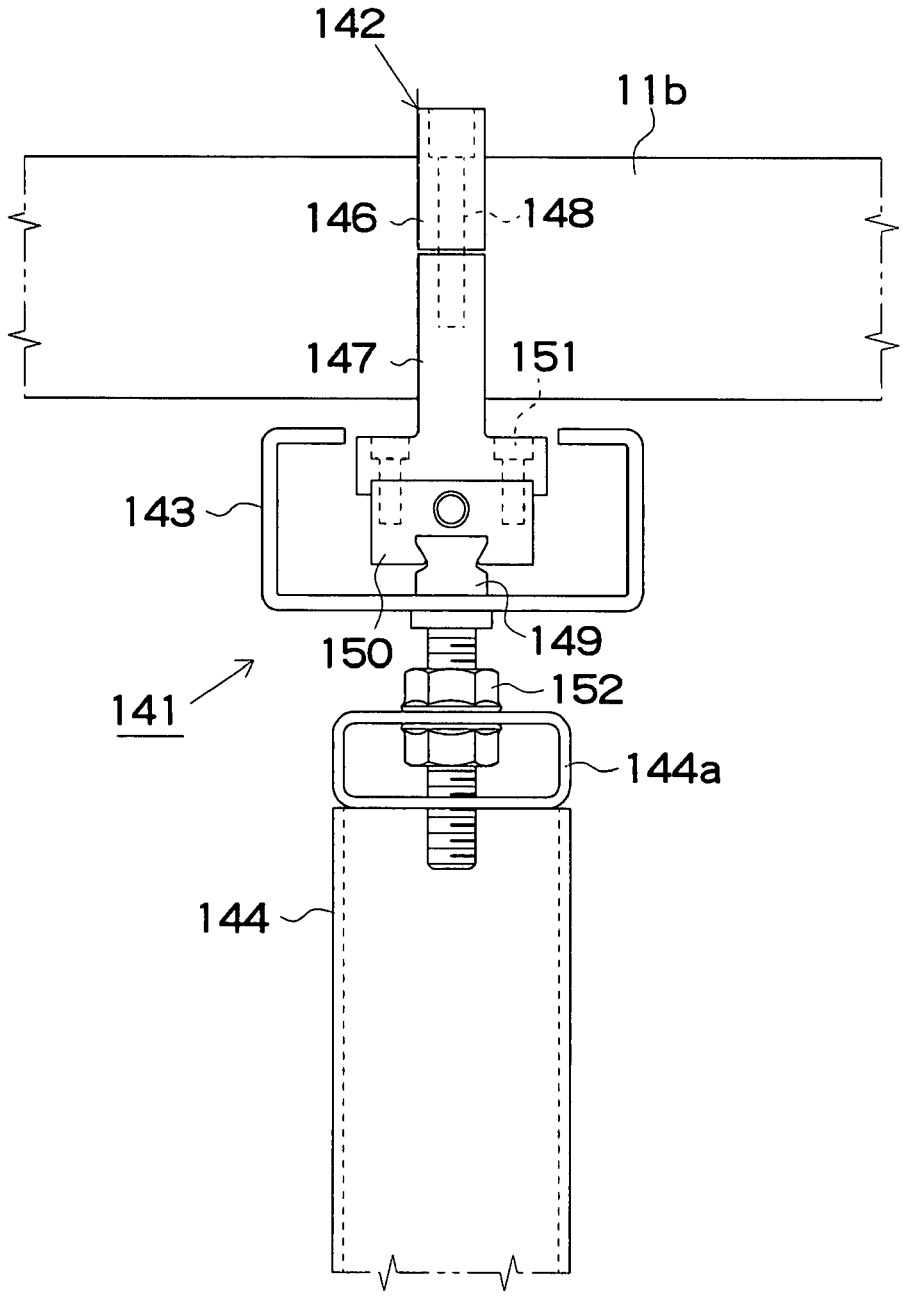
FIG. 21 is a front view showing the essential portion of the lower support mechanism according to the sixth embodiment when seen from the line XXI-XXI of FIG. 20.
Figure 22:
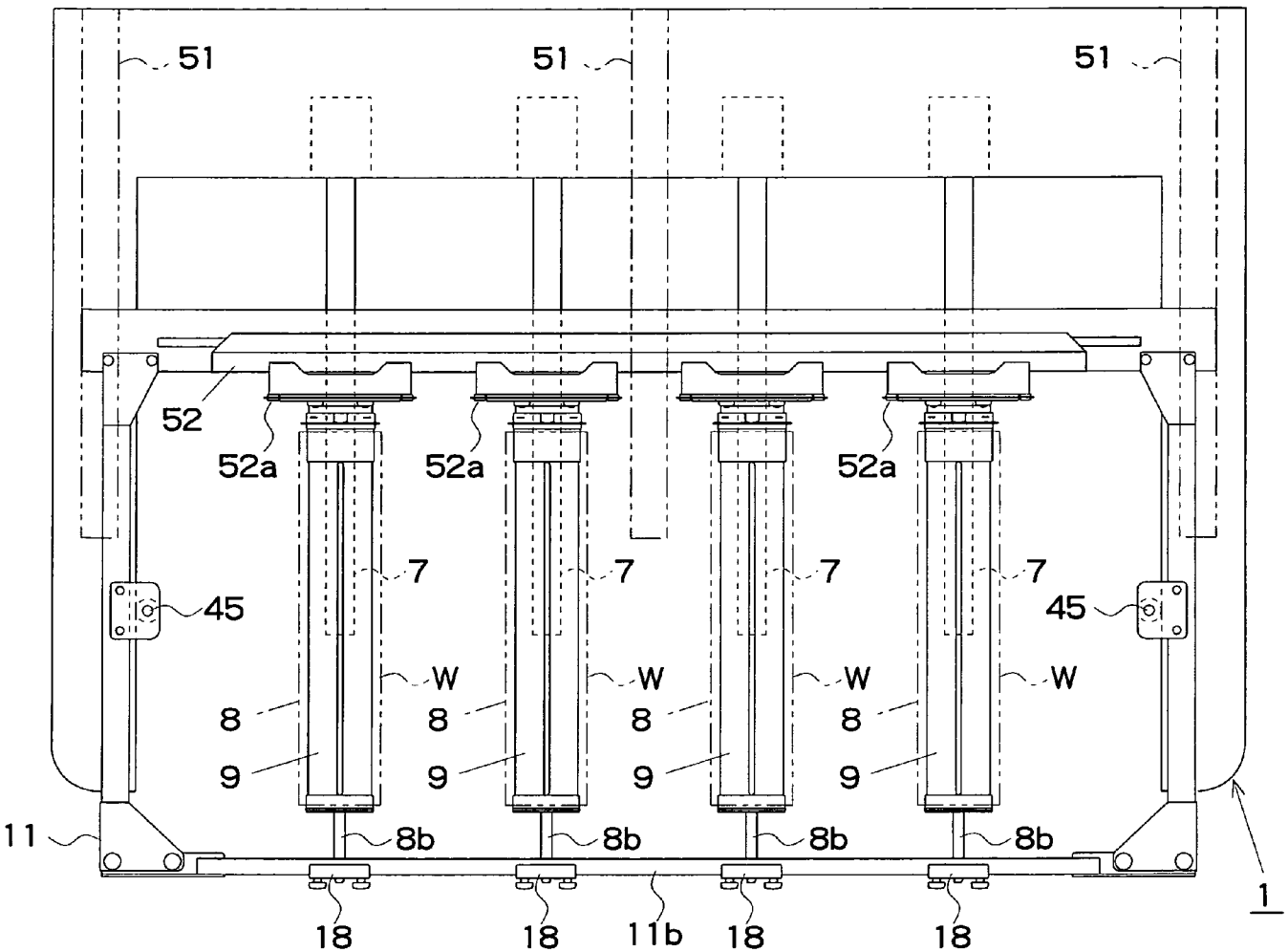
FIG. 22 is a plan view showing an embroidery sewing machine according to a seventh embodiment.
Figure 23:
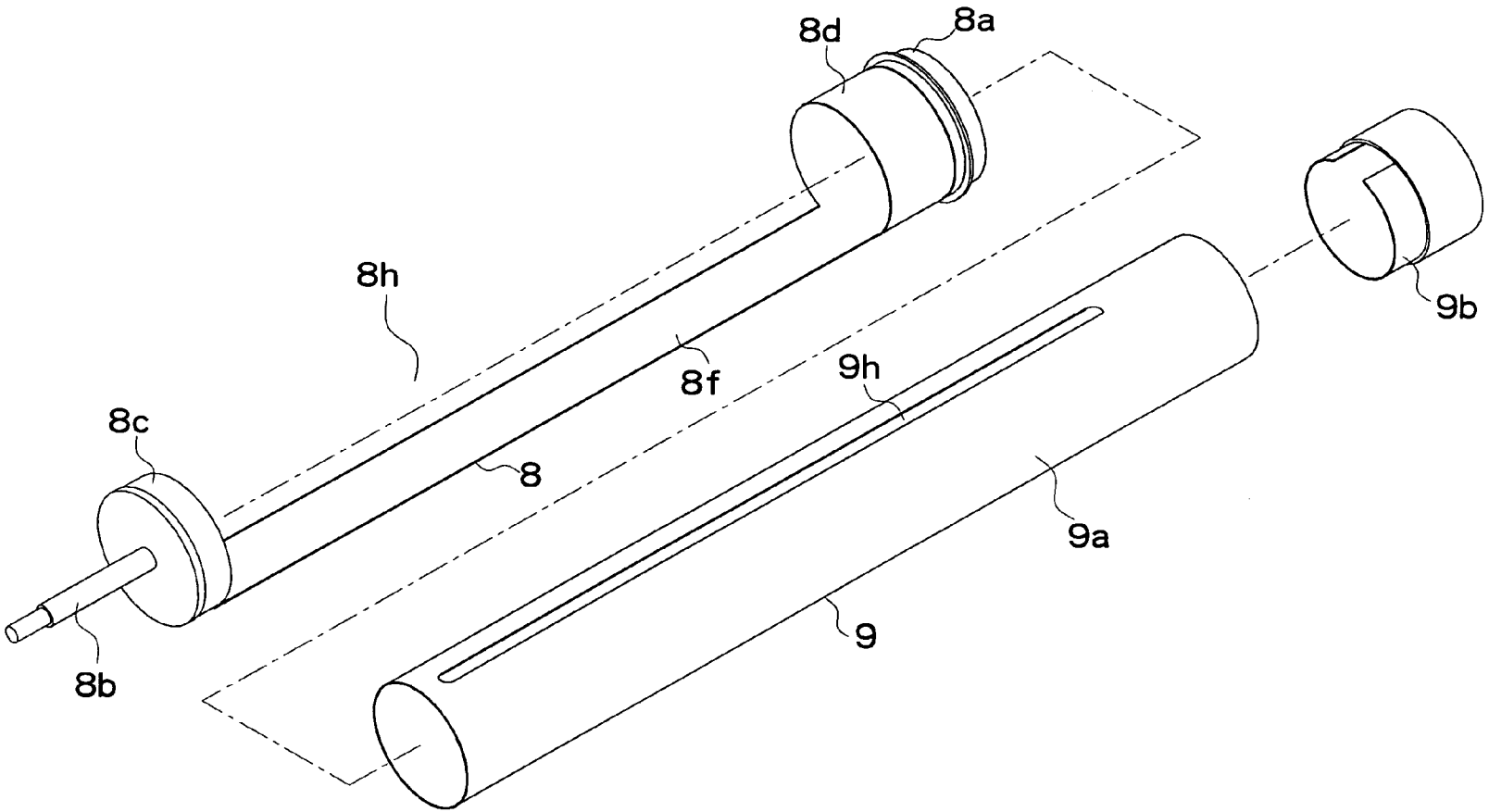
FIG. 23 is an exploded perspective view showing a sewing frame of the seventh embodiment.
Figure 24:
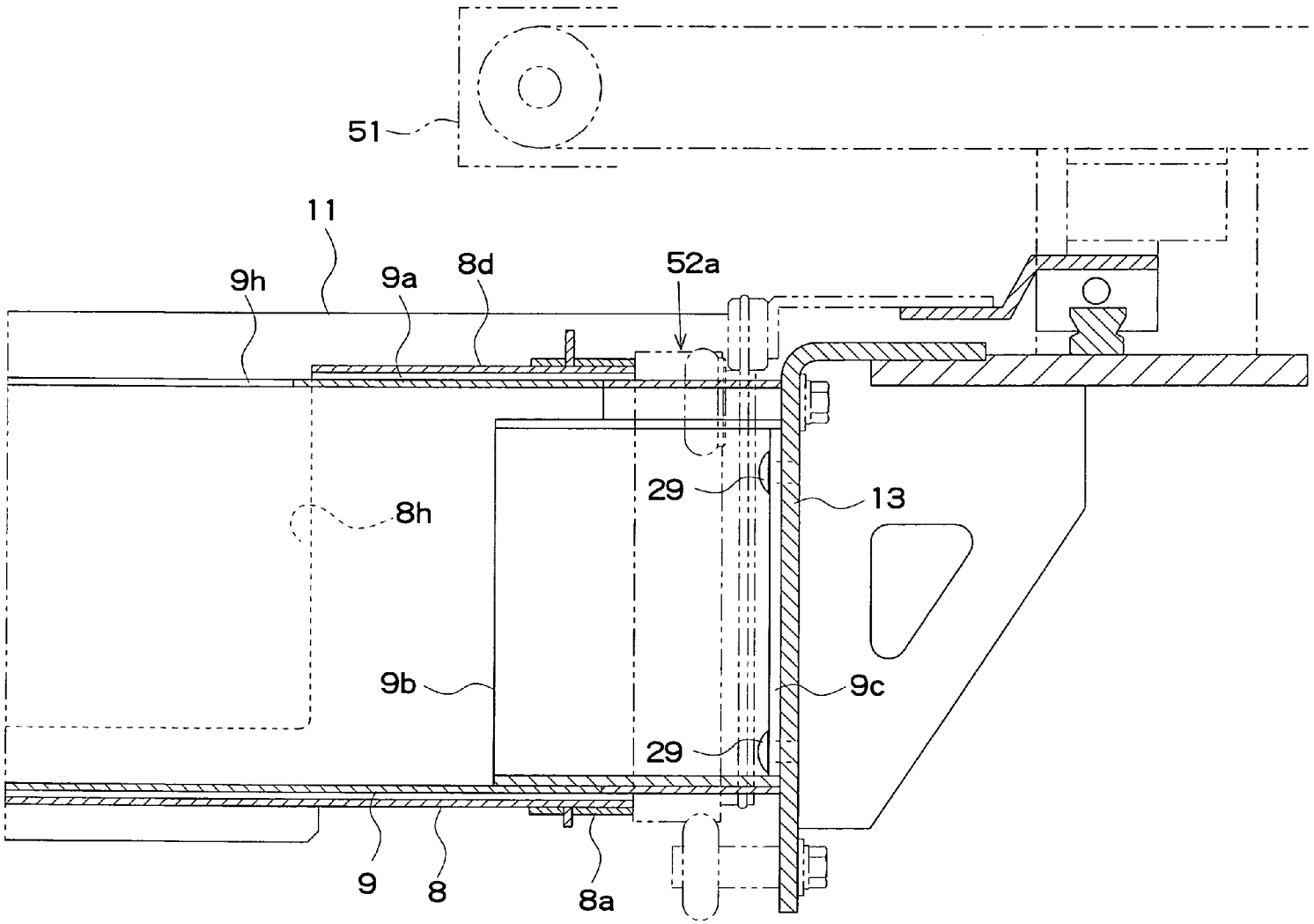
FIG. 24 is a sectional view showing a support structure at the rear end of the sewing frame of the seventh embodiment.

Meanwhile, the lower front frame side support mechanism 141 shown in FIGS. 20 and 21 is formed of: a front frame link member 142 linked to the front frame side portion 11*b* of the support frame 11; a bearing member 143 which bears the front frame link member 142 movably in the longitudinal direction below the support frame 11; a mount frame 144 which supports the bearing member 143 on the floor surface; and a connector frame 145 which connects a mount frame 144 to a leg portion 108 of the sewing machine frame 1*f*. The front frame link member 142 includes a pair of upper and lower blocks 146, 147 which grip the front frame side portion 11*b* to be fixed. The blocks 146 and 147 are connected with a bolt 148 so as to be separative.

The bearing member 143 includes a longitudinally long rail 149 at the inside of the channel steel with the open upper surface. The lower block 147 of the front frame link member 142 is connected to a slider 150 supported at the rail 149 with the bolt 151. The mount frame 144 includes a pair of front and rear screw type adjusters 152 for adjusting the height of the bearing member 143 on a horizontal frame 144*a* at the upper end, and the height adjuster 153 as described above and a vibration absorbing pad 154 at the lower end. The connector frame 145 has the rear end fixed to the leg portion 108 of the sewing machine frame 1*f*, and the front end connected to the mount frame 144 to be separative with a connector 155. The structure of the lower front frame side support mechanism 141 allows the front frame side portion 11*b* of the support frame 11 to be supported at the bearing member 143 at the lower side such that the front frame side portion does not hang downward, thus suppressing the vertical vibration of the front frame side portion 11*b* with the link member 142. This makes it possible to accurately process the embroidery on the heavy sewing cloth such as jeans which is applied to the long sewing frame 8.

Seventh Embodiment

The seventh embodiment shown in FIGS. 22 to 26 is provided with substantially the same sewing frame as that of the first embodiment. The cylindrical sewing frame 8 contains the cylindrical inner frame 9 having the length slightly longer and the diameter slightly smaller than the sewing frame 8 and inserted into the sewing frame 8 to form the double frame structure including the outer and inner frames. The sewing frame 8 includes a front cylindrical element 8*c* having the closed front end, a rear cylindrical element 8*d* having the open front and rear ends, a connector element 8*f* which connects those elements, and a sewing window 8*h* which defines the embroidery range to be processed on the sewing cloth W.

The sewing window 8*h* is formed to have a circumferentially wide open area with the same length as that of the connector element 8*f* which is to be excluded from the open area. The shaft 8*b* supported at the front frame side portion 11*b* of the support frame 11 is formed on the front end surface of the front cylindrical element 8*c* to protrude therefrom. A connector portion 8*a* linked to the rotating drive mechanism 52*a* is provided at the rear end of the rear cylindrical element 8*d*. The bracket serving as the support portion 18 is attached to the front frame side portion 11*b* of the support frame 11, and a bearing 20 which supports the shaft 8*b* at the bracket.

The inner frame 9 is formed by connecting a short pipe 9*b* to the rear end of the long pipe 9*a* with substantially the same length as that of the sewing frame 8. A slit 9*h* with substantially the same length as that of the sewing window 8*h*, extending in the longitudinal direction is formed in the circumferential wall of the long pipe 9*a*, through which an embroidery needle (needle for the embroidery sewing machine) 5 of the embroidery sewing machine 1 pierces. Meanwhile, an end plate 9*c* (see FIG. 26) serving as the attachment portion is fixed to the rear end of the short pipe 9*b*, and the rear end of the inner frame 9 is attached to the perpendicular plate (attachment base) 13 of the rotating drive mechanism 52*a* of the lateral drive unit 52 with the screw 28 threaded through the screw through hole 9*d* of the end plate 9*c*. The perpendicular plate 13 is a fixing portion fixed on the support frame 11, which does not rotate but moves only in the longitudinal direction together with the support frame 11. The following functions and effects may be obtained by the above-structured sewing frame.

(1) As both the sewing frame 8 and the inner frame 9 are formed to be longitudinally long, and the inner frame 9 is inserted into the sewing frame 8 with a small gap therebetween, the cylindrical frame may be formed into the longitudinally long double frame structure including the outer and inner frames.

(2) In the double frame structure, the inner frame 9 covers the sewing window 8*h* of the sewing frame 8 from the inside such that the sewing cloth W is supported at the circumferential surface that is brought very close to the circumferential surface of the sewing frame 8.

(3) The sewing window 8*h* is largely opened in the longitudinal and circumferential directions of the sewing frame 8 without weakening the force for holding the sewing cloth W to ensure sufficient embroidery range to process the large pattern on the long tubular sewing cloth W such as jeans.

(4) As the entire area of the sewing window 8*h* is covered by the inner frame 9 from the inside, the complicated work for applying the interliner may be eliminated, thus improving the working efficiency.

(5) As the interliner is not required, the part for holding the interliner on the sewing frame 8 is no longer necessary. This makes it possible to form the cylindrical frame into the simple structure with reduced number of parts at the reduced cost.

(6) The front and rear ends of the sewing frame 8 are supported at the support frame 11 with the shaft 8*b* and the engagement portion (link portion) 8*a*. This ensures to prevent the front portion of the sewing frame 8 from hanging downward, and allows the accurate processing of the embroidery pattern on a wider range of the heavy and long tubular cloth such as the jeans and the golf bag.

Figure 25:
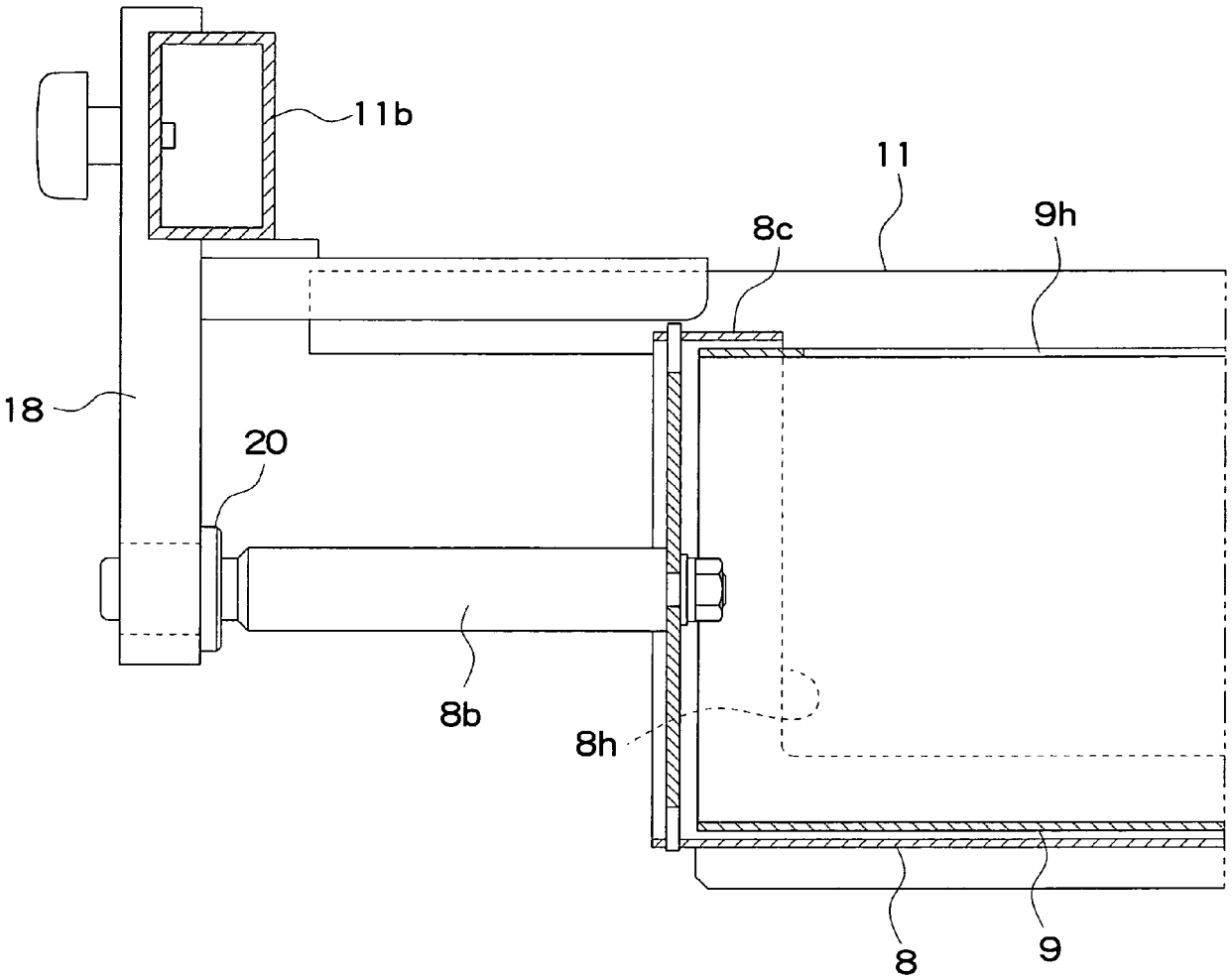
FIG. 25 is a sectional view showing the support structure at the front end of the sewing frame of the seventh embodiment.
Figure 26:
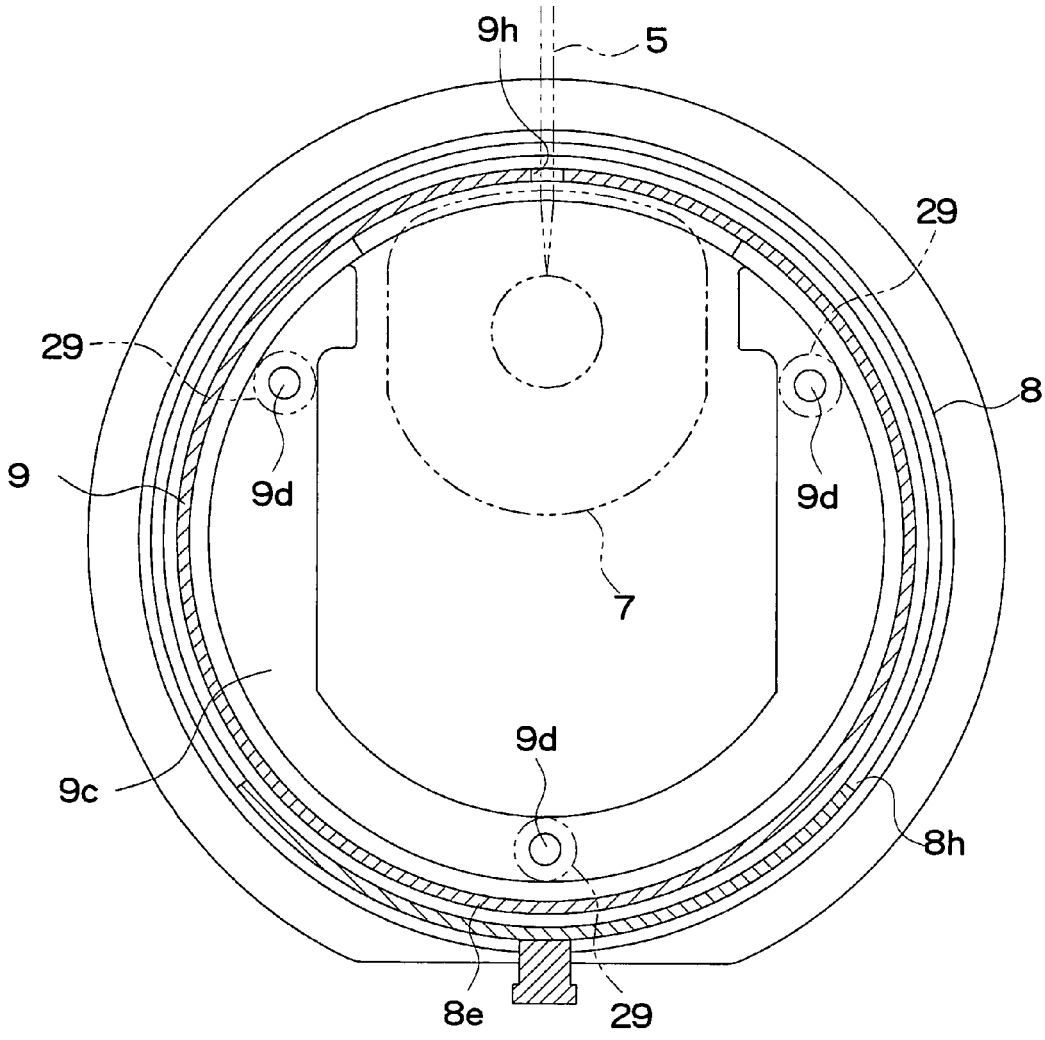
FIG. 26 is a vertical sectional view showing the sewing frame of the seventh embodiment.
Figure 27:
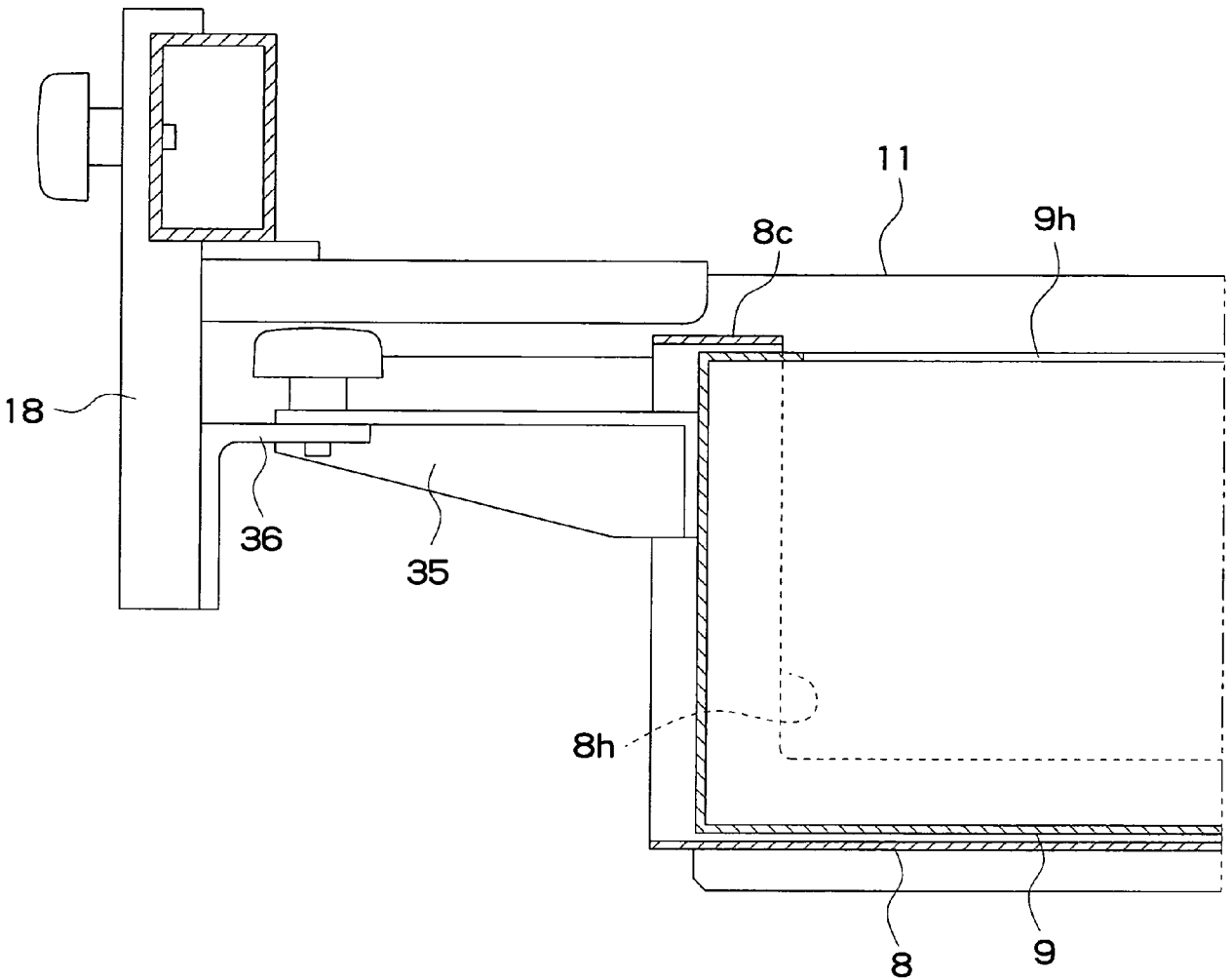
FIG. 27 is a sectional view showing another example of the support structure at the front end of the sewing frame according to the seventh embodiment.
Figure 28:
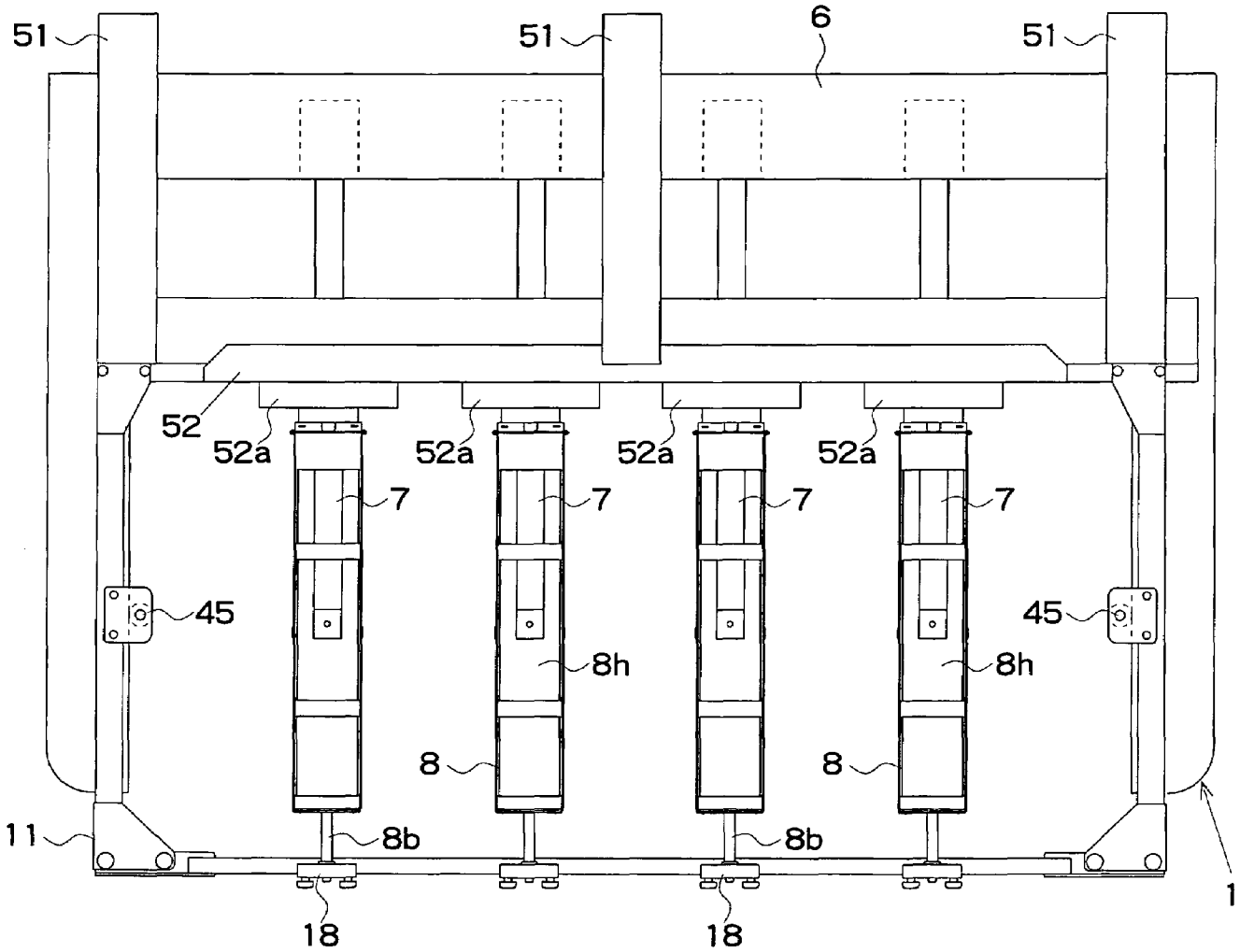
FIG. 28 is a plan view showing an embroidery sewing machine according to an eighth embodiment.

Note that the structure for supporting the front end of the sewing frame 8 at the support frame 11 is not limited to the embodiment as shown in FIG. 25, but may be formed into the structure shown in FIG. 27. In this case, the front end surface of the sewing frame 8 is opened, the support piece 35 is formed on the front end surface of the inner frame 9, and a bearing fitting 36 which bears the support piece 35 on the bracket as the support portion 18 of the support frame 11 is provided. The soft material may be provided between the front ends of the inner frame 9 and the sewing frame 8.

Eighth Embodiment

The eighth embodiment shown in FIGS. 28 to 32 is substantially the same as the first embodiment except that the cylindrical sewing frame 8 is structured such that the sewing cloth W is supported with the interliner 160, which covers the sewing window 8*h*, along the circumferential surface of the sewing frame 8, and the sewing frame 8 is provided with the interliner holding member 166 and the pressure member 176. The explanation of the first embodiment may be used for the other structures that are similar to those of the first embodiment.

The material, such as the cardboard and the nonwoven fabric, that exhibits relatively high rigidity and thickness sufficient to hold the shape of the sewing cloth W may be used as the interliner 160.

A pair of left and right band-like pieces 161 are fixed on the outer peripheral surface of the sewing frame 8 to extend along the longitudinal edge of the sewing window 8*h*. The bearing member 162 is formed between the band-like pieces 161. The bearing member 162 is formed like an arch to allow the interliner 160 to be supported within the same cylindrical surface as that of the sewing frame 8, and fit with the screw hole 165 of the band-like piece 161 with the screw 164 at the attachment portion 163 such that the longitudinal position is selectable. The interliner holding member 166 is disposed at the lower side of the left and right band-like pieces 161 to allow the interliner holding member 166 to press the interliner 160 against the sewing frame 8. The band-like pieces 161 prevents lack of the interliner 160 (see FIG. 32B).

Figure 30:
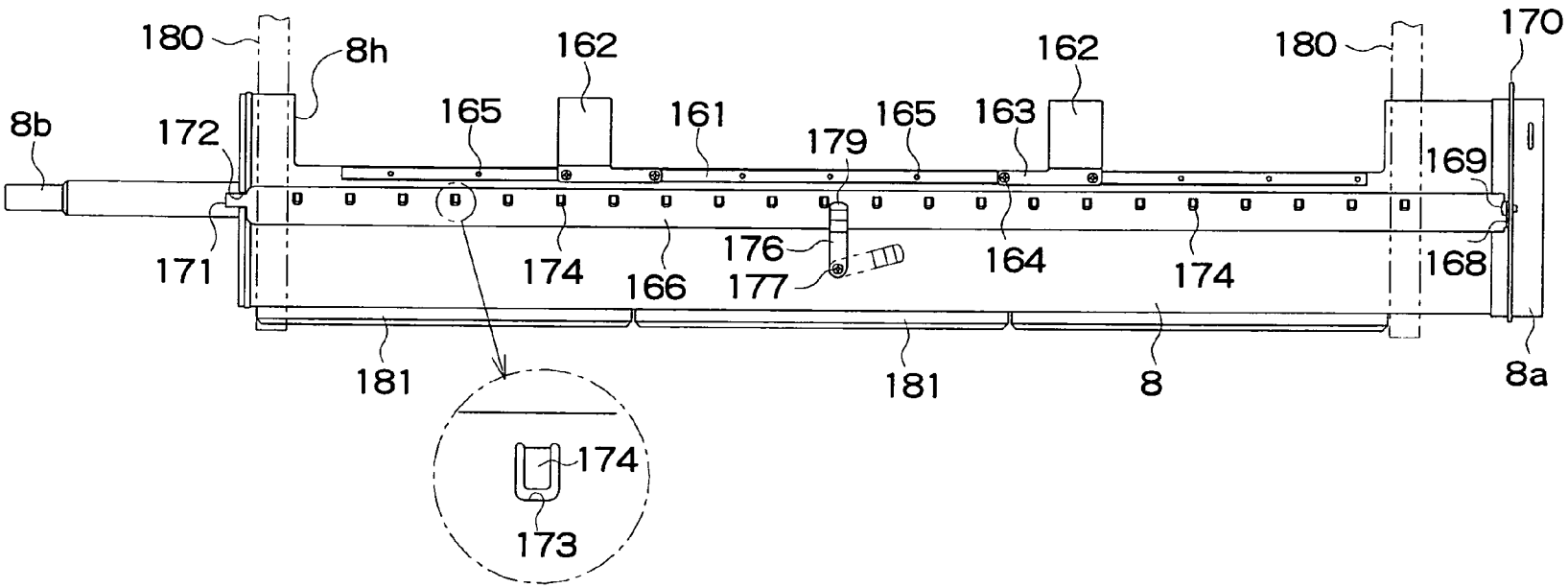
FIG. 30 is a side view showing the sewing frame of the eighth embodiment.
Figure 31:
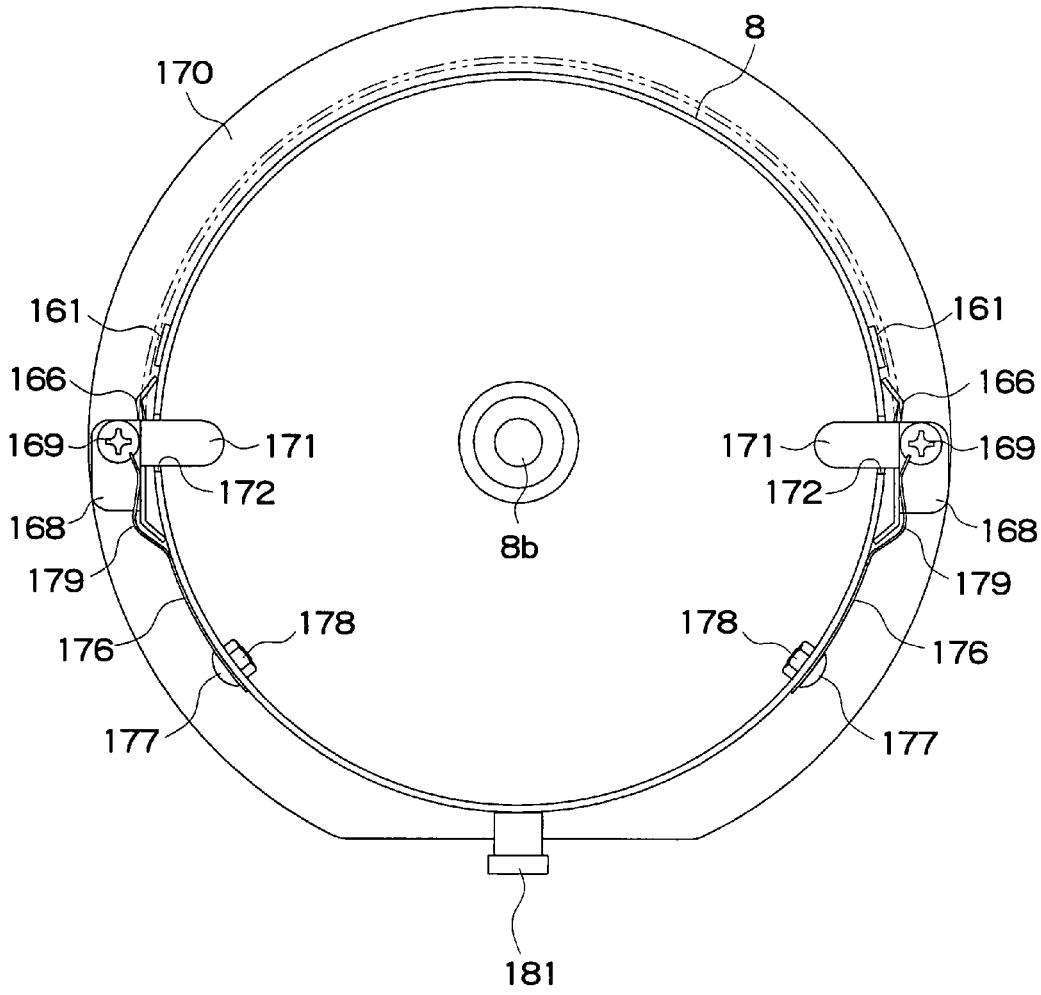
FIG. 31 is a front view of the sewing frame of the eighth embodiment.

Referring to FIGS. 30 and 31, the interliner holding member 166 formed of the steel strip plate is longer than the sewing window 8*h*, and has the attachment piece 168 at the rear end and a fixing piece 171 at the front end. The attachment piece 168 is attached to a flange portion 170 of the sewing frame 8 with the screw 169 such that the rear end of the interliner holding member 166 is fixedly held at the sewing frame 8. The fixing piece 171 is elastically fixed to a front end notch 172 of the sewing frame 8 such that the front end of the interliner holding member 166 is detachably held with respect to the sewing frame 8. Clicks 174 are formed in the interliner holding member 166 at a plurality of points by forming cuts 173 in the longitudinal direction. The clicks 174 bite the interliner 160 in the state where the fixing piece 171 closes the front end of the interliner holding member 166 to strongly hold the interliner 160 on the sewing frame 8.

The pressure member 176 is provided at the lower side of the left and right interliner holding member 166 at the intermediate position of the sewing window 8*h* in the longitudinal direction. The pressure member 176 is formed of the strip-like plate spring and has the base end pivotally attached to the sewing frame 8 using the screw 177 and the nut 178, and the leading end provided with a bent pressure portion 179 for pressing the intermediate portion of the interliner holding member 166 against the sewing frame 8. The operator operates the pressure member 176 to rotate between the operational position at which the pressure portion 179 is overlapped with the outer surface of the interliner holding member 166 (indicated by the solid line in FIG. 30) and the non-operational position at which the pressure portion 179 is remote downward of the interliner holding member 166 (indicated by the chain line in FIG. 30) in the longitudinal direction.

Figure 32A:
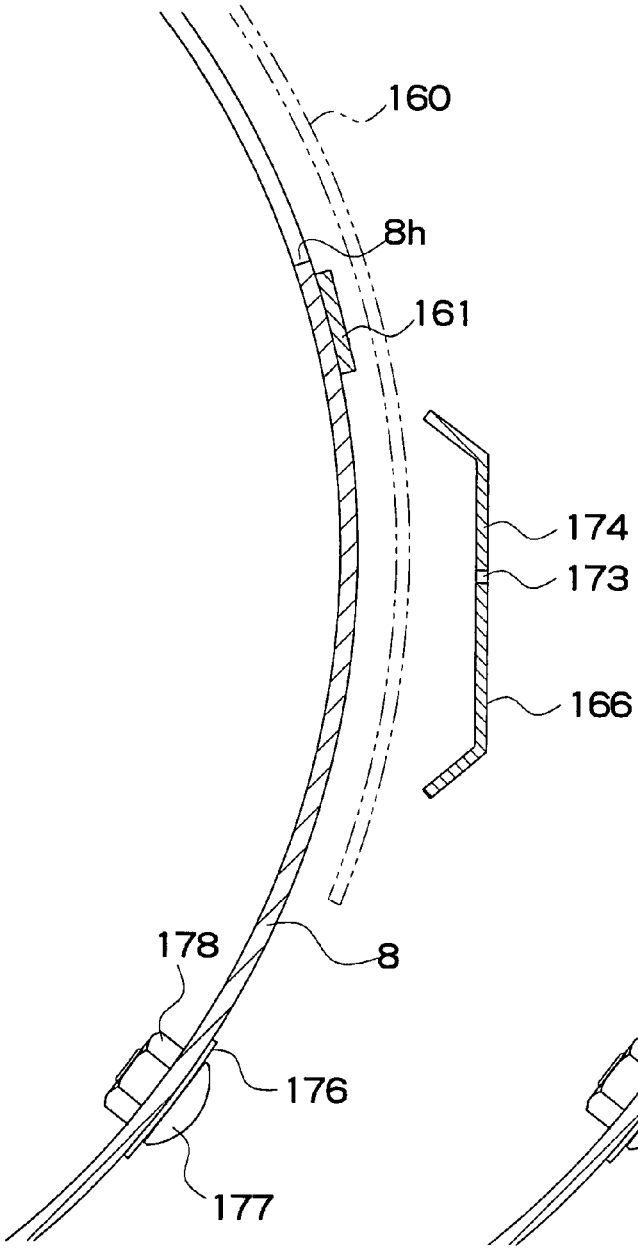
FIG. 32 is a sectional view showing the procedure of holding an interliner on the sewing frame of the eighth embodiment.
Figure 32B:
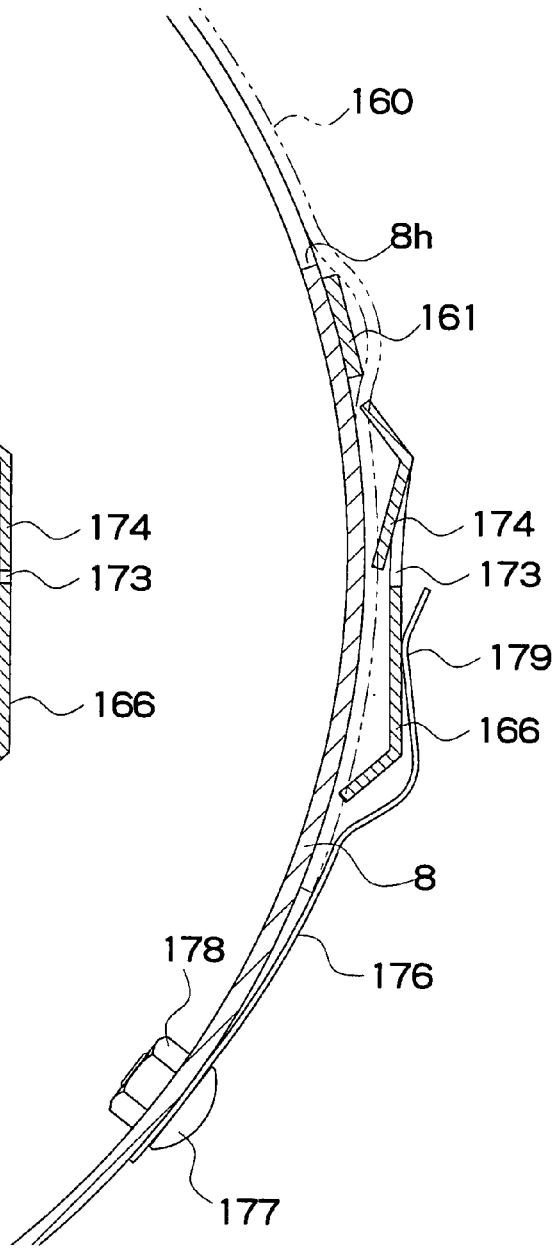

In the case where the above-structured sewing frame 8 is used for processing the embroidery pattern on the long tubular cloth W like jeans, the pressure member 176 is rotated to the non-operational position to open the interliner holding member 166 such that the sewing window 8*h* is covered with the interliner 160 as shown in FIG. 32A. Then referring to FIG. 32B, the interliner holding member 166 is closed such that the interliner 160 is gripped between the interliner holding member 166 and the sewing frame 8. Then the pressure member 176 is rotated to the operational position, and the intermediate portion of the interliner holding member 166 is pressed against the sewing frame 8 with the pressure portion 179 to elastically deform the interliner holding member 166 and to allow the clicks 174 to bite into the interliner 160. In this way, the interliner 160 may be strongly held on the sewing frame 8 under the elastic force of the pressure member 176 at the longitudinal intermediate position of the sewing window 8*h*.

Then the interliner 160 is covered with the sewing cloth W such that the sewing cloth W and the interliner 160 are tightened to the sewing frame 8 together with the interliner holding member 166 using the band 180 (see FIG. 30). The surplus portion of the sewing cloth W is gripped by a clip (not shown) so as to be held at a protruding thread 181 (see FIG. 31) formed on the lower surface of the sewing frame 8. Thereafter, the sewing frame 8 is attached to the support frame 11, and the embroidery sewing machine 1 is activated to process the longitudinally long embroidery pattern on the sewing cloth W. As the interliner 160 is strongly held on the sewing frame 8 by the pressure member 176, the interliner 160 is not deformed by the impact resulting from the drop of the needle. Accordingly, the interliner 160 holds the normal cylindrical shape of the sewing cloth W, resulting in accurate processing of the embroidery patterns.

The embodiment may be modified for the practical use as described below.

Figure 29:
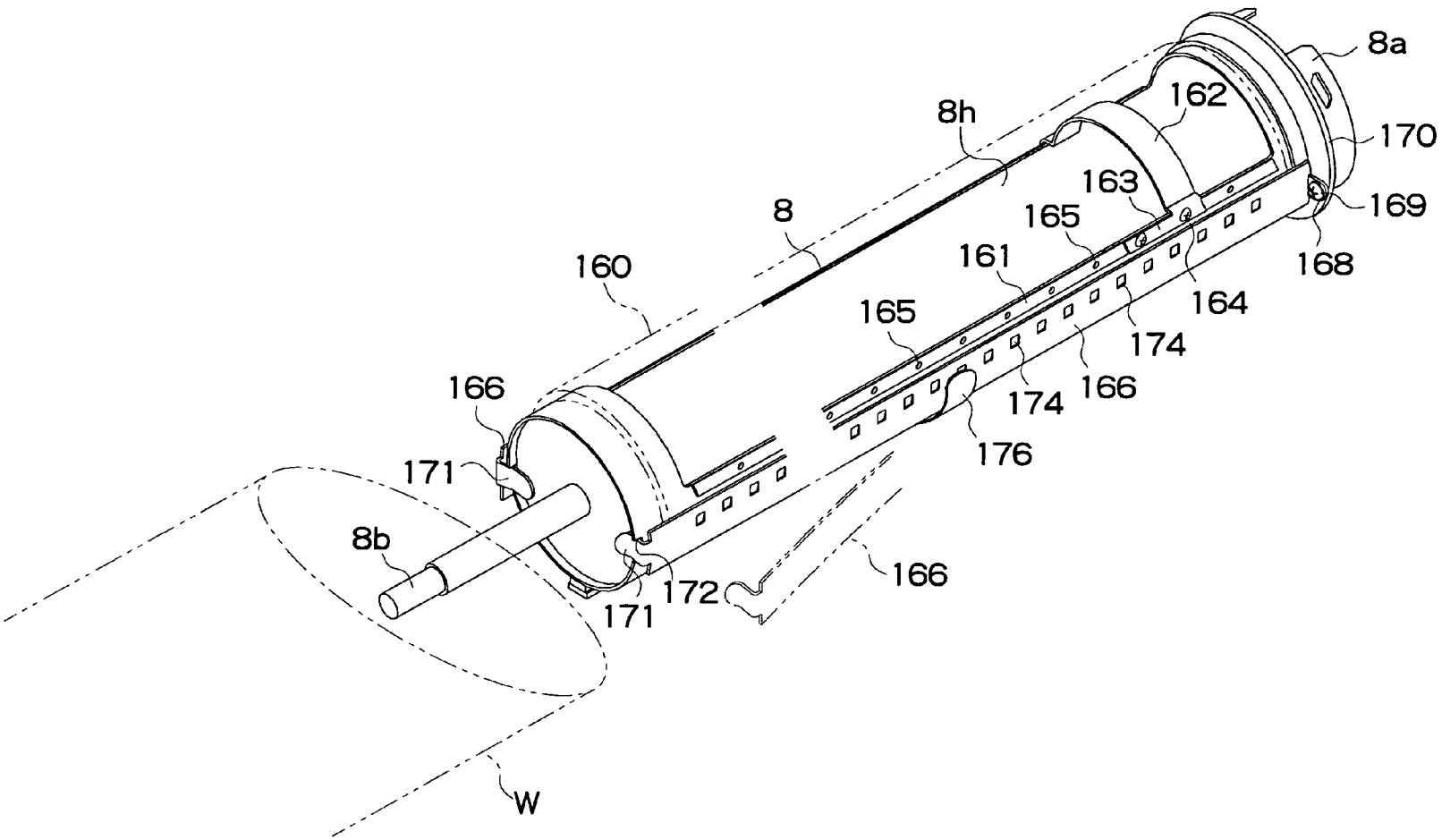
FIG. 29 is a perspective view showing a sewing frame of the eighth embodiment.

(a) The interliner holding member 166 shown in FIG. 29 is formed of a bar-like material to be longitudinally long.

(b) The interliner holding member 166 is rotatably held at the sewing frame 8 in the lateral or the up-down direction with the shaft at the rear end.

(c) The front end of the interliner holding member 166 is fixedly held, and the rear end thereof is held so as to be opened with respect to the sewing frame 8.

(d) Two or three pressure members 176 as shown in FIG. 29 are provided within the range of the length of the sewing window 8*h*.

Ninth Embodiment

Figure 33:
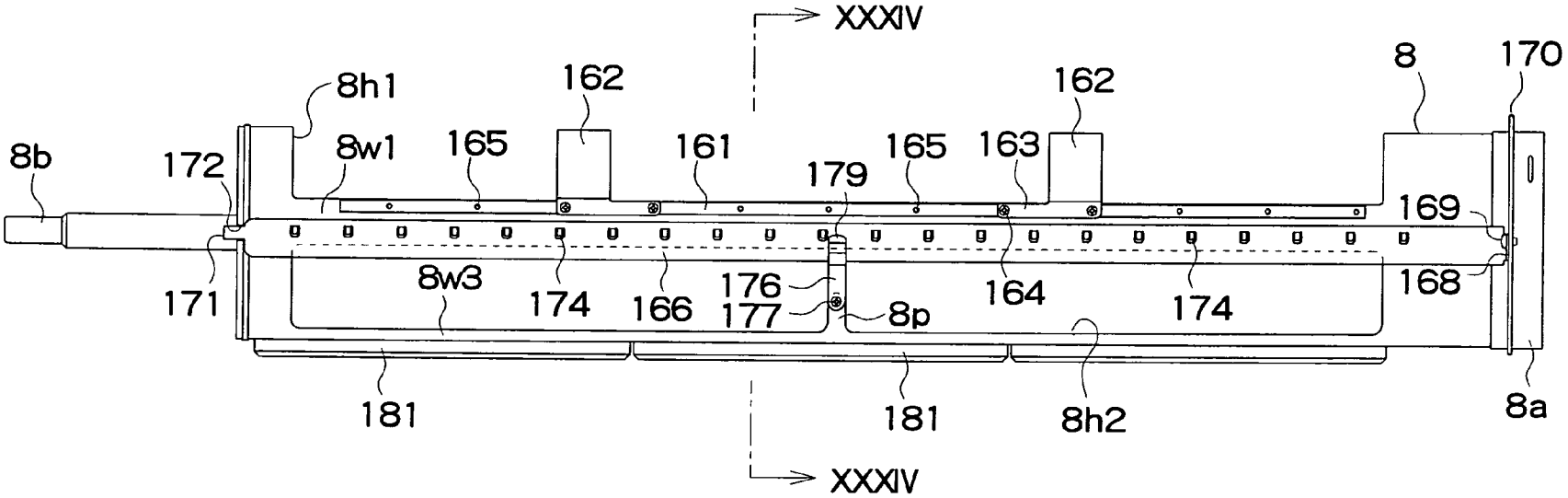
FIG. 33 is a side view showing a sewing frame according to a ninth embodiment.
Figure 34:
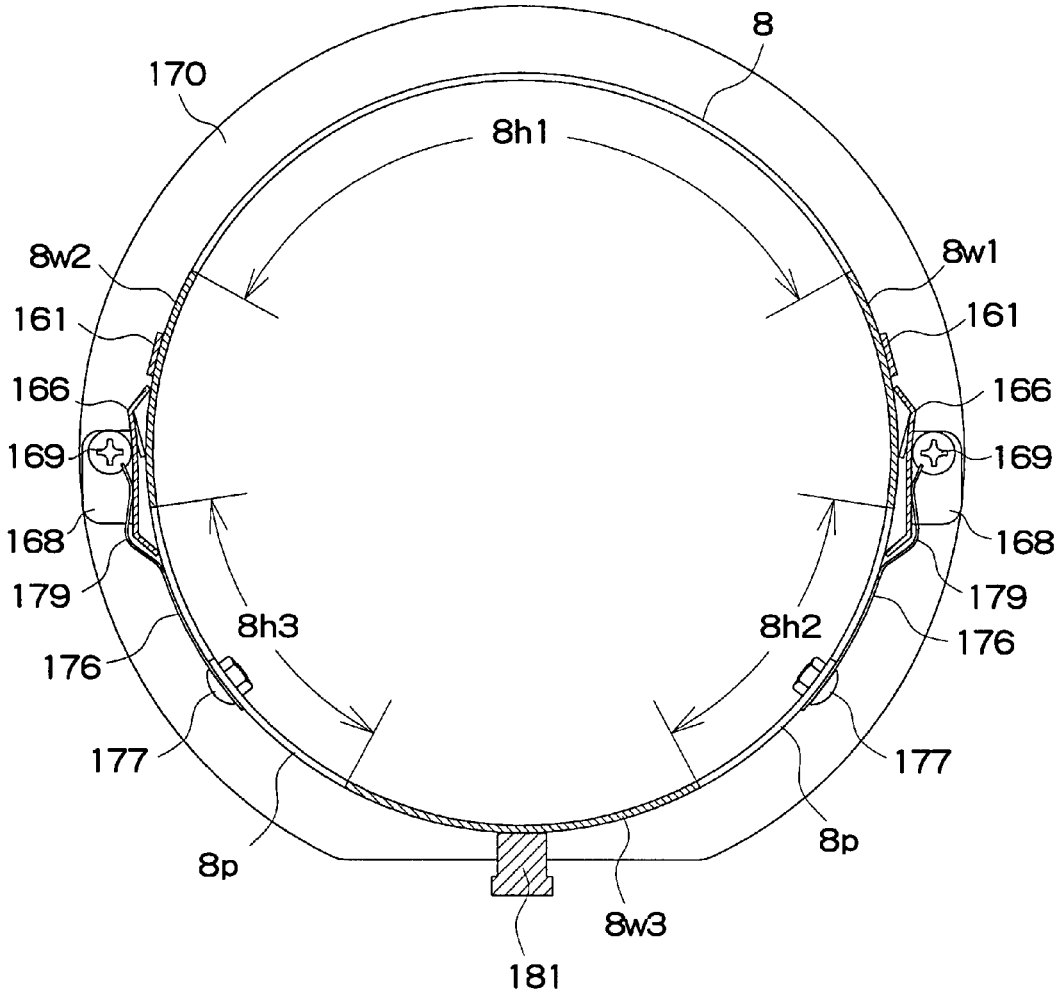
FIG. 34 is a sectional view taken along line XXXIV-XXXIV of FIG. 33.

The ninth embodiment shown in FIGS. 33 and 34 is different from the eighth embodiment in the structure of the sewing frame 8. The sewing frame 8 includes three sewing windows 8*h*1, 8*h*2 and 8*h*3 and three reinforcing walls 8*w*1, 8*w*2 and 8*w*3 on the peripheral wall of the cylindrical body each extending in the longitudinal direction. The first sewing window 8*h*1 has substantially the same size as that of the sewing window 8 of the eighth embodiment. The second and the third sewing windows 8*h*2 and 8*h*3 each having the area smaller than that of the first sewing window 8*h*1 are formed to be symmetrical in the lateral direction. The interliner holding member 166 which is the same as the one used in the eighth embodiment is provided for the first and the second reinforcing walls 8*w*1 and 8*w*2. The pressure member 176 which presses the intermediate portion of the interliner holding member 166 is rotatably supported at the support piece 8*p* of the third reinforcing wall 8*w*3.

In the structure of the ninth embodiment, three sewing windows 8*h*1, 8*h*2 and 8*h*3, and the same number of reinforcing walls 8*w*1, 8*w*2 and 8*w*3 are formed on the sewing frame 8. This makes it possible to reduce the weight of the long sewing frame 8 without deteriorating its rigidity. As the three sewing windows 8*h*1, 8*h*2 and 8*h*3 form the large opening as a whole in the circumferential direction of the sewing frame 8, the respective sewing windows 8*h*1, 8*h*2 and 8*h*3 are selectively set as the sewing position of the embroidery sewing machine 1 by the rotating drive mechanism 52*a* so as to greatly enlarge the embroidery range covered by the sewing frame 8. Accordingly, the longitudinally long embroidery pattern may be easily processed on the respective portions of jeans, for example, in the circumferential direction without applying the sewing cloth W again.

Tenth Embodiment

The tenth embodiment is substantially the same as the first embodiment except that the cylindrical sewing frame 8 includes a base frame 8*m* and a plurality of cloth application frames 182 each having the differently shaped sewing window, which are replaceably attached to the base frame 8*m*. The explanation of the first embodiment may be used for the other structures that are similar to those of the first embodiment.

Figure 36:
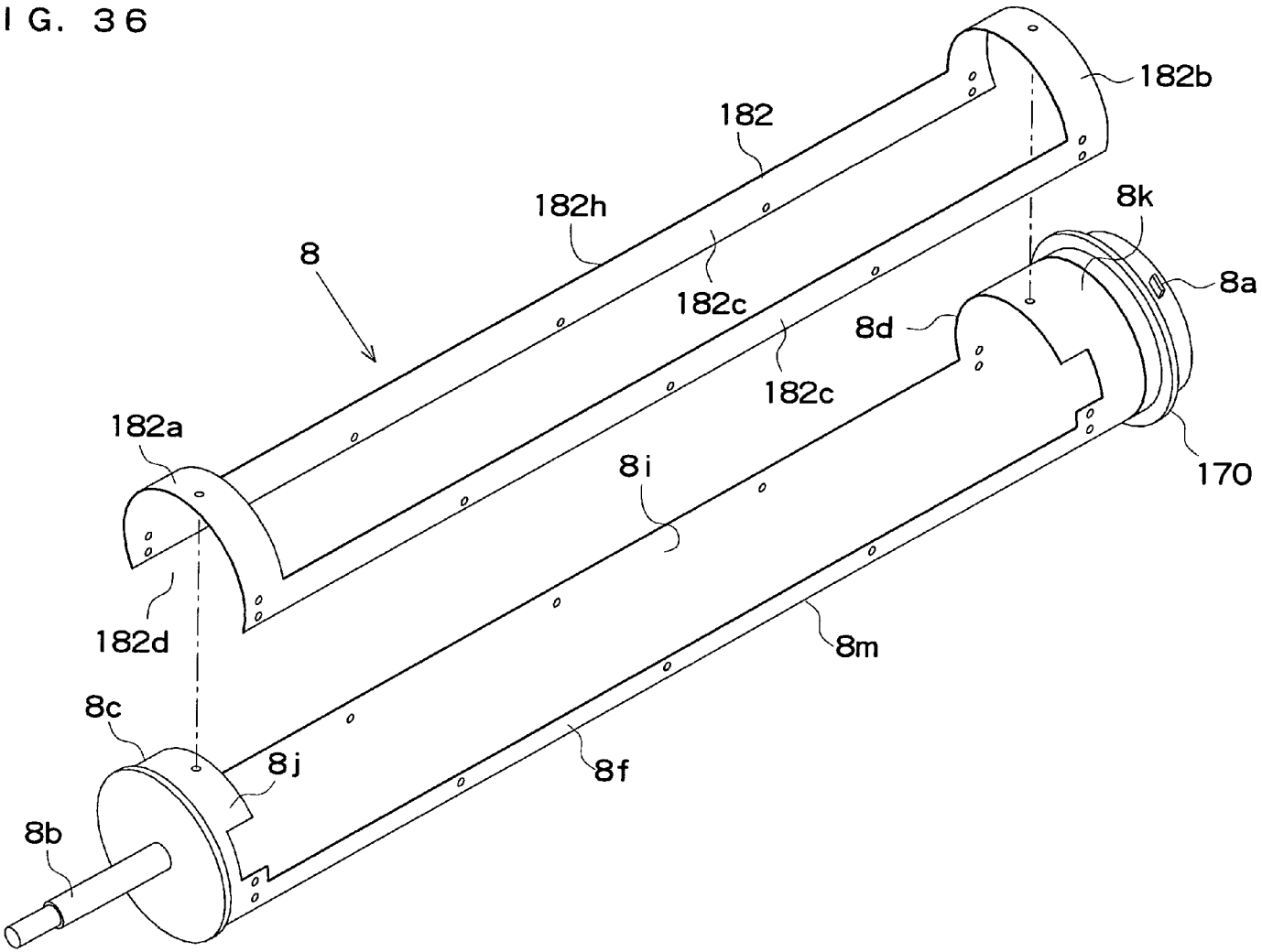
FIG. 36 is a perspective view showing a sewing frame of the tenth embodiment.
Figure 37:
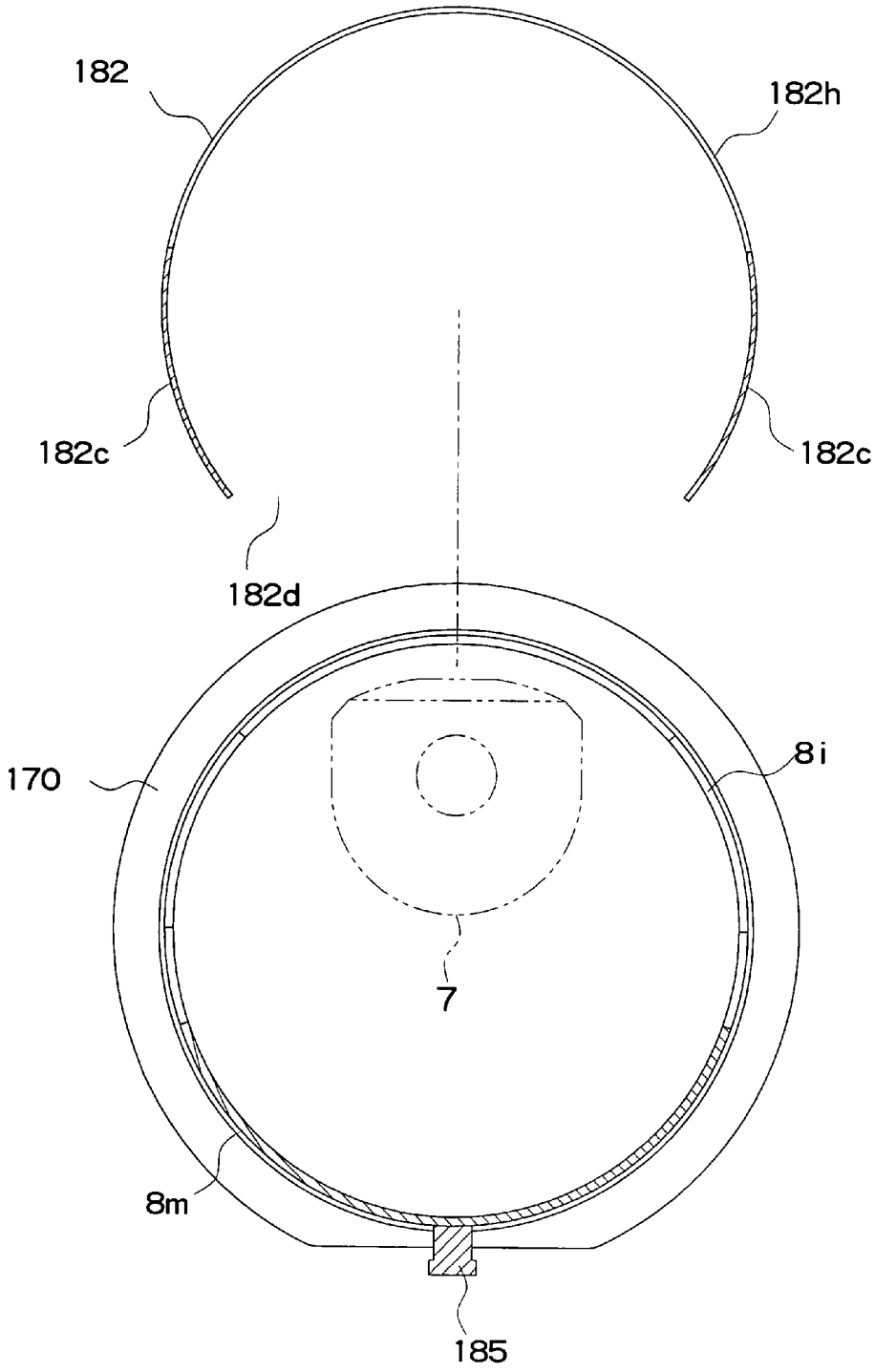
FIG. 37 is a sectional view showing the sewing frame of the tenth embodiment.
Figure 38:
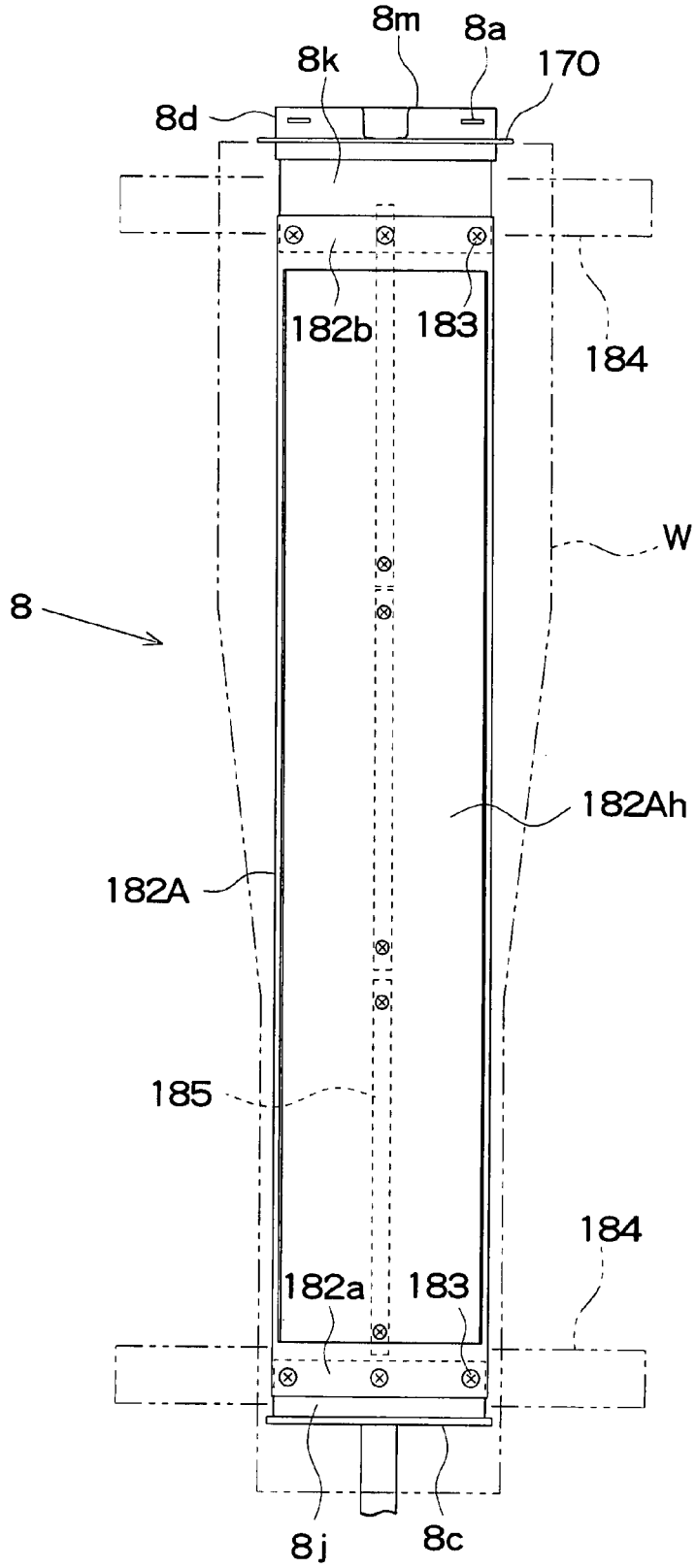
FIG. 38 is a plan view showing the sewing frame of the tenth embodiment.

Referring to FIGS. 36 to 38, the sewing frame 8 formed into the cylindrical shape includes the base frame 8*m* attached to the sewing frame drive unit 10 and the longitudinally long cloth application frame 182 to which the long tubular sewing cloth W is applied. The base frame 8*m* is formed into the cylindrical shape to have the length slightly longer than that of the cloth application frame 182 through the sheet metal processing, and includes a front element 8*c* with the closed front end, a rear element 8*d* with open front and rear ends, and a link element 8*f* which links the front element 8*c* and the rear element 8*d*, and an opening 8*i* having the same length as that of the link element 8*f*.

A shaft 8*b* is formed on the front end surface of the front element 8*c* to protrude therefrom. A front support portion 8*j* for supporting the front end 182*a* of the cloth application frame 182 is attached to the peripheral wall of the front element 8*c*. A flange 170 is fixed to the rear element 8*d* which is provided with an engagement portion (attachment portion) 8*a* attached to the rotating drive mechanism 52*a* to the rear of the flange 170. A rear support portion 8*k* for supporting the rear end 182*b* of the cloth application frame 182 is formed to the front of the flange 170.

The cloth application frame 182 is formed into the semi-cylindrical shape through the sheet metal processing, and includes a sewing window 182*h* which defines the embroidery range on the sewing cloth W, a connector 182*c* connected to the link element 8*f* of the base frame 8*m* at the left and right sides of the sewing window 182*h*, and an opening 182*d* which opens the connector 182*c* in the lateral direction below the sewing window 182*h* within the cylindrical body having substantially the same diameter as that of the base frame 8*m*. The cloth application frame 182 is attached to the base frame 8*m* with a plurality of screws 183 (see FIG. 38) so as to detachably cover the base frame 8*m* through the opening 182*d*.

The plural cloth application frames 182 each having the differently shaped sewing window 182*h* are prepared for the sewing frame 8. The cloth application frame 182A shown in FIG. 38 includes a rectangular sewing window 182Ah which is wide in the lateral direction and straight in the longitudinal direction of the long tubular sewing cloth W, such as trousers (e.g. jeans) or the like. The cloth application frames 182B and 182C shown in FIGS. 39A and 39B include arched sewing windows 182Bh and 182Ch each of which is narrow in width and curved in the longitudinal direction. A cloth application frame 182D shown in FIGS. 40A and 40B includes a wave-like sewing window 182Dh which is narrow in width and extends to form the wave-like shape.

Each of the sewing windows 182Ah to 182 Dh extends to be long between the front end 182*a* and the rear end 182*b* of each of the cloth application frames 182A to 182D, such that the series of embroidery patterns in the longitudinal direction are processed on the sewing cloth W. In the state where the front and rear ends 182*a* and 182*b* are set at the corresponding front and rear support portions 8*j* and 8*k* of the base frame 8*m*, each of the cloth application frames 182A to 182D is replaceably held at the base frame 8*m*. The sewing cloth W is held at the sewing frame 8 with a belt 184 (see FIG. 38), and the surplus portion of the sewing cloth W is fixed to a cloth stopper 185 (see FIG. 37) which protrudes to the lower surface of the base frame 8*m* with a clip.

The use of the sewing frame 8 for the embroidering process according to the tenth embodiment provides the following functions and effects.

(1) As the front element 8*c* and the rear element 8*d* of the base frame 8*m* allow the cloth application frame 182 to be held at the front and rear ends 182*a* and 182*b*, the sewing window 182*h* may be formed to cover substantially the whole length of the cloth application frame 182. The series of embroidery patterns in the longitudinal direction may be efficiently processed in one process step without exchanging the sewing cloth W to be applied.

Figures 39A, 39B:
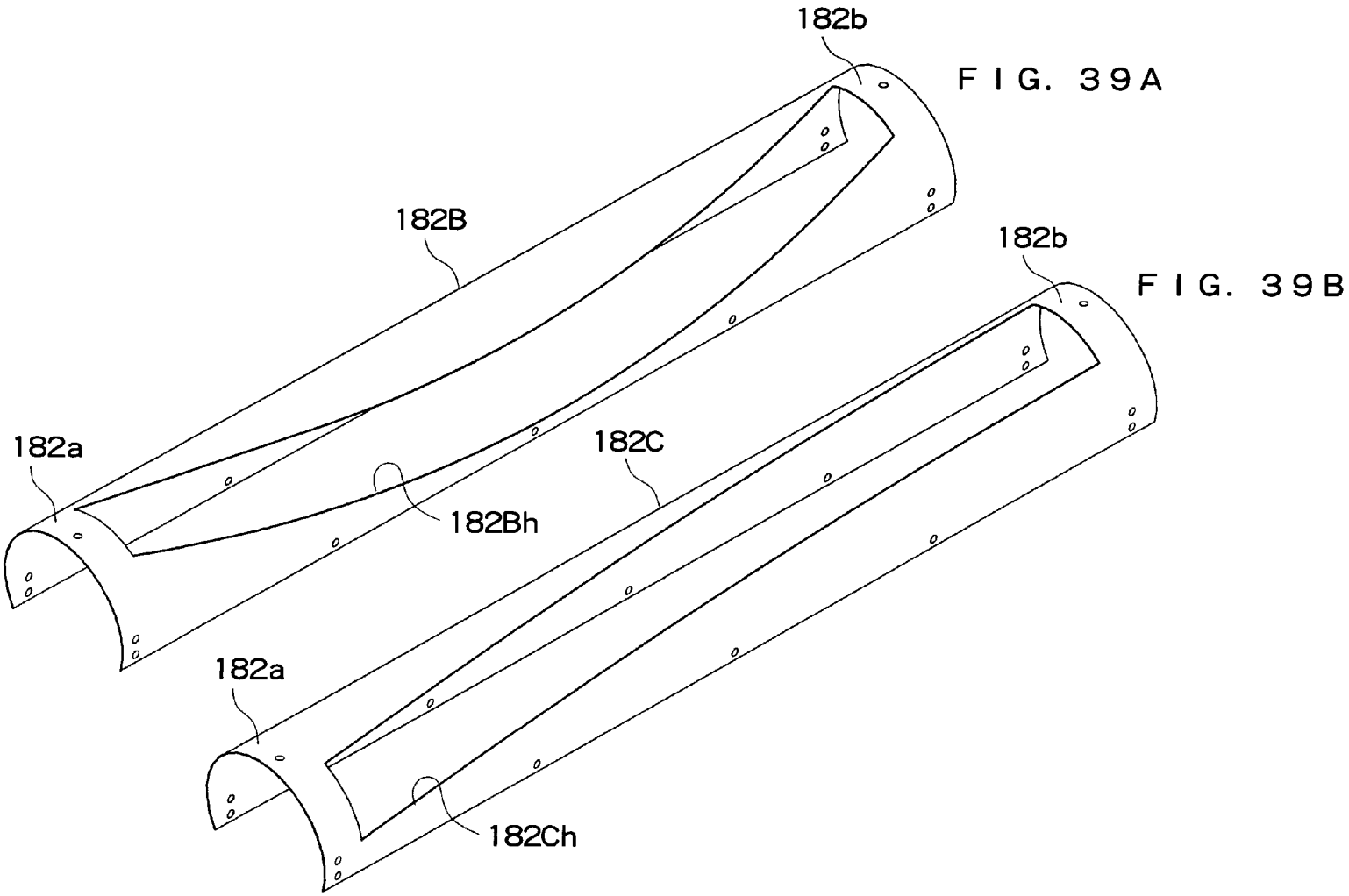
FIG. 39 is a perspective view showing a cloth application frame of the sewing frame according to the tenth embodiment.
Figure 40A:
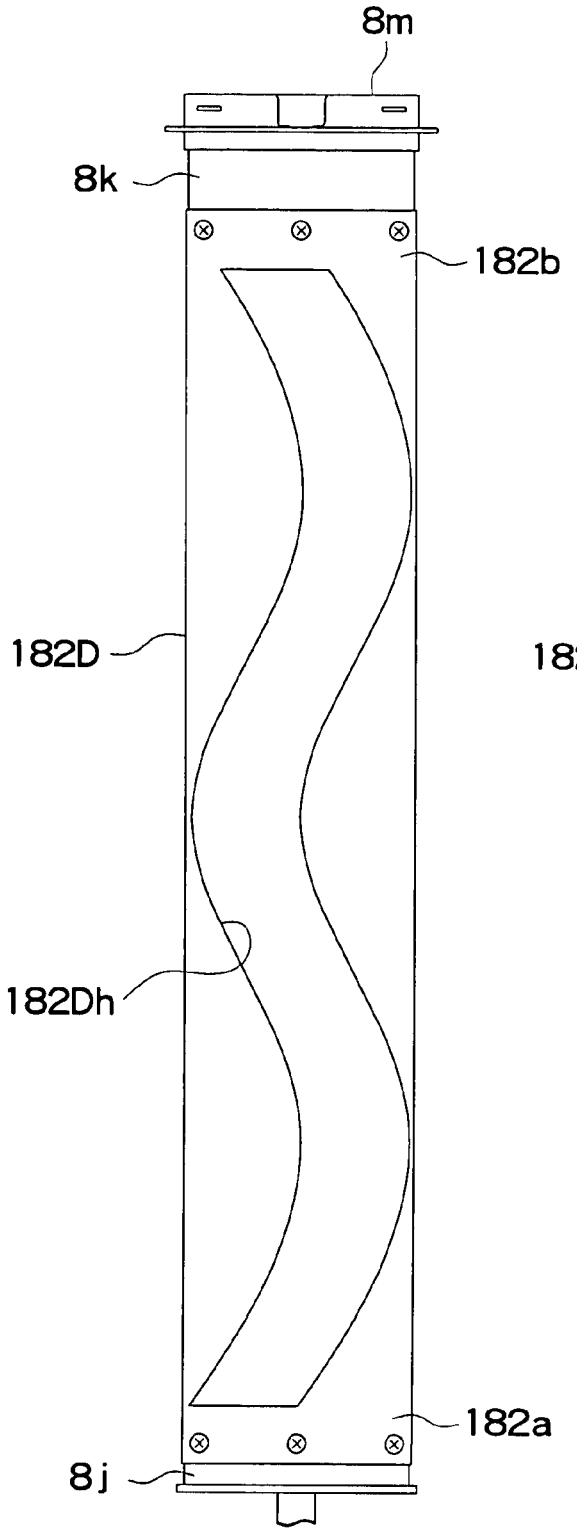
FIG. 40 is a plan view showing another cloth application frame of the tenth embodiment.
Figure 40B:
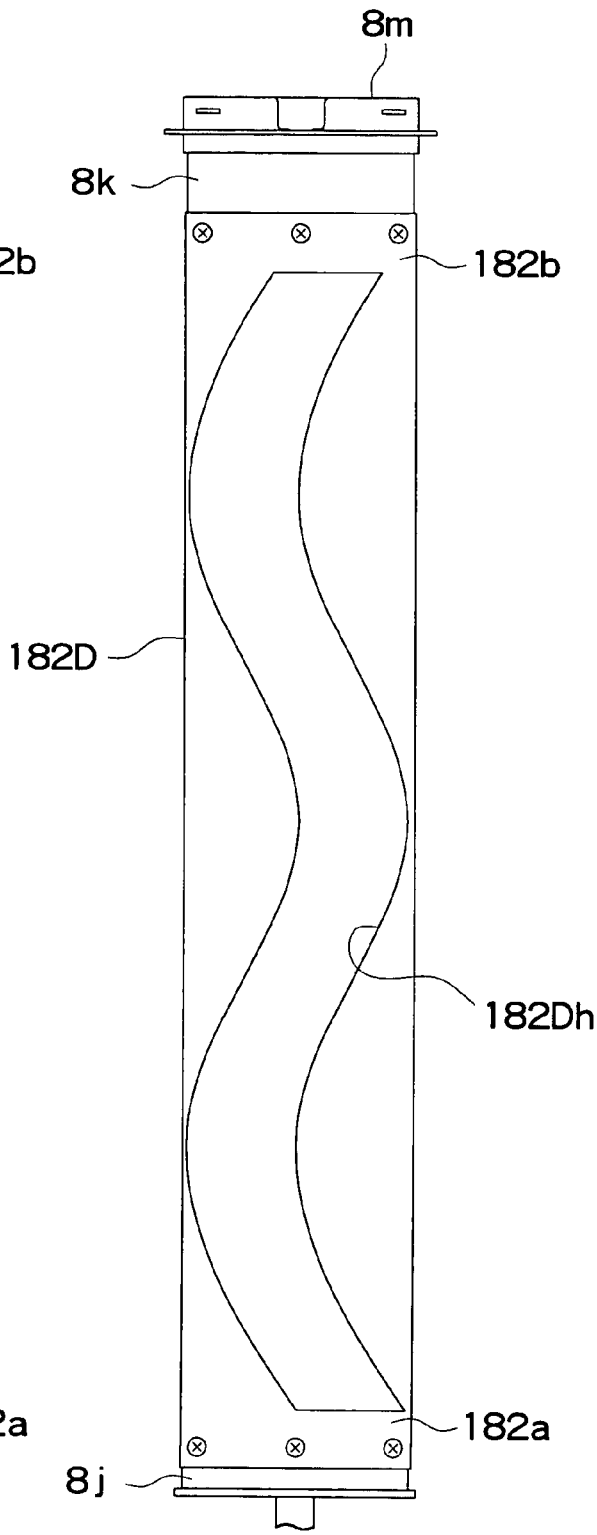

(2) As the cloth application frame 182 is replaceably attached to the base frame 8*m*, the configuration of the sewing window 182*h* may be selected in accordance with the embroidery pattern. This makes it possible to process the large embroidery pattern which is the widest and the longest using the cloth application frame 182A shown in FIG. 38, to process the bow-shaped embroidery pattern which is narrow in the width using the cloth application frames 182B and 182C as shown in FIGS. 39A and 39B, to process the wave-like embroidery pattern (as a large pattern formed of many small patterns) using the cloth application frame 182D shown in FIG. 40A, and to process the wave-like embroidery pattern formed of left and right reversal patterns by inverting the cloth application frame 182D in the longitudinal direction.

(3) As the size of the sewing window 182*h* may be selected in accordance with the embroidery pattern, the sewing window 182*h* with the appropriate opening area is covered with the sewing cloth W to prevent the deformation or slack of the sewing cloth W during sewing, thus improving the processing accuracy of the embroidery pattern.

(4) The embroidery pattern may be changed by exchanging the cloth application frame 182, which eliminates preparation of many kinds of the sewing frames. This makes it possible to manage the accessories of the embroidering sewing machine 1.

(5) As the cloth application frame 182 includes the opening 182*d*, only the cloth application frame 182 may be exchanged to be easily attached to the base frame 8*m* which is kept set in the sewing frame drive unit 10.

(6) The material for forming the cloth application frame 182 may be selected in accordance with the material and type of the sewing cloth W, for example, the cloth application frame 182 with its surface subjected to the non-skid process may be used for the slick sewing cloth, and the cloth application frame 182 which is relatively thick may be used for the heavy sewing cloth.

(7) The material may be selected in accordance with the load, for example, the thick steel plate may be used for forming the base frame 8*m* (see FIG. 37), or the thin steel plate or the resin plate may be used for forming the cloth application frame 182, thus ensuring rigidity of the entire sewing frame 8 while reducing the weight.

Eleventh Embodiment

Figure 41:
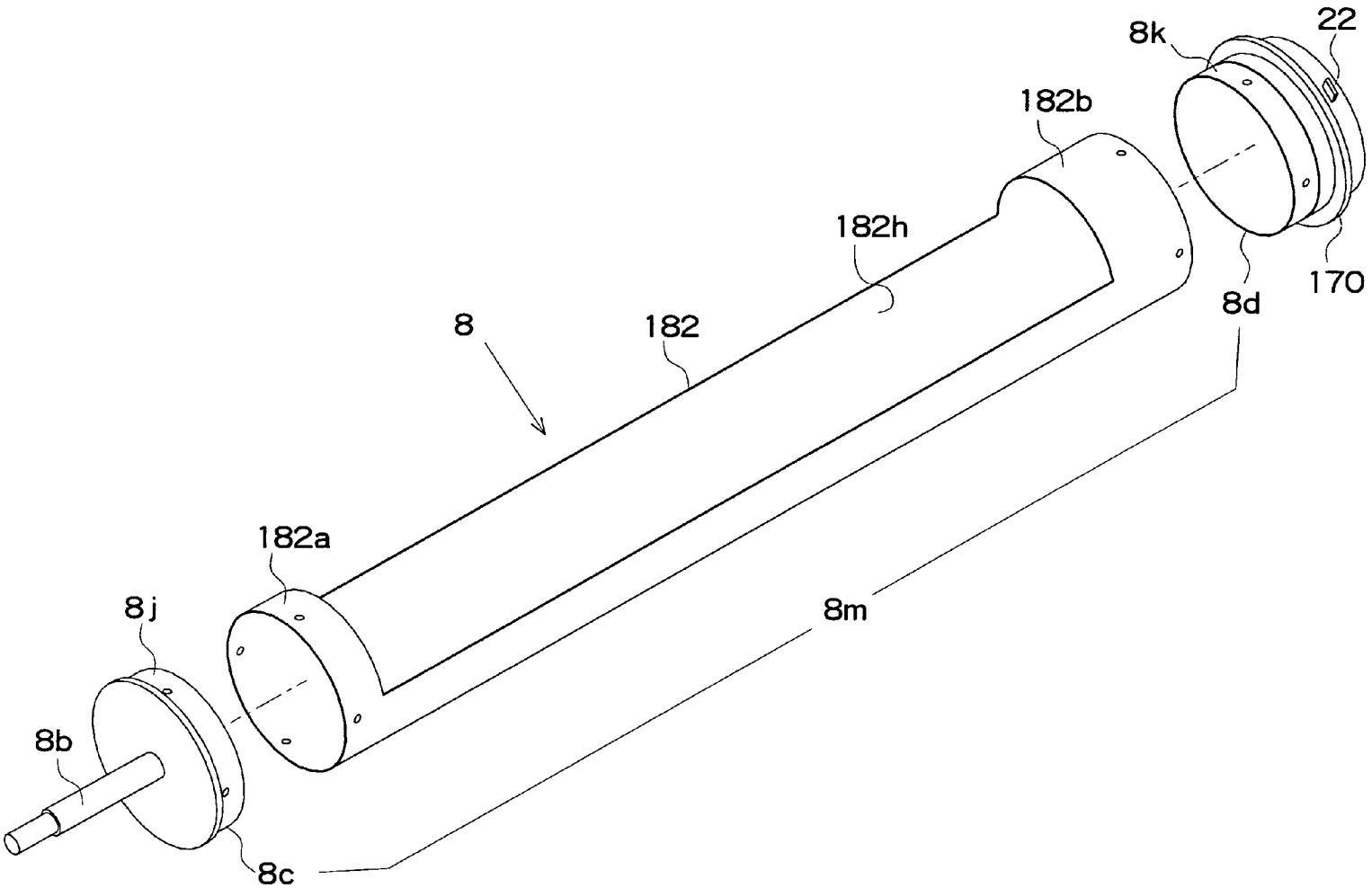
FIG. 41 is a perspective view showing a sewing frame according to an eleventh embodiment.

The eleventh embodiment shown in FIGS. 41 and 42 is different from the tenth embodiment in the structure of the base frame 8*m* of the sewing frame 8, and the shape of the cloth application frame 182. Referring to FIG. 41, the base frame 8*m* is formed of a front element 8*c* attached to the front portion (bracket as the support mechanism 17) of the sewing frame drive unit 10, and a rear element 8*d* attached to the rear portion (rotating drive mechanism 52*a*) of the sewing frame drive unit 10, which are separated. A front support portion 8*j* for supporting the front end 182*a* of the cloth application frame 182 is attached to the front element 8*c*, and a rear support portion 8*k* for supporting the rear end 182*b* of the cloth application frame 182 is attached to the rear element 8*d*.

Figures 42A, 42B:
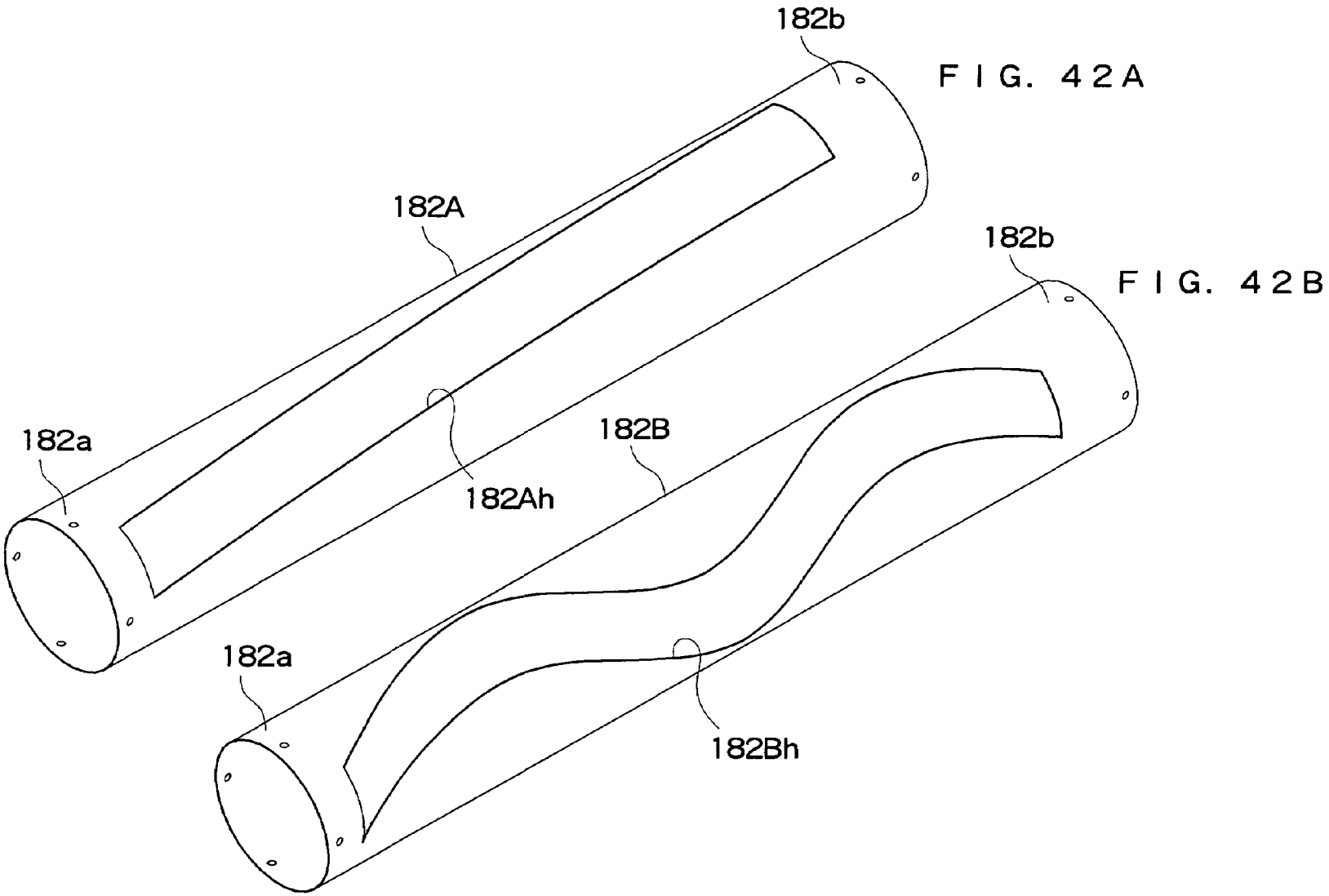
FIG. 42 is a perspective view showing a cloth application frame of the sewing frame according to the eleventh embodiment.

The cloth application frame 182 is formed into a cylindrical shape having entire circumference closed and has the sewing window 182*h* in the cylindrical surface with substantially the same diameter as that of the base frame 8*m* for defining the embroidery range to be processed on the sewing cloth W. The front end 182*a* of the cloth application frame 182 is inserted into the front support portion 8*j* of the base frame 8*m*, and the rear end 182*b* is inserted into the rear support portion 8*k*. Referring to FIGS. 42A and 42B, the respective cloth application frames 182A and 182B have differently shaped sewing windows 182Ah and 182Bh such that cloth application frames 182A and 182B are replaceably attached in the state where the front and rear ends 182*a* and 182*b* are set with the corresponding front and rear support portions 8*j* and 8*k*, respectively.

The use of the sewing frame 8 for the embroidery processing according to the eleventh embodiment provides the following effects.

(8) The cloth application frame 182 is formed into the cylinder with the entire circumference closed. This makes it possible to intensify the rigidity and to appropriately support the whole length of the heavy and long tubular sewing cloth on the horizontal plane.

(9) The sewing window 182*h* may be largely changed in the circumferential direction of the cloth application frame 182 to allow the processing of, for example, the spiral embroidery pattern.

Twelfth Embodiment

Figure 35:
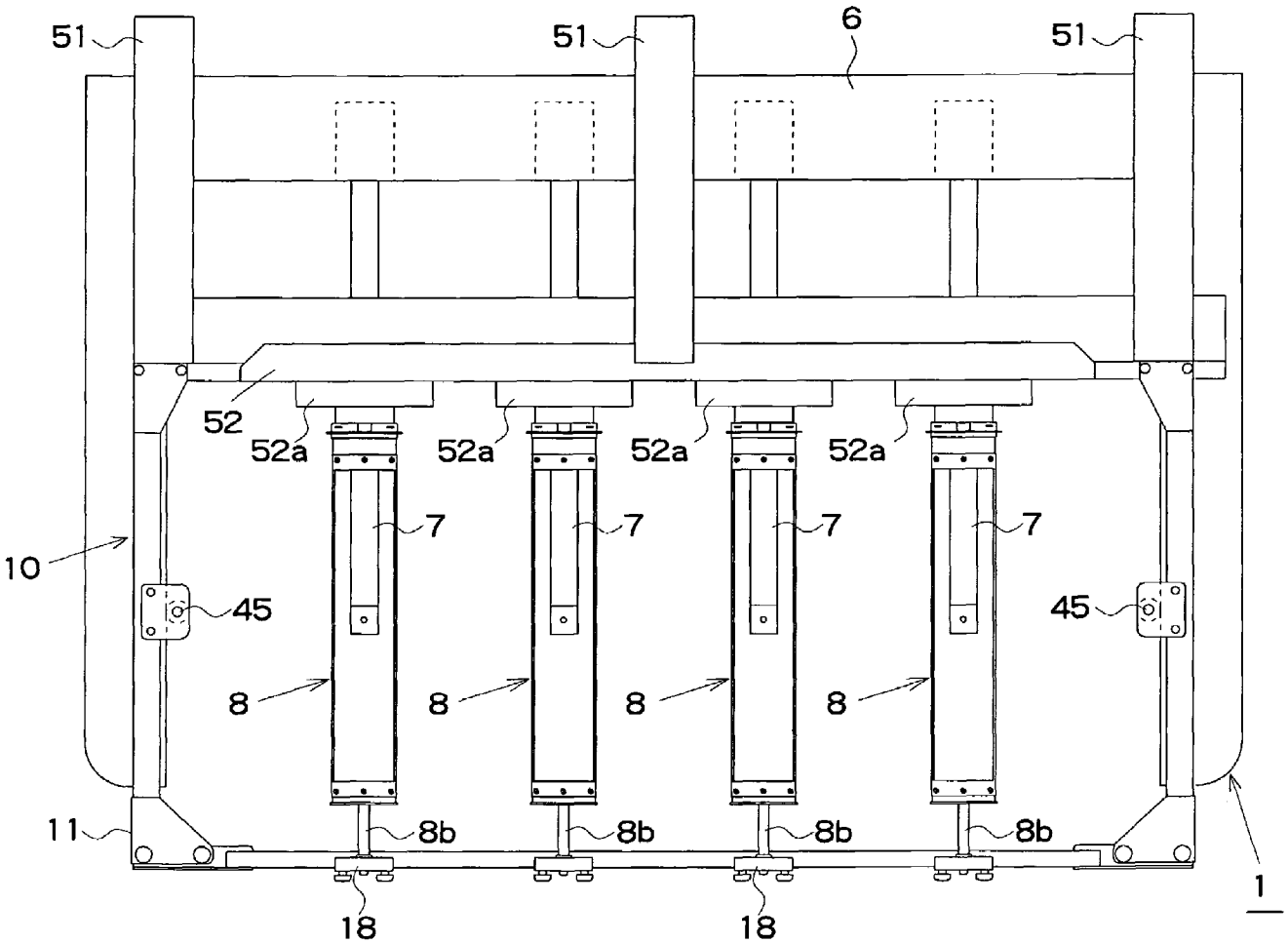
FIG. 35 is a plan view showing an embroidery sewing machine according to a tenth embodiment.
Figure 43:
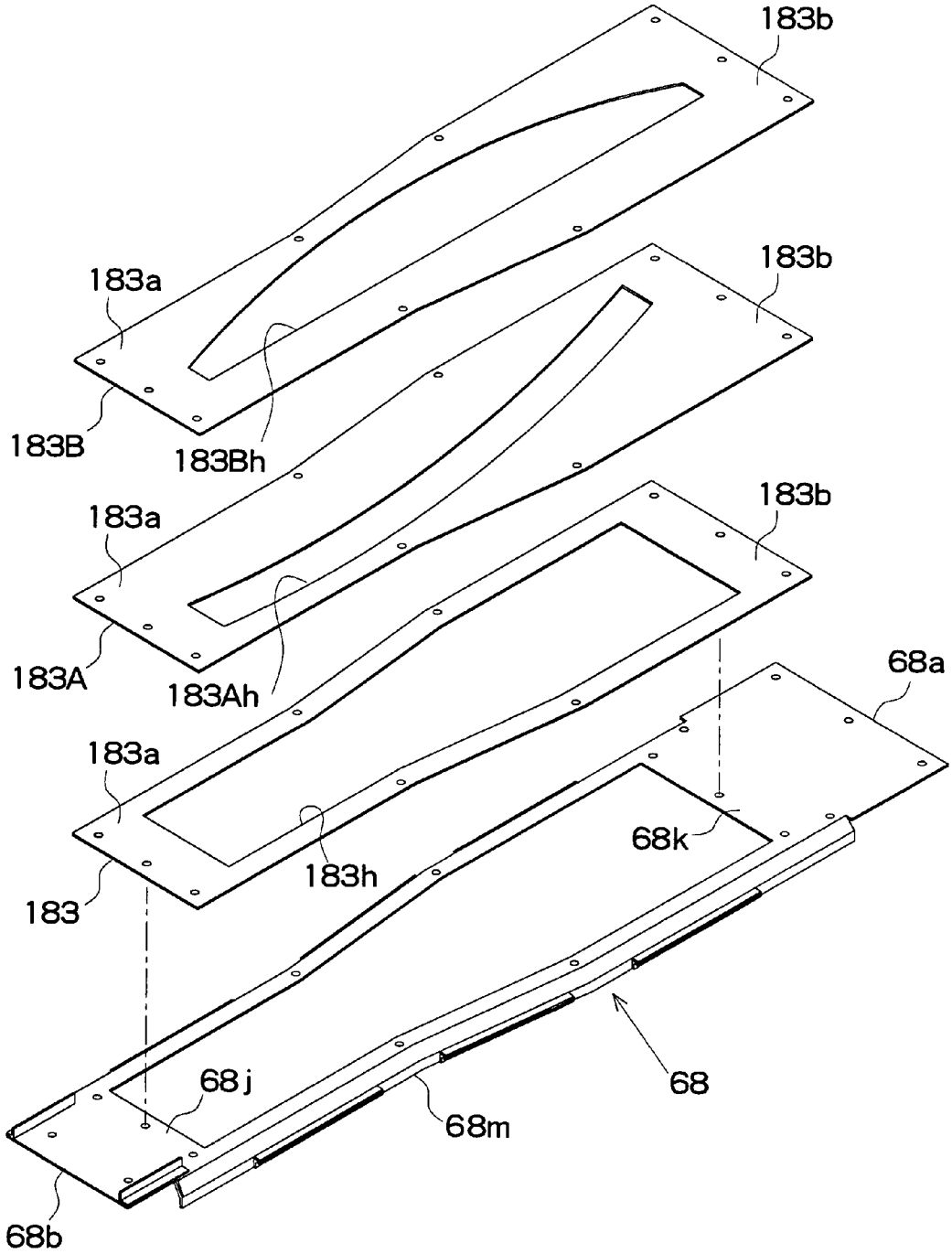
FIG. 43 is a perspective view showing a sewing frame of a twelfth embodiment.
Figure 44:
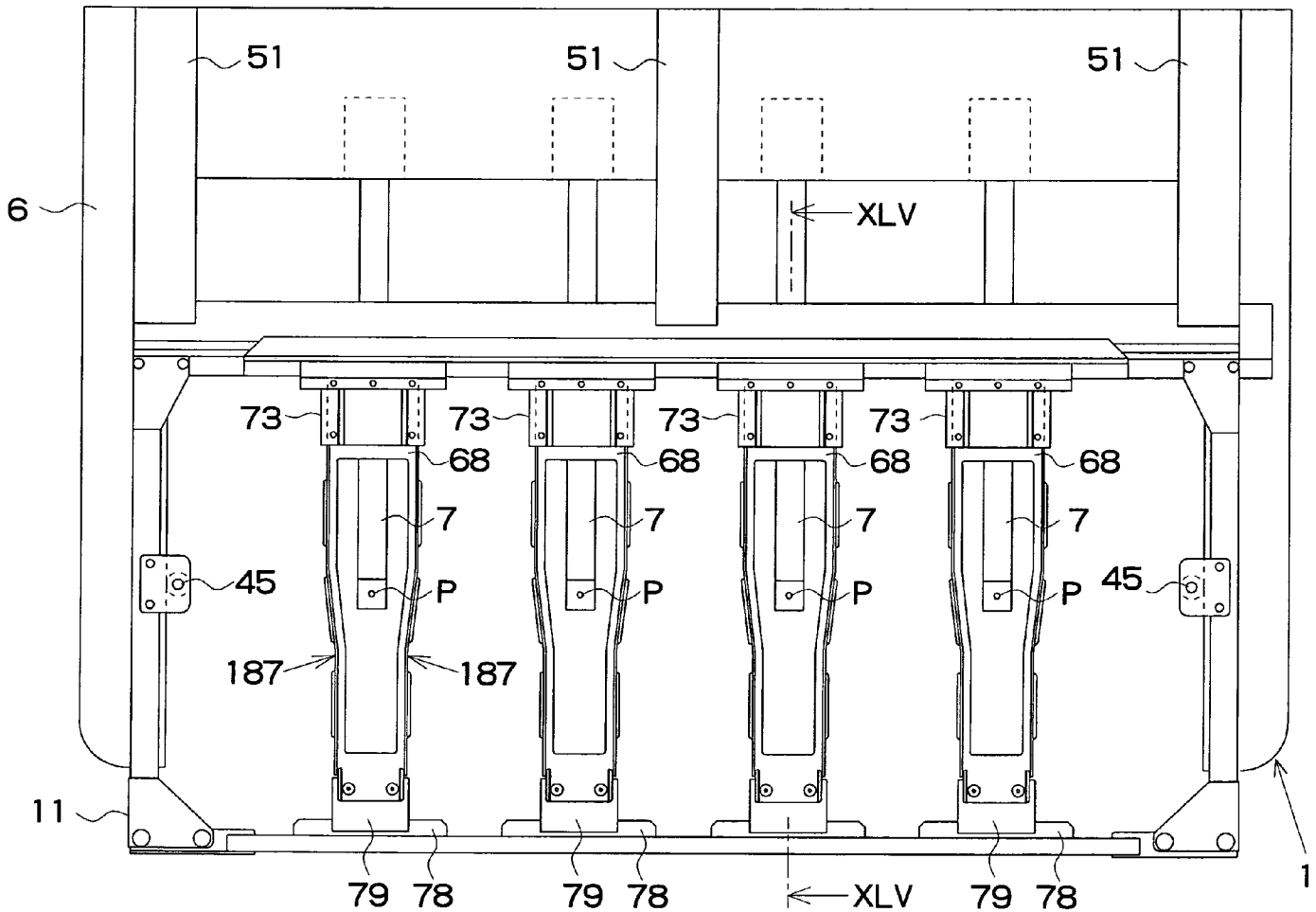
FIG. 44 is a plan view showing an embroidery sewing machine of a thirteenth embodiment.

In the twelfth embodiment shown in FIG. 43, the sewing frame 68 is formed of a flat base frame 68*m* attached to the sewing frame drive unit and a flat cloth application frame 183 to which the long tubular sewing cloth is applied. The base frame 68*m* is formed of a front end 68*b* attached to the front side of the frame drive unit, and a rear end 68*a* attached to the rear side of the frame drive unit. In the case where the sewing frame 68 is flat, the frame drive unit is equipped with the mechanism for linearly driving the base frame 68*m* to the lateral direction instead of the rotating drive mechanism 52*a* shown in FIG. 35. In the present embodiment, the base frame 68*m* is formed into a tapered shape in accordance with the boot-cut shape of jeans through the sheet metal processing.

The front end 68*b* is provided with a front support portion 68*j* for supporting the front end 183*a* of the cloth application frame 183. The rear end 68*a* is provided with a rear support portion 68*k* for supporting the rear end 183*b*. The cloth application frame 183 includes a sewing window 183*h* which extends between the front end 183*a* and the rear end 183*b* to define the embroidery range to be processed on the sewing cloth. A plurality of cloth application frames 183 (183A, 183B) each having the different shape are set by fitting the respective front and rear ends 183*a* and 183*b* with the corresponding front and rear support portions 68*j* and 68*k* of the base frame 68*m* so as to be replaceably attached to the base frame 68*m*. The use of the flat sewing frame 68 allows the accurate processing of the longitudinally long and laterally various patterns to be processed on the long tubular sewing cloth.

Thirteenth Embodiment

The thirteenth embodiment shown in FIGS. 44 to 49 is substantially the same as the second embodiment except the structure of the sewing frame 68 formed of the flat steel plate. The explanation of the second embodiment may be used for the similar structure of the thirteenth embodiment.

The sewing frame 68 is formed of a narrow front portion 68*e*, a wide rear portion 68*f*, and a tapered intermediate portion 68*g*. The front end of the front portion 68*e* is provided with a link portion 68*b* linked to the slide plate 79, and the rear end of the rear portion 68*f* is provided with a connector portion 68*a* connected to the rear end support member 73. The sewing window 69 is formed to be longitudinally long in the sewing frame 68 in the area excluding the link portion 68*b* and the connector portion 68*a*. The sewing window 69 is formed of a narrow portion 69*a* contained in the front portion 68*e* of the sewing frame 68, a wide portion 69*b* contained in the rear portion 68*f*, and a taper portion 69*c* contained in the intermediate portion 68*g*. The embroidery range to be processed on the long tubular sewing cloth W (see FIG. 49) is defined by the respective portions 69*a*, 69*b* and 69*c*.

Figure 45:
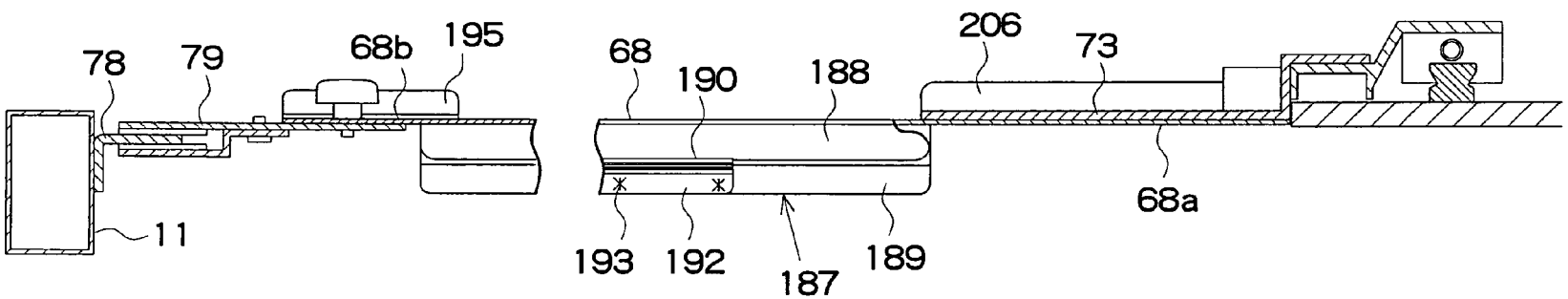
FIG. 45 is a sectional view taken along line XLV-XLV of FIG. 44.
Figure 48:
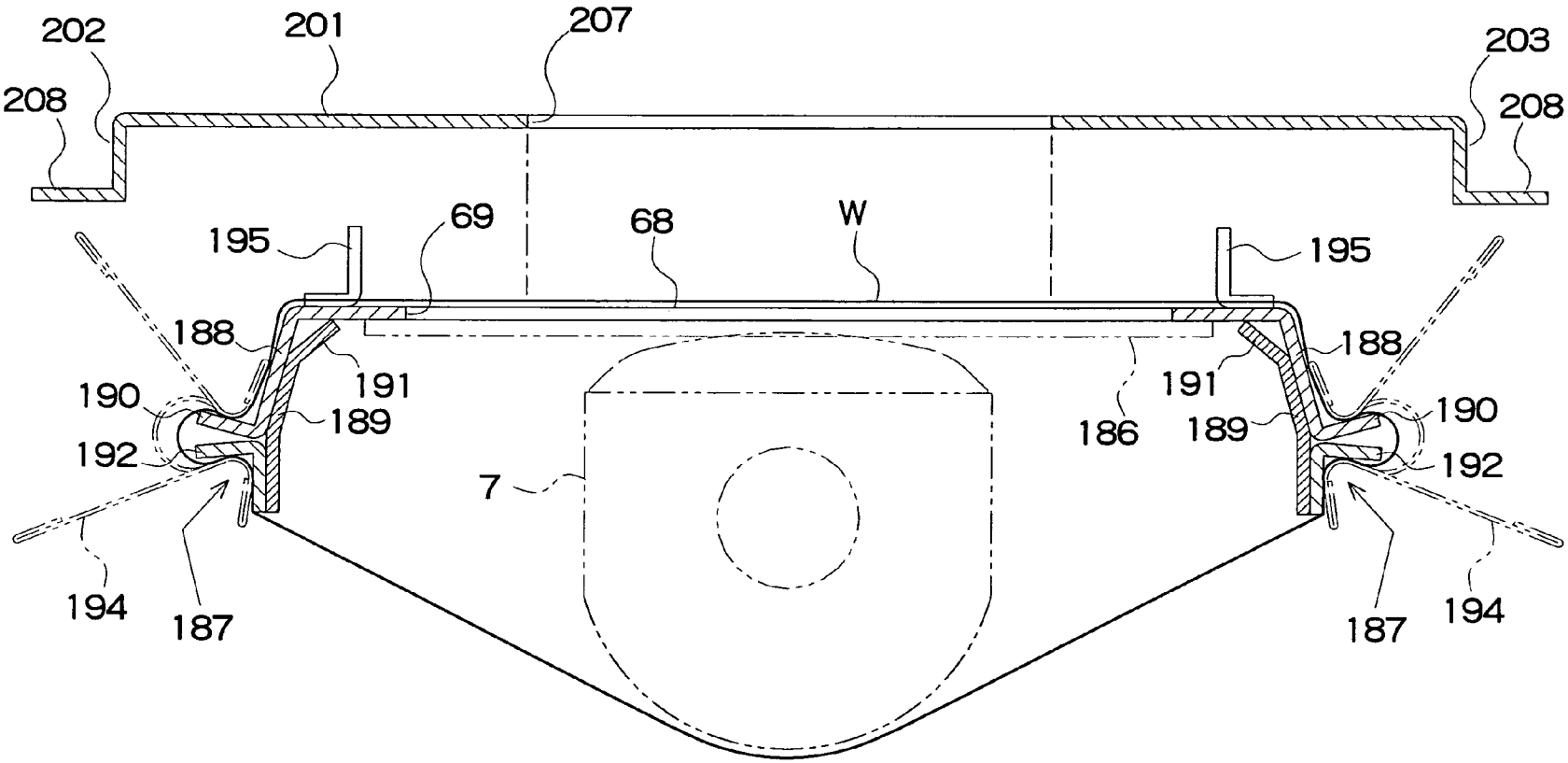
FIG. 48 is a sectional view taken along line XLVIII-XLVIII of FIG. 47.

Referring to FIG. 48, reinforcing ribs 187 are formed on the left and right side edges of the sewing frame 68 which extend along the longitudinal edges of the sewing window 69. The reinforcing rib 187 is a double structure including an outer rib 188 bent downward at the left and right side edges of the sewing frame 68 and an inner rib 189 welded to the inner surface of the outer rib 188. A plurality of upper cloth stoppers 190 are bent outward at the lower edge of the outer rib 188, and inclined portions 191 in abutment against the lower surface of the sewing frame 68 are provided at the upper end of the inner ribs 189. A plurality of lower cloth stopper 192 opposite the upper cloth stoppers 190 are welded to the outer surface of the lower portion of the inner rib 189 (the reference numeral 193 shown in FIG. 45 represents welding). The sewing cloth W is fixed between the upper and the lower cloth stoppers 190 and 192 with the clip 194. A pair of left and right vertical ribs 195 are welded onto the upper surface of the front end link portion 68*b* of the sewing frame 68. The soft material 186 may be attached to the lower surface of the sewing frame 68 for preventing the metal contact with the cylinder bed 7.

Figure 46:
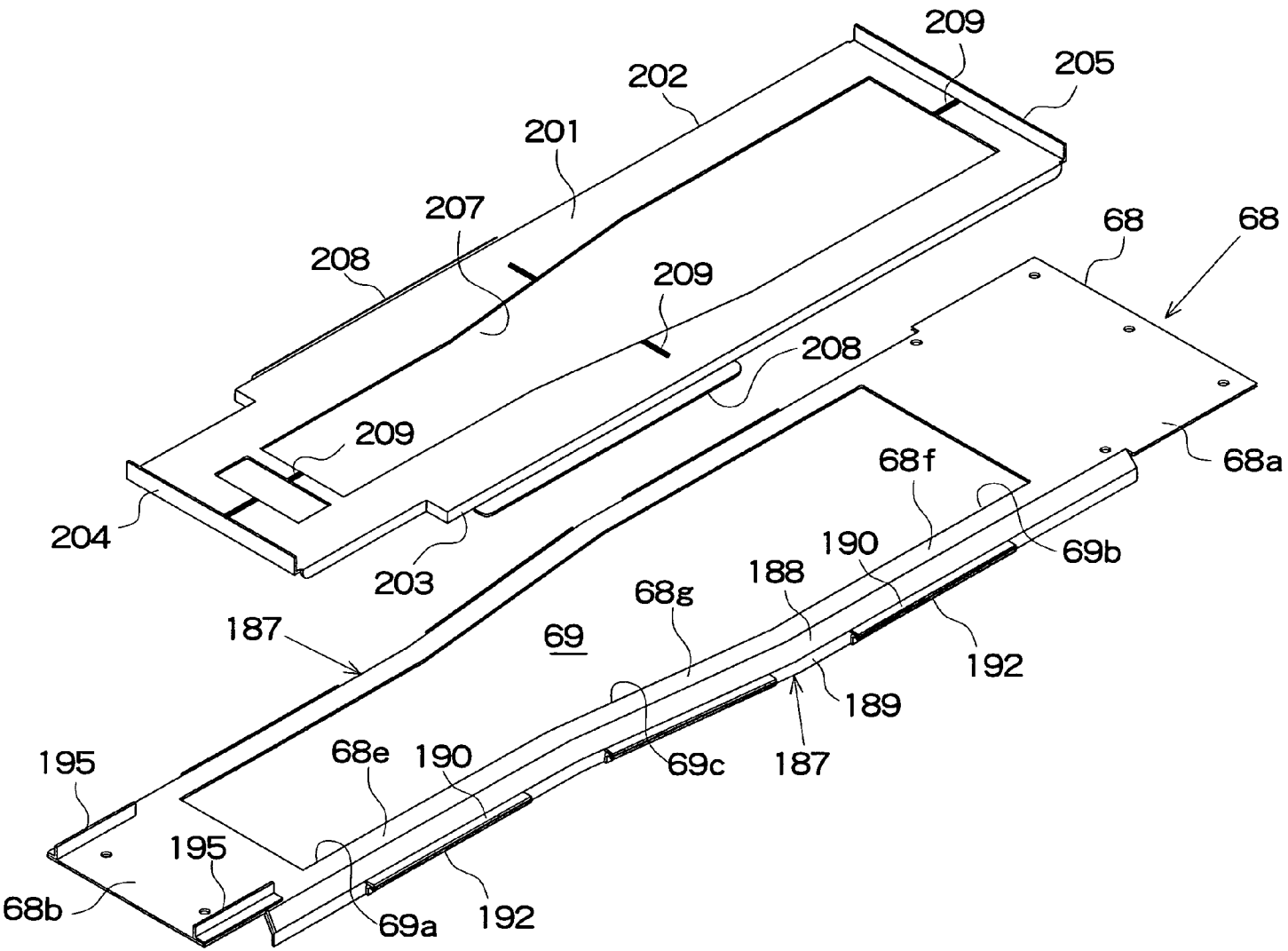
FIG. 46 is a perspective view showing a sewing frame of the thirteenth embodiment.
Figure 47:
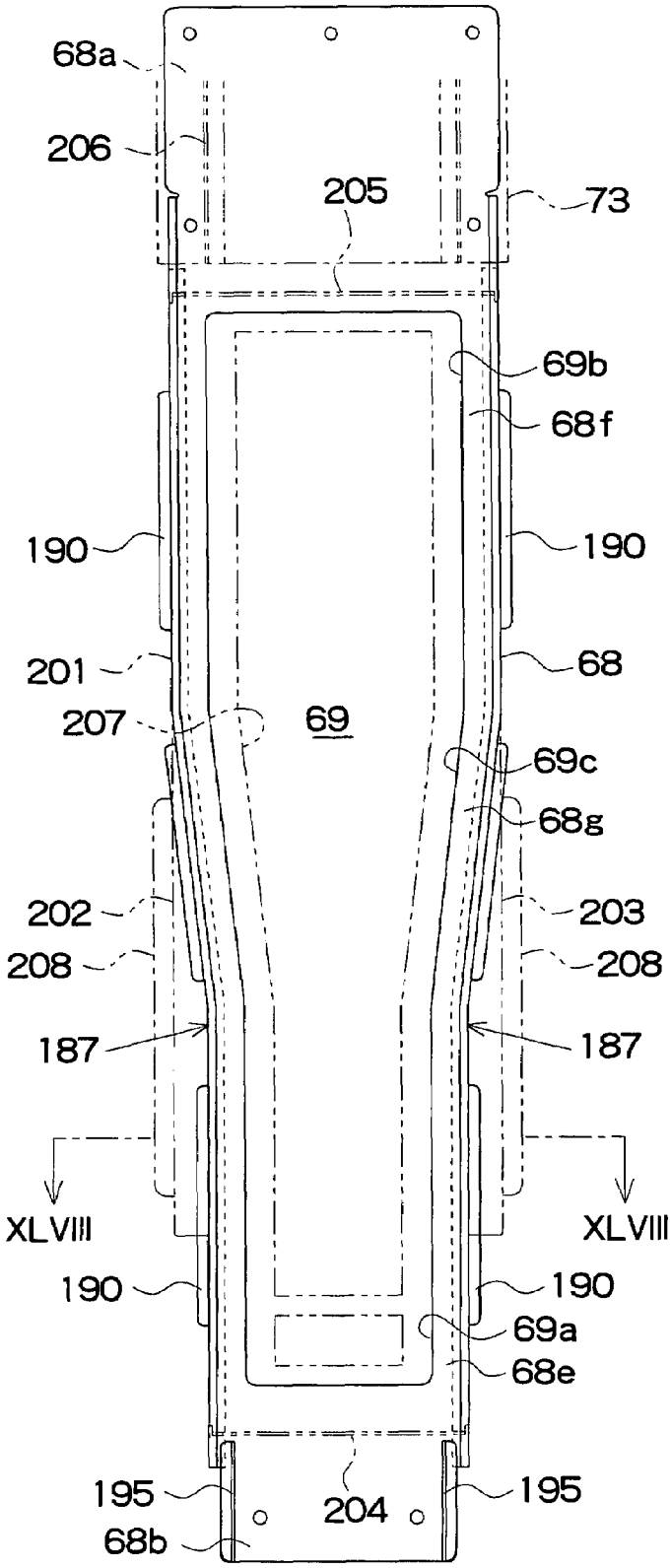
FIG. 47 is a plan view showing the sewing frame of the thirteenth embodiment.

Referring to FIGS. 46 to 48, the sewing frame 68 is detachably covered with a positioning jig 201 for positioning the sewing cloth W to the needle drop hole P (sewing position) at the front end of the cylinder bed 7. The positioning jig 201 is formed of a flat steel plate or a plastic plate as substantially a rectangular shape, and includes a pair of left and right width defining portions 202, 203 for positioning the positioning jig 201 with respect to the width direction of the sewing frame 68, and a pair of front and rear longitudinal defining portions 204, 205 for positioning the positioning jig 201 with respect to the longitudinal direction of the sewing frame 68. The width defining portions 202 and 203 are bent downward to face the outer rib 188 of the sewing frame 68 from outside. The longitudinal defining portion 204 at the front end is bent upward to face the longitudinal rib 195 of the sewing frame 68 from the rear side. The longitudinal defining portion 205 at the rear end is bent upward to face the reinforcing fitting 206 on the rear end support member 73 from the front side. The positioning jig 201 includes an opening 207 for allowing the operator to identify the position of the sewing window 69 from above the sewing cloth W to be long in the longitudinal direction and similar in the shape to the sewing window 69 with smaller size. Handles 208 are externally bent at the respective width defining portions 202 and 203, and a mark 209 for positioning is formed around the opening 207.

Figure 49A:
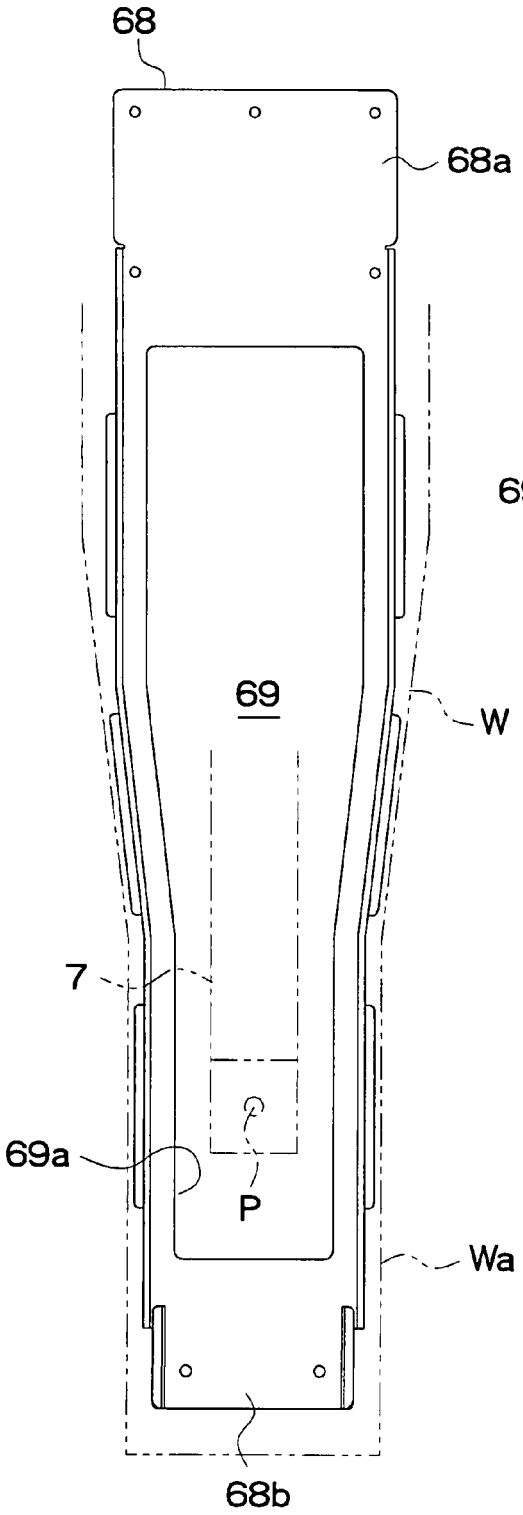
FIG. 49 is a plan view showing the procedure of applying a long tubular sewing cloth to a sewing frame of the thirteenth embodiment.
Figure 49B:
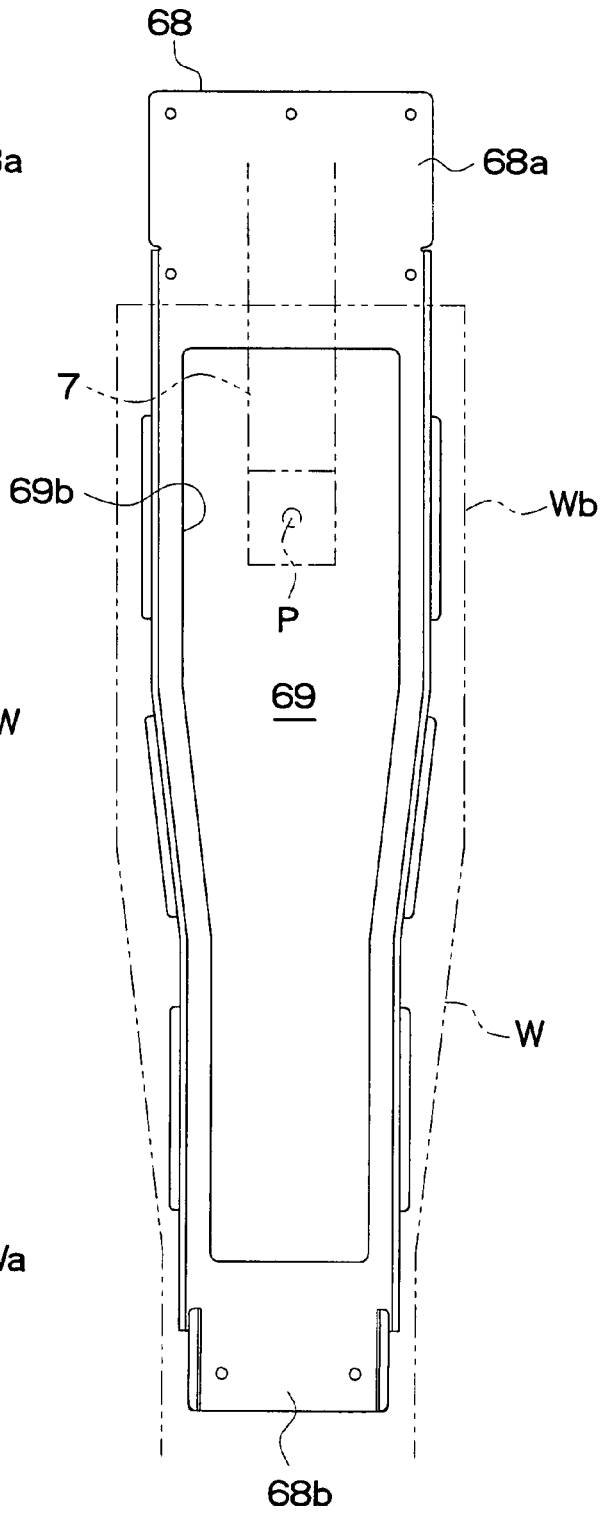
Figure 50:
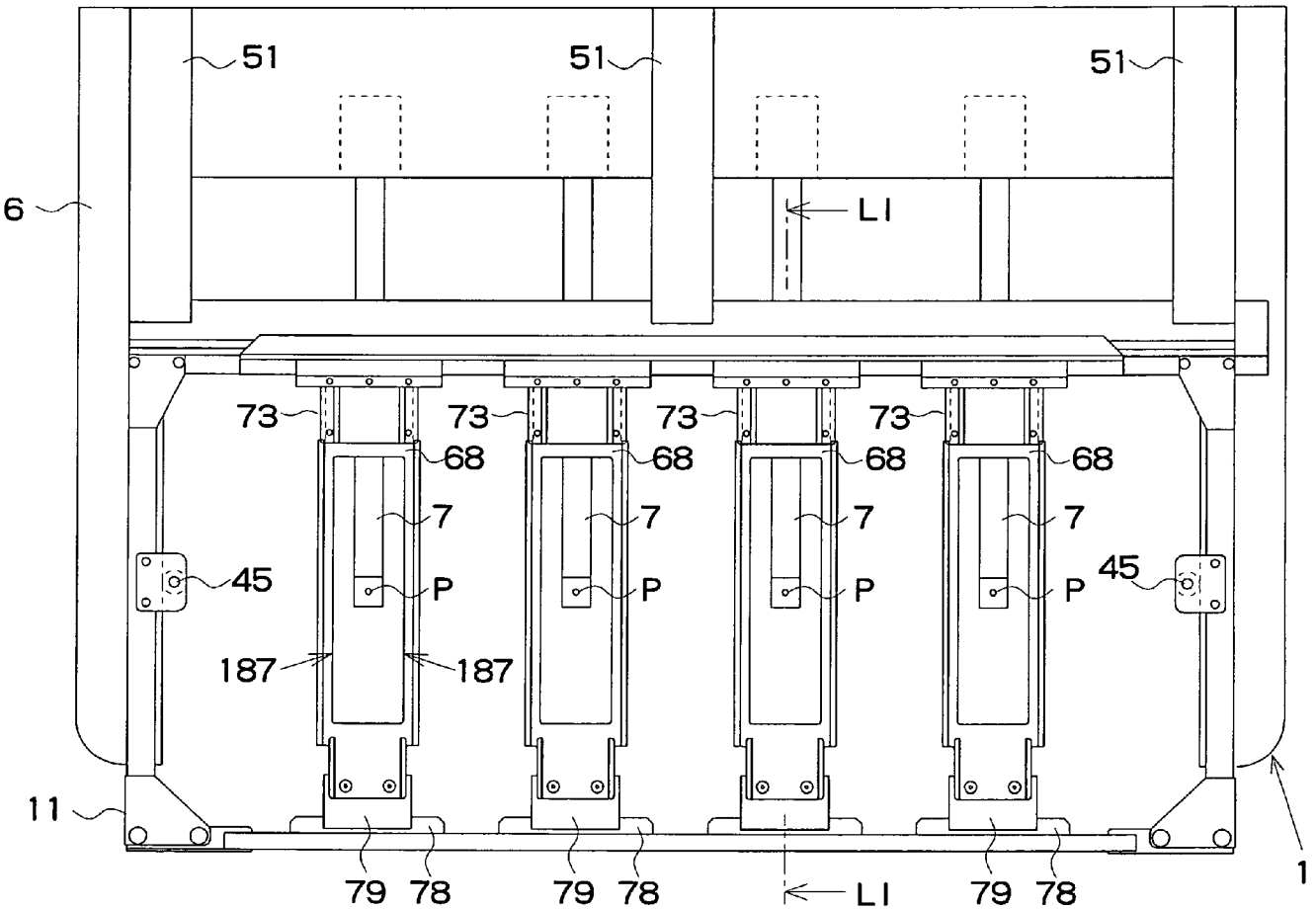
FIG. 50 is a plan view showing an embroidery sewing machine to which the sewing frame according to a fourteenth embodiment is attached.
Figure 51:
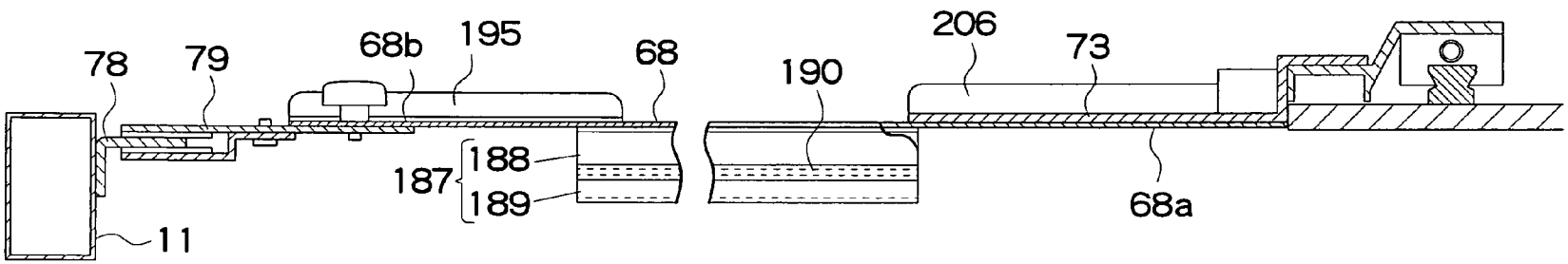
FIG. 51 is a sectional view taken along line LI-LI of FIG. 50.

In the case where the sewing frame 68 is used for processing the embroidery pattern on the long tubular cloth W like jeans, the positioning jig 201 is removed from the sewing frame 68 as shown in FIG. 49A. The sewing window 69 is covered with a thick interliner (not shown) and then the sewing frame 68 is covered with the sewing cloth W inserted thereinto from the front end so as to be overlapped with the interliner. The sewing frame 68 covered with the sewing cloth W is further covered with the positioning jig 201 (see FIG. 47) so as to be positioned in the longitudinal and lateral directions with the width defining portions 202, 203 and the longitudinal defining portions 204 and 205. The sewing start point on the sewing cloth W is positioned to the needle drop hole P. Although the needle drop hole P is obscured by the sewing cloth W, the operator is allowed to position the sewing start point to the needle drop hole P easily based on the contour of the opening 207 of the jig 201 and the mark 209. FIG. 49A shows the state where the narrow width portion (bottom of the boot-cut jeans) Wa of the sewing cloth W is positioned to the narrow width portion 69*a* of the sewing window 69.

Referring to FIG. 48, the sewing cloth W is spread over the sewing window 69 such that the left and right side portions of the sewing cloth W are fixed to the upper and lower cloth stoppers 190, 192 of the reinforcing ribs 187 using the clips 194. Then the positioning jig 201 is removed from the sewing frame 68, and the rear end connector 68*a* of the sewing frame 68 is connected to the rear end support member 73 of the sewing frame drive unit with the screw (not shown). The front end link portion 68*b* of the sewing frame 68 is supported at the front end support portion 78 of the support frame 11 via the front end support member (slide plate) 79 (see FIG. 44). Then the embroidery sewing machine 1 is activated to drive the sewing frame 68 in the lateral and longitudinal directions to process the relatively small embroidery pattern on the narrow width portion Wa of the sewing cloth W. As the sewing frame 68 is reinforced with the reinforcing ribs 187 as the double structure including the outer and inner ribs, the sewing frame 68 is not deformed by its own weight nor the impact resulting from drop of the needle. This makes it possible to process the embroidery pattern with high accuracy while holding the long tubular sewing cloth W on the horizontal plane with the sewing frame 68.

Meanwhile, in the case where the embroidery pattern is processed on the wide portion (around hip portion of jeans) Wb of the long tubular sewing cloth W, the wide portion 69*b* of the sewing window 69 is covered with the wide portion Wb, and the left and right sides of the sewing cloth W are fixed with cloth stoppers 190, 192 with the clips 194 by positioning the sewing start point to the needle drop hole P. Thereafter, the embroidery sewing machine 1 is activated to form the relatively large embroidery pattern on the wide portion Wb. The frame replacement may be eliminated upon processing of the irregularly shaped cloth such as the boot-cut jeans. This makes it possible to efficiently process the embroidery patterns of different sizes on the narrow portion Wa and the wide portion Wb of the sewing cloth W, using only a single kind of the sewing frame 68. The entire length of the sewing window 69 may be effectively used to easily process the longitudinally long embroidery pattern without applying the sewing cloth W to the sewing frame 68 again.

The thirteenth embodiment may be modified to have the following structures.

(1) The sewing frame 68 may be used for processing the embroidery on the relatively short tubular sewing cloth, for example, T-shirt, pillow cover and the like.

(2) The sewing frame 68 may be used for processing the embroidery on the flat material, for example, bath towel, muffler and the like.

(3) In the case where the sewing cloth is too narrow in width to be fixed with the clips 194, it may be applied to the sewing frame 68 with the two-sided stick tape at several points around the sewing window 69.

(4) The sewing frame 68 is formed into a rectangular shape that is constant in width and is long in the longitudinal direction.

(5) The narrow portion 69*a* of the sewing window 69 is formed at the rear portion of the sewing frame 68, and the wide portion 69*b* of the sewing window 69 is formed at the front portion of the sewing frame 68.

Fourteenth Embodiment

In the fourteenth embodiment shown in FIGS. 50 to 54, the periphery of the embroidery range processed on the tubular sewing cloth is fixed on the upper surface of the flat sewing frame.

The longitudinal length and the lateral length of the sewing frame 68 formed of the flat steel plate range from 60 to 100 cm, and 12 to 25 cm, respectively, for example. The front end of the sewing frame 68 is provided with the link portion 68*b* for linking the front end support member (slide plate) 79, and the rear end is provided with the connector 68*a* connected to the rear end support member 73. The sewing frame 68 includes the sewing window 69 to be long in the longitudinal direction on the area excluding the link portion 68*b* and the connector 68*a*. The sewing window 69 defines the range of embroidery processed on the long tubular sewing cloth W (see FIG. 54).

Figure 54:
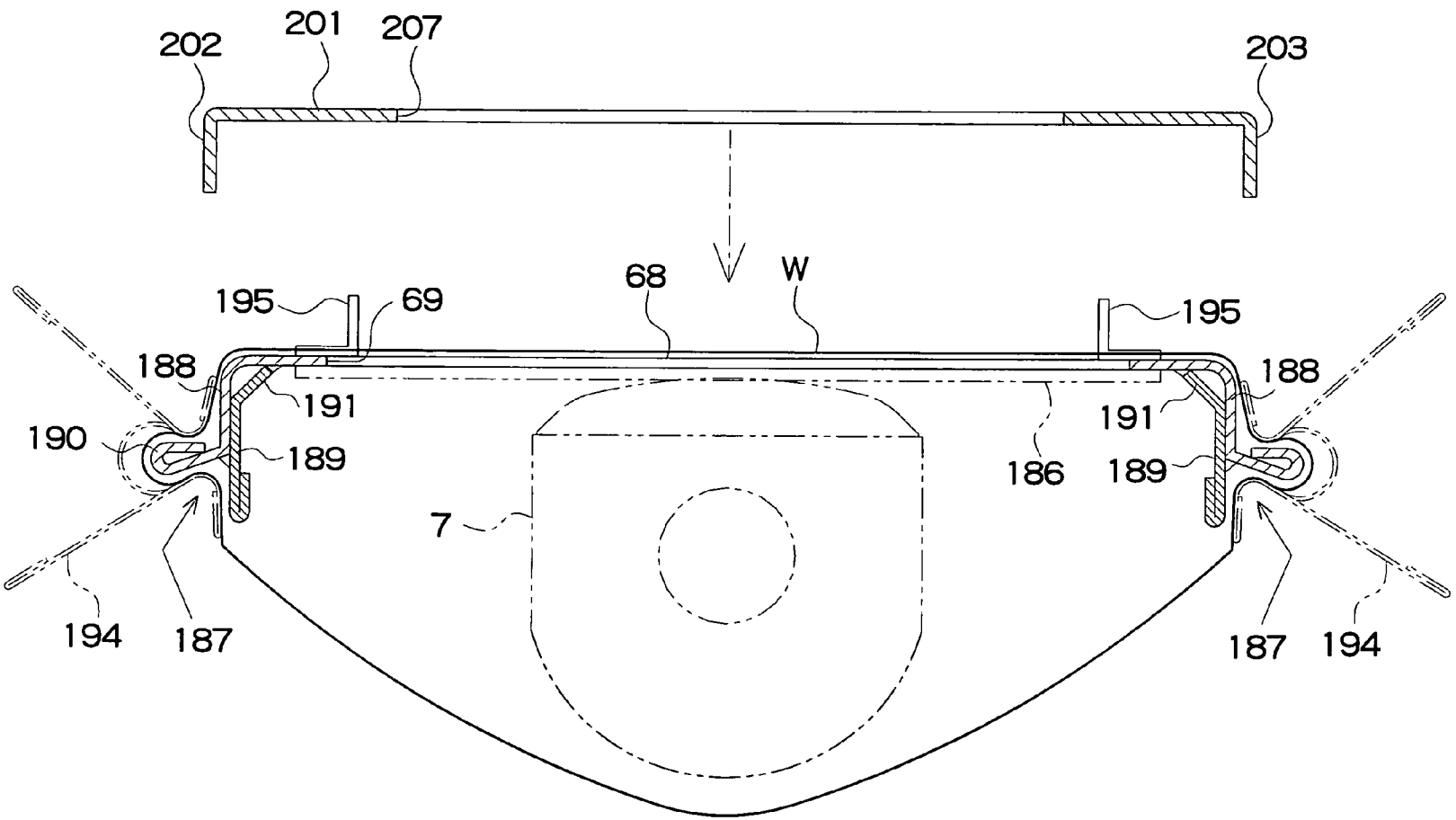
FIG. 54 is a sectional view taken along line LIV-LIV of FIG. 53.

Referring to FIG. 54, reinforcing ribs 187 are formed on the left and right side edges of the sewing frame 68 extending along the longitudinal edges of the sewing window 69. Each of the reinforcing ribs 187 has a double structure formed of an outer rib 188 bent downward at the left and right side edges of the sewing frame 68, and an inner rib 189 welded to the inner surface of the outer rib 188. A plurality of cloth stoppers 190 are externally bent at the lower edge of the outer rib 188. An inclined portion 191 which abuts against the lower surface of the sewing frame 68 is formed on the upper end of the inner rib 189. The sewing cloth W is fixed by the cloth stopper 190 with a spring type clip 194. A pair of left and right vertical ribs 195 are welded to the upper surface of the front end link portion 68*b* of the sewing frame 68. A soft member 186 may be applied to the lower surface of the sewing frame 68 for preventing the metal contact with the cylinder bed 7.

Figure 52:
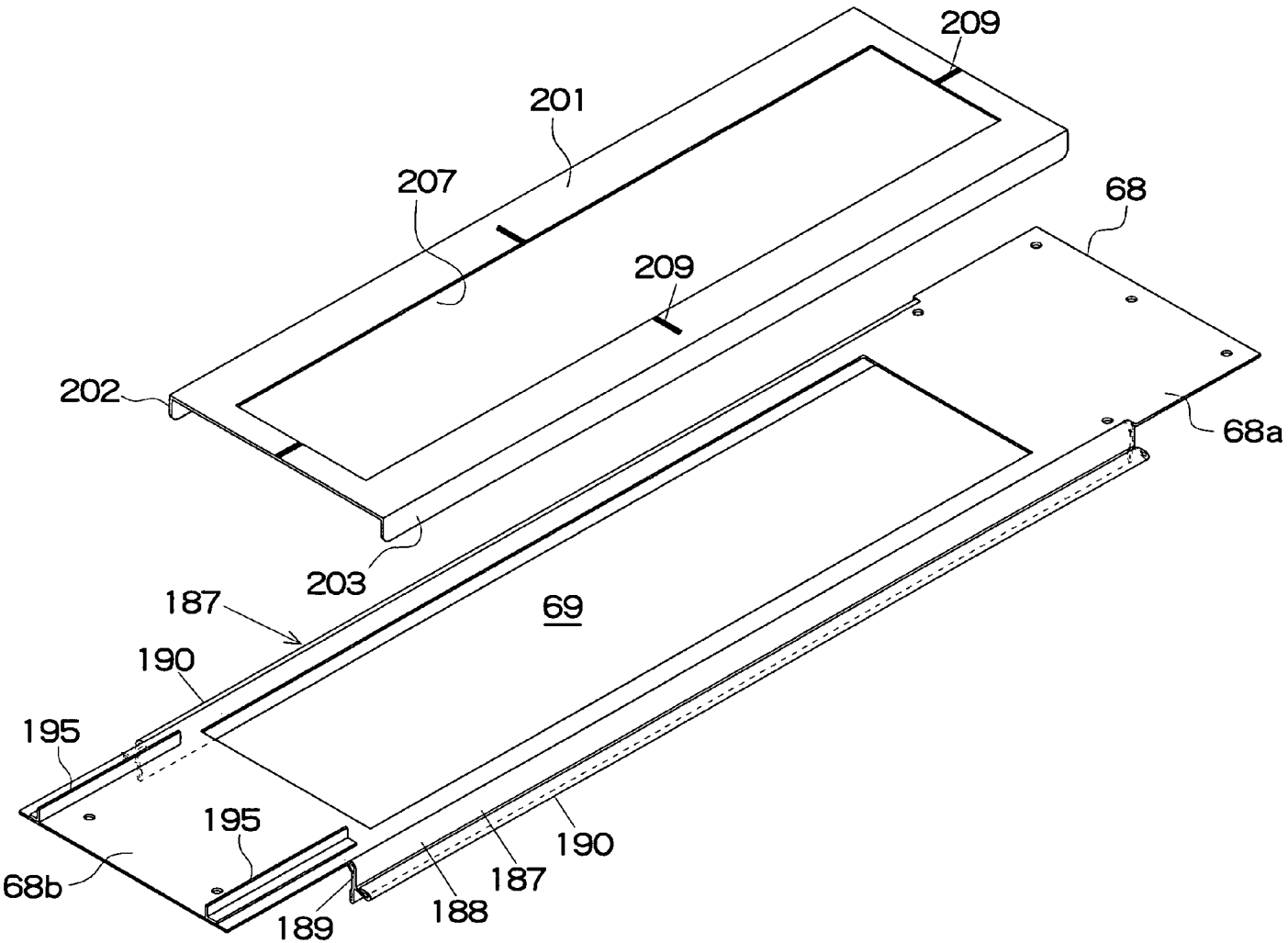
FIG. 52 is a perspective view showing the sewing frame of the fourteenth embodiment.
Figure 53:
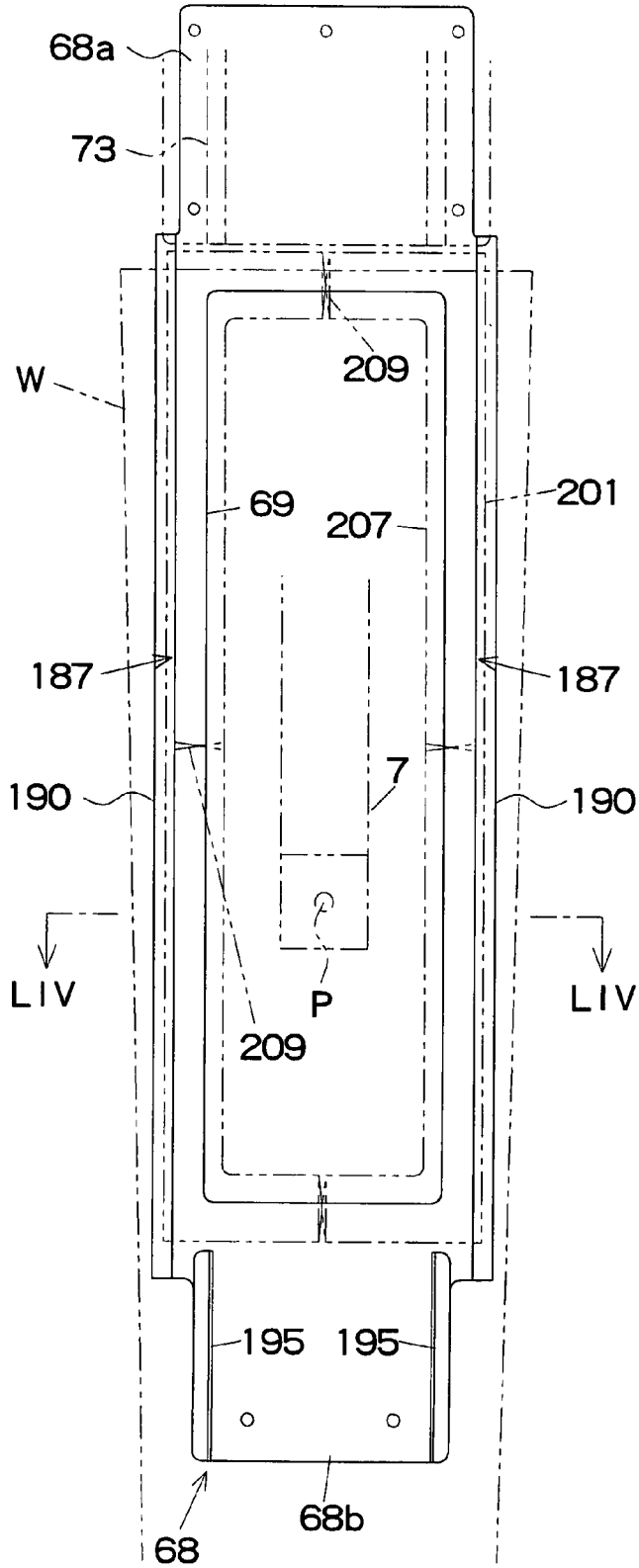
FIG. 53 is a plan view showing the sewing frame of the fourteenth embodiment.

Referring to FIGS. 52 to 54, the sewing frame 68 is detachably covered with the positioning jig 201 for positioning the sewing cloth W to the needle drop hole P (sewing position) of the front end of the cylinder bed 7. The jig 201 is formed of a flat steel plate or a plastic plate as substantially a rectangular shape, and includes a pair of left and right width defining portions 202, 203 for positioning the jig 201 with respect to the width direction of the sewing frame 68. The width defining portions 202 and 203 are bent downward to face the outer ribs 187 of the sewing frame 68 from outside. The jig 201 includes an opening 207 for allowing the operator to identify the position of the sewing window 69 from above the sewing cloth W to be long in the longitudinal direction and similar in the shape to the sewing window 69 with smaller size. A mark 209 for positioning is formed around the opening 207.

In the case where the above-structured sewing frame 68 is used for processing the embroidery pattern on the long tubular sewing cloth W as the trousers (jeans, for example), the positioning jig 201 is removed from the sewing frame 68 (the sewing window 69 may be covered with the thick interliner (not shown) if needed), and then the tubular sewing cloth W is placed on the sewing frame 68 from the front end so as to cover the sewing window 69. The sewing frame 68 covered with the sewing cloth W is further covered with the positioning jig 201 (see FIG. 53) so as to be positioned to the reinforcing ribs 187 with the width defining portions 202, 203 such that the sewing start point of the sewing cloth W is positioned to the needle drop hole P. Although the needle drop hole P is obscured by the sewing cloth W, the operator is allowed to position the sewing start point to the needle drop hole P easily based on the contour of the opening 207 of the jig 201 and the mark 209.

Referring to FIG. 54, the embroidery range of the tubular sewing cloth W is spread flat over the sewing window 69 such that the periphery (left and right side portions in the present embodiment) of the embroidery range of the tubular sewing cloth W is fixed to the cloth stoppers 190 of the reinforcing ribs 187 with the clips 194. Thereafter, the positioning jig 201 is removed from the sewing frame 68, and the rear end connector 68*a* of the sewing frame 68 is connected to the rear end support member 73 of the X drive frame 10 with the screw (not shown). The front end link portion 68*b* of the sewing frame 68 is supported at the front end support portion 78 of the support frame 11 via the front end support member (slide plate) 79 (see FIG. 50). Then the embroidery sewing machine 1 is activated to drive the sewing frame 68 in the lateral and longitudinal directions to process the embroidery pattern on the embroidery range of the tubular sewing cloth W. As the sewing frame 68 is reinforced with the reinforcing ribs 187 with the double structure including the outer and inner ribs, the sewing frame 68 is not deformed by its own weight nor the impact resulting from drop of the needle. This makes it possible to process the embroidery pattern with high accuracy while holding the long tubular sewing cloth W on the horizontal plane with the sewing frame 68.

FIRST MODIFIED EXAMPLE

Figure 55A:
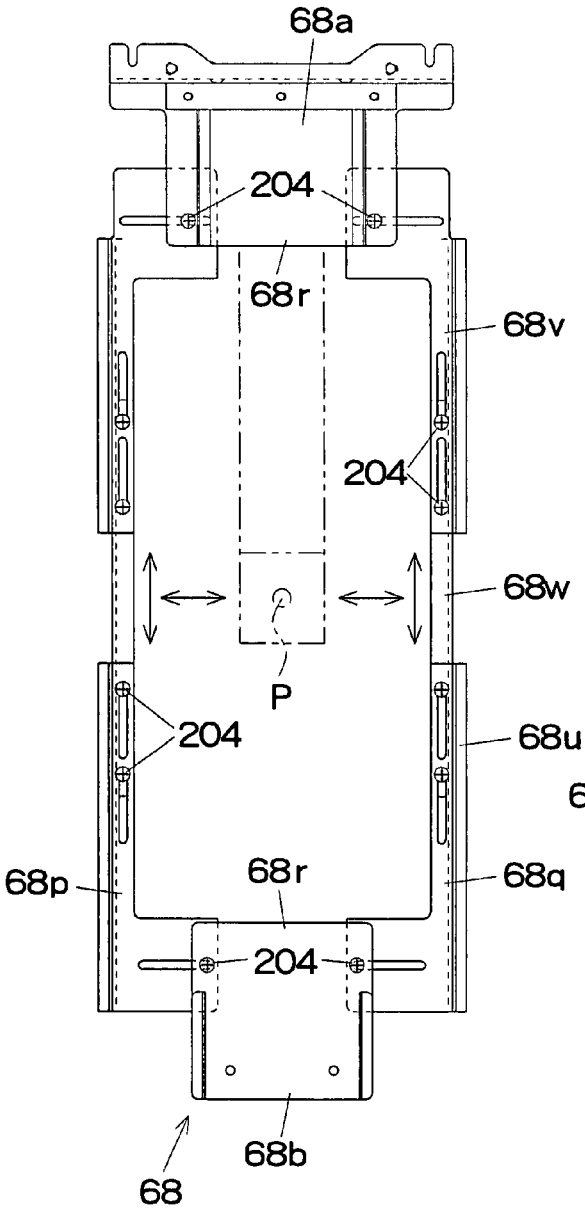
FIG. 55 is a plan view showing a first modified example of the fourteenth embodiment.
Figure 55B:
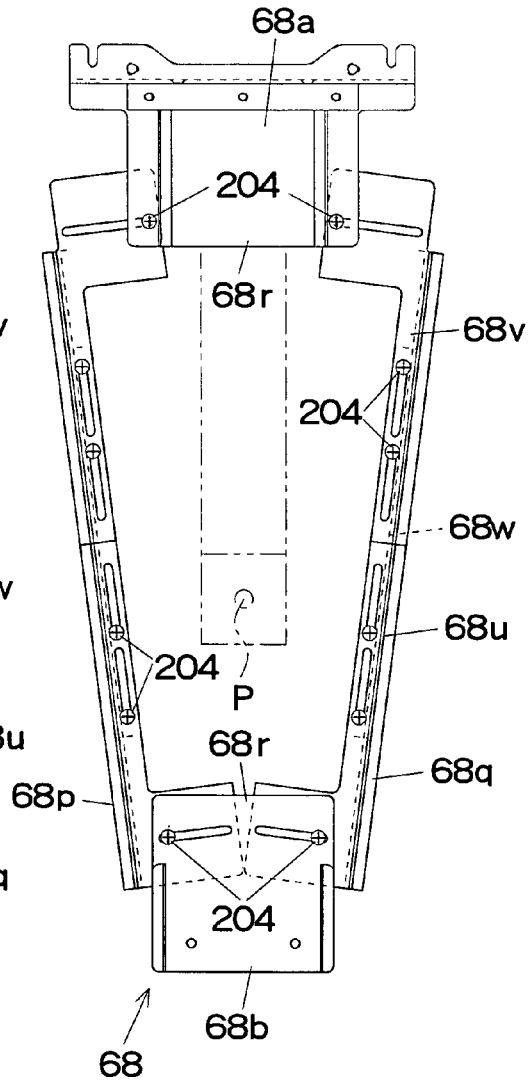

In the first modified example according to the fourteenth embodiment shown in FIG. 55, the sewing frame 68 is divided into three parts in the lateral direction, that is, a pair of end portions 68*p*, 68*q*, and a link portion 68*r* between the end portions 68*p* and 68*q*. The pair of end portions 68*p*, 68*q* are linked to the link portion 68*r* with the screw 204 such that the respective positions are adjustable to allow the sewing window 69 to be retractable in the lateral direction while keeping the rectangular shape as shown in FIG. 55A, or the sewing window 69 to be retractable while changing its shape between the rectangle and trapezoid as shown in FIG. 55B. In the example, the sewing frame 68 is divided into three parts in the longitudinal direction, that is, a pair of end portions 68*u*, 68*v*, and a link portion 68*w* with L-like cross section between the end portions. The pair of end portions 68*u*, 68*v* are connected to the link portion 68*w* with the screw 204 such that the respective positions are adjustable to allow the sewing window 69 to be retractable in the longitudinal direction.

According to the example, the single sewing frame 68 covers the tubular sewing cloth with different width and embroidery range, thus, ensuring the maximum embroidery range. The sewing window is retractable while changing its shape between the rectangle and the trapezoid. Accordingly, the single sewing frame 68 may be used for processing the irregularly shaped cloth such as the boot-cut jeans without requiring the frame replacement.

SECOND MODIFIED EXAMPLE

Figure 56:
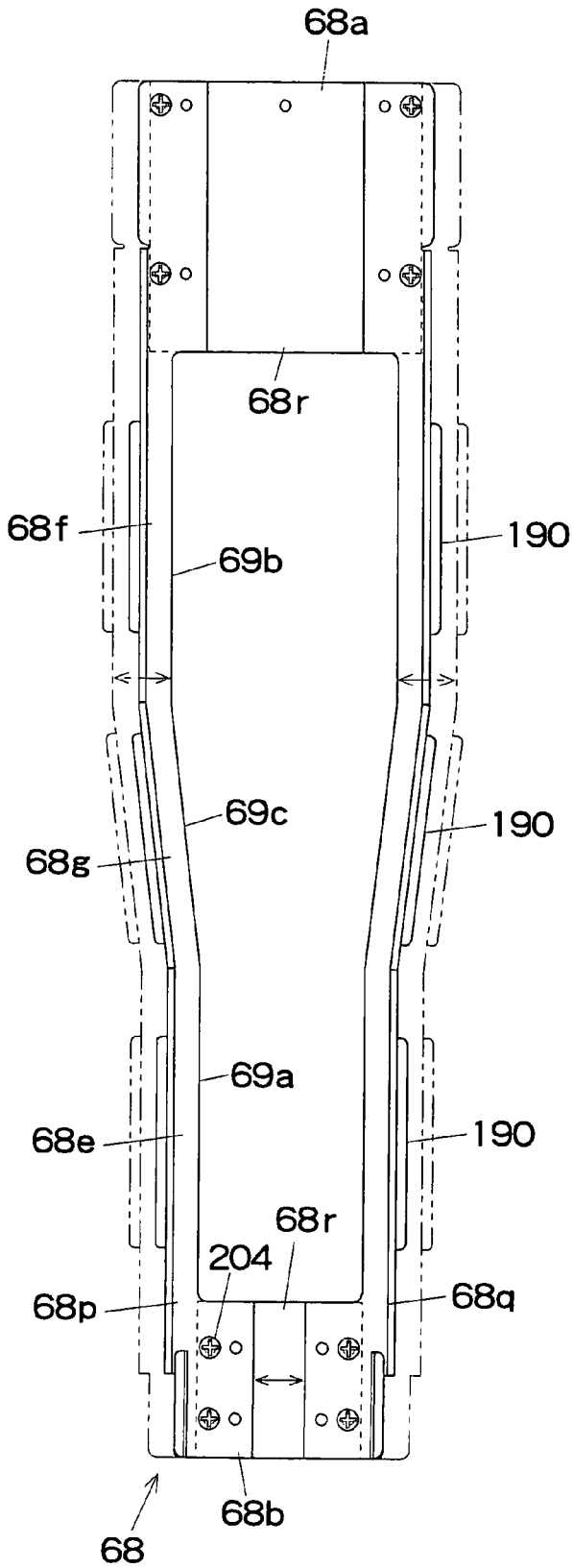
FIG. 56 is a plan view showing a second modified example of the fourteenth embodiment.

The second modified example according to the fourteenth embodiment shown in FIG. 56 is different from the embodiment in that: the sewing frame 68 is formed of a narrow front portion 68*e*, a wide rear portion 68*f* and a tapered intermediate portion 68*g*; a narrow portion 69*a* of the sewing window 69 is formed in the front portion 68*e*; a wide portion 69*b* is formed in the rear portion 68*f*; and a tapered portion 69*c* is formed in the intermediate portion 68*g*. The sewing frame 68 is divided into three parts in the lateral direction, that is, a pair of end portions 68*p*, 68*q* and a link portion 68*r* between the end portions 68*p* and 68*q*. The pair of end portions 68*p*, 68*q* are connected to the link portion 68*r* with the screw 204 such that the sewing window 69 is retractable in the lateral direction.

According to the example, in the case where the embroidery pattern is processed on the narrow portion of the tubular sewing cloth W (for example, the bottoms of trousers), it is applied to the narrow portion 69*a*. In the case where the embroidery pattern is processed on the wide portion of the tubular sewing cloth W (for example, the hip portion of the trousers), it is applied to the wide portion 69*b*. In this case, the processing of the irregularly shaped cloth such as the boot-cut jeans requires no frame replacement. The single kind of the sewing frame 68 may be used to efficiently process the embroidery pattern with different size for the narrow portion and the wide portion of the sewing cloth. The retraction of the sewing window 69 may provide the same effects as those of the first modified example.

THIRD MODIFIED EXAMPLE

Figure 57A:
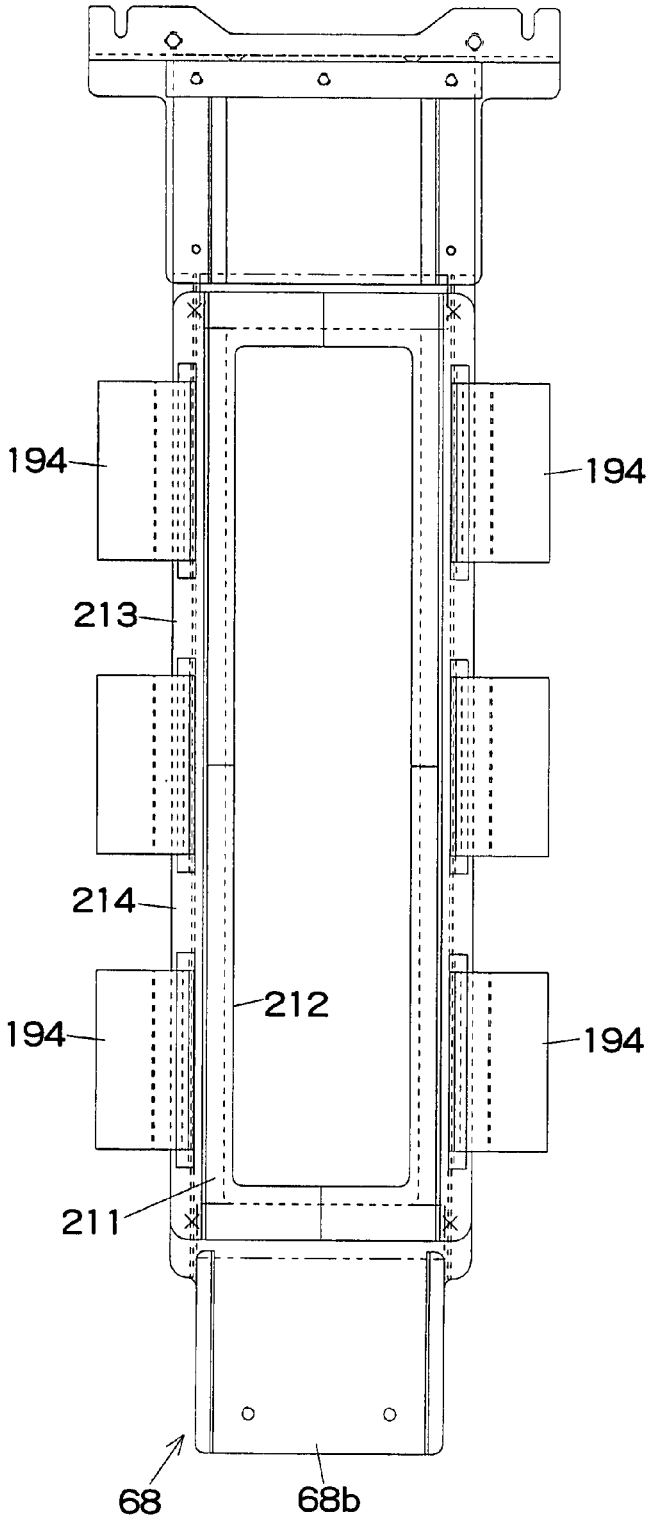
FIG. 57A is a plan view and FIG. 57B is a side view.
Figure 57B:
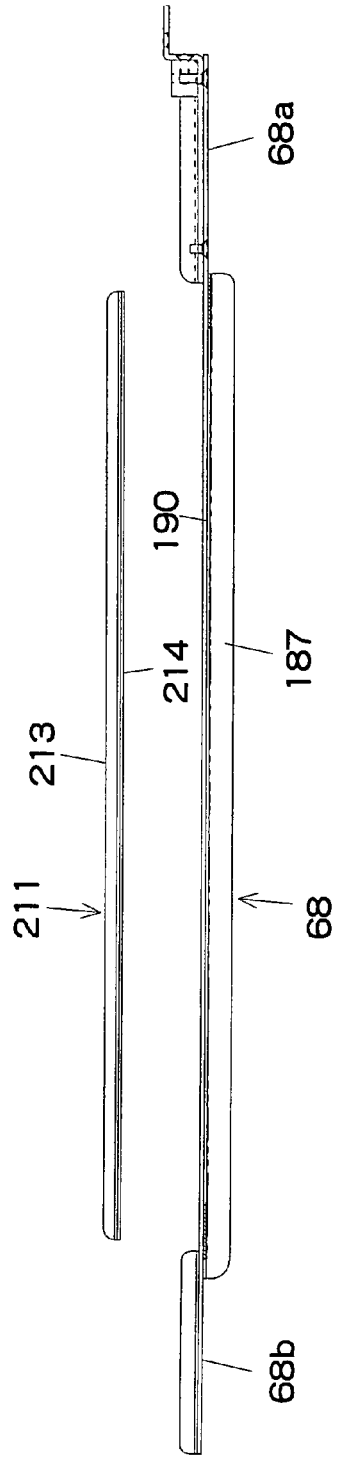
Figure 58:
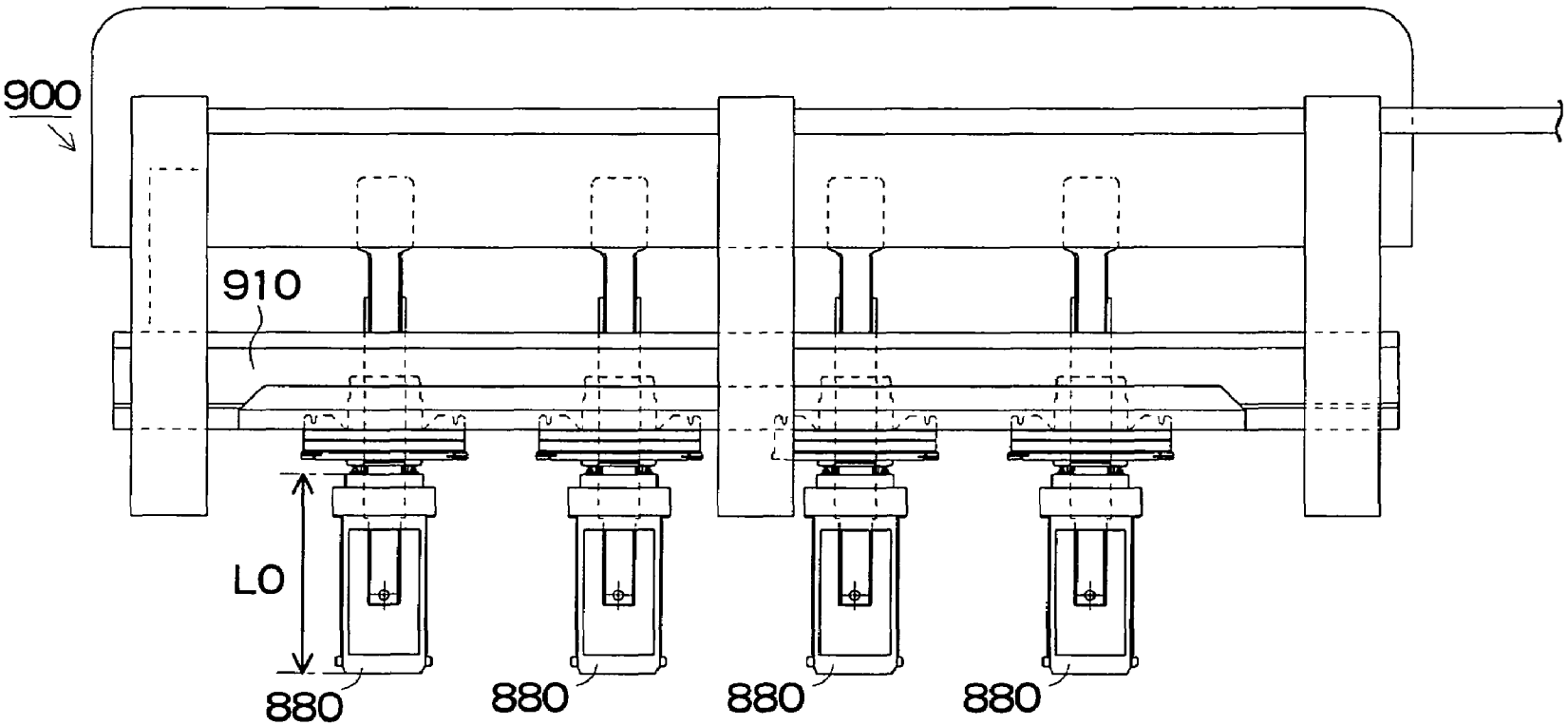
FIG. 58 is a plan view showing a sewing frame and a drive mechanism according to the related art.

The sewing frame 68 according to the third modified example of the fourteenth embodiment shown in FIG. 57 includes a long and narrow flat holding frame 211 for holding the periphery of the embroidery range of the tubular sewing cloth. The holding frame 211 is provided with a transparent window 212 having substantially the same shape as that of the sewing window 69 of the sewing frame 68. In the example, the sewing frame 68 is simply structured to have a single reinforcing rib 187 (corresponding to the reference numeral 188), and a cloth stopper outward. The holding frame 211 is also simply structured to have the reinforcing rib 213 upward and the cloth stopper 214 outward. The sewing frame 68 is covered with the tubular sewing cloth, and the periphery of the embroidery range of the tubular sewing cloth is pressed by the holding frame 211 on the sewing frame 68 such that the cloth is fixed through gripping of the cloth stoppers 190 and 214 with the clips 194.

In the example, as the strength of the sewing frame 68 and the holding frame 211 may further be intensified, the structure of the side which is likely to be affected by the embroidery area is simplified, which may be applicable to the long tubular sewing cloth such as the trousers and the sleeve.

The fourteenth embodiment may be put into the practical use by modifying it as follows.

(1) The sewing frame 68 is used for embroidery processing on the relatively short tubular sewing cloth such as the T-shirt, the pillow cover and the like.

(2) The sewing frame 68 is used for embroidery processing on the flat material such as the bath towel and muffler.

(3) In the case where the sewing cloth is too narrow in the width to be fixed with the clip 194, the cloth is applied to the sewing frame 68 at a plurality of positions around the sewing window 69 using the two-sided stick tape.

Note that the present invention is not limited by the embodiments described above, and modifications within a range that does not depart from the spirit of the present invention are possible.

What is claimed is:

1. A sewing frame of a sewing machine for extending and holding a sewing material comprising:

supported portions each provided at a front end and a rear end of the sewing frame, the supported portions being supported at a front frame side portion and a rear frame side portion of a rectangular support frame so as to be movable in a lateral direction relative to the retangular support frame, wherein the rectangular support frame is movable in a longitudinal direction and unmovable in the lateral direction.

2. The sewing frame of a sewing machine according to claim 1, wherein:

the sewing frame is cylindrical and includes a cylindrical inner frame which is inserted into the sewing frame and supported at the rear frame side portion of the support frame so as not to be rotated;

the supported portion which is supported at the front frame side portion of the support frame is provided at a front end of the inner frame; and an opening with a size which allows an operator's hand to be inserted into the inner frame is formed in the front end of the inner frame.

3. The sewing frame of a sewing machine according to claim 1,wherein:

the sewing frame has a longitudinally long cylindrical shape and includes a cylindrical inner frame to be inserted into the sewing frame;

a longitudinally long sewing window is formed in the sewing frame for defining an embroidery range to be processed on a sewing cloth;

a rear end of the sewing frame is provided with a link portion linked to a rotating drive mechanism on the support frame;

a longitudinally long needle hole through which a sewing needle of en embroidery sewing machine pierces is formed in the inner frame;

a rear end of the inner frame is provided with an attachment portion attached to a fixing portion on the support frame; and a front end of one of the sewing frame and the inner frame is provided with a support portion supported at a front frame of the support frame.

4. The sewing frame of a sewing machine according to claim 1, wherein:

the sewing frame has a cylindrical shape, on which a sewing window for defining an embroidery range to be processed on a sewing cloth is formed;

an interliner which covers the sewing window is used to hold the sewing cloth along an outer surface of the sewing frame;

an interliner holding member for pressing the interliner against the sewing frame is provided;

front and rear ends of the interliner holding member are held at the sewing frame to the front and the rear of the sewing window; and a pressure member for pressing an intermediate portion of the interliner holding member against the sewing frame at a longitudinal intermediate portion of the sewing window is provided.

5. The sewing frame of a sewing machine according to claim 4, wherein:

one of the front end and the rear end of the interliner holding member is fixedly held at the sewing frame;

the other end is detachably held at the sewing frame; and the pressure member is provided to the sewing frame so as to be movable between a position overlapping with the interliner holding member and a position remote from the interliner holding member.

6. The sewing frame of a sewing machine according to claim 1, wherein:

the sewing frame comprises a base frame attached to a frame drive unit of the sewing machine and a longitudinally long cloth application frame to which a sewing cloth is applied;

the base frame is provided with a front support portion for supporting a front end of the cloth application frame and a rear support portion for supporting a rear end of the cloth application frame;

a sewing window for defining an embroidery range to be processed on the sewing cloth is formed between the front end and the rear end of the cloth application frame; and a plurality of cloth application frames each having differently shaped sewing window are replaceably attached to the base frame.

7. The sewing frame of a sewing machine according to claim 1, wherein:

the sewing frame is a longitudinally long flat plate and is provided with a longitudinally long sewing window for defining an embroidery range to be processed on a sewing cloth and a reinforcing rib which extends along a longitudinal edge of the sewing window; and a narrow portion is formed in one of a front side and a rear side of the sewing window, and a wide portion is formed in the other side thereof.

8. The sewing frame of a sewing machine according to claim 1, wherein:

the sewing frame is a long and narrow flat plate to be inserted into a tubular sewing cloth and is provided with a long and narrow sewing window for defining an embroidery range to be processed on the tubular sewing cloth; and a peripheral portion of the embroidery range to be processed on the tubular sewing cloth is fixed on an upper surface of the sewing frame.

9. The sewing frame of a sewing machine according to claim 8 wherein:

a positioning jig is detachably provided on the sewing frame; and the positioning jig is provided with a positioning portion with respect to the sewing frame and an opening through which a position of the sewing frame is indicated over the sewing cloth.

10. The sewing frame of a sewing machine according to claim 8, wherein:

the sewing frame is divided into a plurality of portions in one of a lateral direction and a longitudinal direction; and the divided portions are connected while allowing a positional adjustment such that the sewing window is retractable in one of the lateral direction and the longitudinal direction.

11. The sewing frame of a sewing machine according to claim 10, wherein the sewing window is allowed to be retractable while changing the shape thereof between a rectangle and a trapezoid.

12. The sewing frame of a sewing machine according to claim 8,wherein:

a long and narrow flat plate-like holding frame is provided for holding the peripheral portion of the embroidery range to be processed on the tubular sewing cloth on the sewing frame; and a transparent window having substantially the same size as the sewing window of the sewing frame is formed in the holding frame.

13. A sewing frame drive mechanism of a sewing machine for driving a sewing frame for extending and holding a sewing material, the drive mechanism comprising:

a rectangular support frame which is movable in a longitudinal direction and not movable in the lateral direction; and support mechanisms each provided at a front frame side portion and a rear frame side portion of the support frame, wherein the support mechanisms support a front end and a rear end of the sewing frame, respectively, so that the front and rear end of the sewing frame are movable in a lateral direction.

14. The sewing frame drive mechanism of a sewing machine according to claim 13, further comprising a front hang preventive mechanism which prevents the front frame side portion of the support frame from hanging downward with respect to the rear frame side portion.

15. The sewing frame drive mechanism of a sewing machine according to claim 14, wherein the front hang preventive mechanism comprises left and right protruding portions of a table which protrude relatively forward by forming a recess portion from a front side of the table rearward, and left and right frame side portions of the support frame movably disposed in a longitudinal direction on the left and right protruding portions.

16. The sewing frame drive mechanism of a sewing machine according to claim 13, further comprising a guide mechanism which guides a longitudinal movement of the support frame so as not to move in the lateral direction to prevent a lateral shaking.

17. The sewing frame drive mechanism of a sewing machine according to claim 16, wherein the guide mechanism comprises left and right inner end surfaces of a recess portion formed from a front side of a table rearward, and a guide roller attached to left and right frame side portions of the support frame allowed to roll in abutment against the inner end surfaces.

18. The sewing frame drive mechanism of a sewing machine according to claim 17, wherein the guide mechanism further comprises a position adjustment mechanism which adjusts a position of the guide roller in the lateral direction.

19. The sewing frame drive mechanism of a sewing machine according to claim 13, wherein:

front and rear ends of each of a plurality of the sewing frames are supported at the front and rear frame side portions of the support frame by the support mechanism; and a lateral intermediate portion of the front frame side portion of the support frame is supported by a front frame side support mechanism so as to be movable in a longitudinal direction, and so as not to have a front portion hung downward.

20. The sewing frame drive mechanism of a sewing machine according to claim 19, wherein the front frame side support mechanism comprises a longitudinally extending support shaft which is provided movably in the longitudinal direction with the support frame and supports a lateral intermediate portion of the front frame side portion at the front end.

21. The sewing frame drive mechanism of a sewing machine according to claim 19, wherein:

the front frame side support mechanism comprises a support frame fixed to a sewing machine frame and a support shaft which is provided to the support frame so as to be movable in the longitudinal direction;

a front end of the support shaft is provided with a support portion for supporting the lateral intermediate portion of the front frame side portion; and a front end of the support frame is provided with an anti-vibrating device in contact with at least an upper surface of the support shaft for regulating vibration of the shaft.

22. The sewing frame drive mechanism of a sewing machine according to claim 19, wherein the support mechanism comprises a link member linked to the lateral intermediate portion of the support frame and a bearing member for bearing the link member movably in the longitudinal direction at a lower side of the support frame.

* * * * *